US006944415B2

(12) United States Patent
Nomura

(10) Patent No.: US 6,944,415 B2
(45) Date of Patent: Sep. 13, 2005

(54) IMAGE CARRIER CARTRIDGE HAVING MULTIPLE IMAGE CARRIERS

(75) Inventor: Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 10/392,331

(22) Filed: Mar. 20, 2003

(65) Prior Publication Data

US 2004/0022556 A1 Feb. 5, 2004

(30) Foreign Application Priority Data

Mar. 20, 2002 (JP) ..... 2002-077609
Mar. 20, 2002 (JP) ..... 2002-077610
Mar. 20, 2002 (JP) ..... 2002-077611

(51) Int. Cl.[7] ..... G03G 15/16; G03G 21/18
(52) U.S. Cl. ..... 399/111; 399/113; 399/301
(58) Field of Search ..... 399/12, 13, 110–113, 399/298, 301–303, 299

(56) References Cited

U.S. PATENT DOCUMENTS 6,522,861 B2 * 2/2003 Tokutake et al. ..... 399/299
6,647,227 B2 * 11/2003 Yokoi et al. ..... 399/111
6,708,011 B2 * 3/2004 Nomura et al. ..... 399/110

FOREIGN PATENT DOCUMENTS

JP 63-271275 11/1988
JP 9-304994 11/1997

* cited by examiner

*Primary Examiner*—William J. Royer
(74) *Attorney, Agent, or Firm*—Sughrue Mion, PLLC

(57) ABSTRACT

In an image forming apparatus of a tandem type having at least two image forming stations each of which having an image carrier, and a charging device arranged around the image carrier and capable of forming an image. Additionally, a plurality of the image carriers are mounted at proper relative positions to an image carrier cartridge which is detachable relative to the apparatus body. Developing devices are designed to be detachable relative to the respective image carriers mounted to the image carrier cartridge. Writing devices and a transferring device are mounted at proper positions. The cartridge is provided with a storage device for storing information on color registration errors and color registration errors are corrected by a correcting device.

44 Claims, 36 Drawing Sheets

IMAGE CARRIER CARTRIDGE HAVING MULTIPLE IMAGE CARRIERS

BACKGROUND OF THE INVENTION

The present invention relates to an image carrier cartridge and an image forming apparatus and, more particularly, to an image carrier cartridge and an image forming apparatus of tandem type in which a plurality of image carriers are united into a cartridge which is designed to be detachable from the image forming apparatus, thereby improving the maintainability and allowing the correction of color registration errors.

Generally, a toner image forming means of electrophotographic type comprises a photoreceptor as an image carrier having a photosensitive layer on the outer surface thereof, a charging means for uniformly charging the outer surface of the photoreceptor, an exposure means for selectively exposing the outer surface, uniformly charged by the charging means, to light to form an electrostatic latent image on the outer surface, and a developing means for applying toner as a developer to an electrostatic latent image formed by the exposure means to form a visible image (toner image).

As a tandem-type image forming apparatus for forming a color image, there is an apparatus of a type employing an intermediate transfer belt method in which a plurality of (for example, four) toner image forming means as described above are arranged relative to an intermediate transfer belt (as an example of transfer belts). Toner images formed on the photoreceptor by these unicolor toner image forming means are transferred to the intermediate transfer belt so that the toner images of plural colors (for example, yellow, cyan, magenta, black) are superposed on each other, thereby forming a color image on the intermediate transfer belt.

As a tandem-type image forming apparatus for forming a color image, there is an apparatus of a type employing a paper delivery method in which a recording medium (for example, a paper sheet) is held and carried by a recording medium holding belt (as an example of transfer belts). Toner images formed by a plurality of unicolor toner image forming means are sequentially transferred to the recording medium so that the toner images of plural colors are superposed on each other, thereby forming a color image on the recording medium. In such an image forming apparatus of tandem type, a color registration error, i.e. relative deviation of respective color printed positions, may occur due to a positional error of image carriers or a tolerance of diameter of a photosensitive drum. The color registration error makes the quality of color image poorer. Therefore, means of preventing the color registration error have been taken. An example of such preventing means is disclosed in Japanese Patent Unexamined Publication S63-271275, in which image register marks are formed on a transfer belt by an image forming apparatus and these marks are read out by detecting sensors, thereby correcting a color registration error. That is, the means disclosed in Japanese Patent Unexamined Publication S63-271275 detects a color registration error within the image forming apparatus. Accordingly, even when one or more of color image positions are shifted, the color registration error can be corrected by replacing the corresponding image carrier or the like.

Further, an example of such preventing means is disclosed in Japanese Patent Unexamined Publication H9-304994, in which a plurality of image carriers are integrally supported. In an embodiment thereof, developing means are also supported integrally with the image carriers. Therefore, the positioning accuracy of the image carriers in an apparatus body is improved, whereby the possibility of color registration error is reduced and the maintainability is improved. In addition, there is no possibility of insertion error of image carriers.

The means disclosed in Japanese Patent Unexamined Publication S63-271275 can achieve the correction of color registration error without increasing the precision of parts. However, since the detection sensors for detecting the image register marks are required, there is a problem of increase in cost. Further, there is also a problem that toner is consumed for forming the image register marks and a problem that the image forming operation should be suspended during the positioning operation, thus degrading the operating efficiency of the image forming apparatus. On the other hand, the means disclosed in Japanese Patent Unexamined Publication H9-304994 prevents the color registration error by improving the relative positioning accuracy of the image carriers as described above. However, with the recent increase of resolution and quality of image, required precision of color registration is increased. Therefore, the method of integrating the image carriers as disclosed in Japanese Patent Unexamined Publication H9-304994 is no longer enough to improve the positioning accuracy of the image carriers. While the positioning accuracy of the image carriers may be improved by further increasing the precision of parts, there is a problem that the costs of the parts become extremely high.

SUMMARY OF THE INVENTION

The present invention has been made in consideration of these problems of the prior arts. Therefore, it is an object of the present invention to improve the maintainability of an image carrier cartridge and reduce the running cost of an image forming apparatus of tandem type. It is another object of the present invention to provide an image forming apparatus in which information on color registration error is stored in a cartridge and an apparatus body is provided with a correction means to thereby achieve the correction of color registration error.

An image carrier cartridge of a first aspect of the present invention for achieving the aforementioned object is designed to be detachable relative to an image forming apparatus of a tandem type which comprises at least two image forming stations each of which is composed of an image carrier, and a charging means, a writing means, a developing means, and a transfer means which are arranged around the image carrier, wherein the image forming apparatus forms a color image by passing a transfer medium through the respective stations. The image carrier cartridge supports a plurality of the image carriers together and comprises:

a positioning member for positioning the image carriers at proper relative positions;

an electronic module having a storage means in which information about color registration error is stored; and a signal connecting means between the electronic module and the image forming apparatus body.

In the image carrier cartridge of the first aspect of the present invention, the information on color registration error is formed as follows: (1) The information on color registration error is formed on the basis of the respective positions of the image carriers. (2) The information on color registration error is formed on the basis of the respective profiles of the image carriers. (3) The information on color registration error is formed on the basis of the respective positions of the image carriers relative to a positioning member of the cartridge for positioning the cartridge relative to the image forming apparatus body. (4) The positioning member of the cartridge for positioning the cartridge relative to the image forming apparatus body is a shaft of the image carrier for a reference color and the information on color registration error is formed on the basis of the positions of the other image carriers relative to the image carrier for the reference color. (5) The information on color registration error is formed on the basis of the coefficient of linear expansion of the positioning member for the image carriers.

In the image carrier cartridge of the first aspect of the present invention, driving force produced at one portion of the apparatus body diverges and is transmitted to all of a plurality of the image carriers within the image carrier cartridge. The image carrier cartridge has no cleaning means disposed around the image carriers for collecting remaining developer.

An image forming apparatus of the first aspect of the present invention is of a tandem type and comprises at least two image forming stations each of which is composed of an image carrier, and a charging means, a writing means, a developing means, and a transfer means which are arranged around the image carrier, wherein the image forming apparatus forms a color image by passing a transfer medium through the respective stations. The image forming apparatus comprises;

an image carrier cartridge having a positioning member for positioning the image carriers at proper relative positions; an electronic module having a storage means in which information about color registration error is stored; and a signal connecting means between the electronic module and the image forming apparatus body, wherein the image carrier cartridge is designed to be detachable relative to the image forming apparatus body and supports a plurality of the image carriers together; and a correcting means for correcting color registration errors on the basis of a signal from said electronic module.

The image forming apparatus of the first aspect of the present invention, the information on color registration error stored in said storage means is information as described in any of the aforementioned (1) through (5).

According to the image carrier cartridge and the image forming apparatus of the first aspect of the present invention, the cartridge supporting a plurality of the image carriers together is designed to be detachable relative to the apparatus body as described above, thereby improving the maintainability of the image carrier cartridge and reducing the running cost. In addition, the cartridge has information of color registration error such as positioning error of image carriers, whereby the color registration error can be corrected during the image formation by the image forming apparatus so as to achieve image formation without color registration error. Further, the reduction in precision of machining and assembling the positioning member is allowed. Since the storage means stores information on color registration error inherent in each cartridge, the formation of an image without color registration error is obtained even if the cartridge is replaced.

An image carrier cartridge of a second aspect of the present invention for achieving the aforementioned object is designed to be detachable relative to an image forming apparatus of a tandem type which comprises at least two image forming stations each of which is composed of an image carrier, and a charging means, a writing means, a developing means, and a transfer means which are arranged around the image carrier, wherein the image forming apparatus forms a color image by passing a transfer medium through the respective stations. The image carrier cartridge supports a plurality of the image carriers together and comprises:

a positioning member for positioning the image carriers at proper relative positions;

writing means located at positions corresponding to the respective image carriers;

an electronic module having a storage means in which information about color registration error is stored; and a signal connecting means between the electronic module and the image forming apparatus body.

In the image carrier cartridge of the second aspect of the present invention, the information on color registration error is formed as follows: (1) The information on color registration error is formed on the basis of the respective positions of the image carriers. (2) The information on color registration error is formed on the basis of the respective writing positions of the image carriers. (3)The information on color registration error is formed on the basis of the respective parallelisms of the writing means relative to the axes of the image carriers. (4) The information on color registration error is formed on the basis of the respective positions of the image carriers relative to a positioning member of the cartridge for positioning the cartridge relative to the image forming apparatus body. (5)The positioning member of the cartridge for positioning the cartridge relative to the image forming apparatus body is a shaft of the image carrier for a reference color and wherein the information on color registration error is formed on the basis of the positions of the other image carriers relative to the image carrier for the reference color. (6) The information on color registration error is formed on the basis of the coefficient of linear expansion of the positioning member for the image carriers. (7) The information on color registration error is formed on the basis of the rotational error of the image carrier due to the driving force transmitting member for the image carriers provided on the image carrier cartridge.

In the image carrier cartridge of the second aspect of the present invention, driving force produced at one portion of the apparatus body diverges and is transmitted to all of a plurality of the image carriers within the image carrier cartridge. The image carrier cartridge has no cleaning means disposed around the image carriers for collecting remaining developer.

An image forming apparatus of the second aspect of the present invention is of a tandem type and comprises at least two image forming stations each of which is composed of an image carrier, and a charging means, a writing means, a developing means, and a transfer means which are arranged around the image carrier, wherein the image forming apparatus forms a color image by passing a transfer medium through the respective stations. The image forming apparatus comprises:

an image carrier cartridge having a positioning member for positioning the image carriers at proper relative positions; an electronic module having a storage means in which information on color registration error is stored; writing means located at positions corresponding to the respective image carriers; and a signal connecting means between the electronic module and the image forming apparatus body, wherein the image carrier cartridge is designed to be detachable relative to the image forming apparatus body and supports a plurality of the image carriers together; and a correcting means for correcting color registration errors on the basis of a signal from the electronic module.

The image forming apparatus of the second aspect of the present invention, the information on color registration error stored in the storage means is information as described in any of the aforementioned (1) through (7).

According to the image carrier cartridge and the image forming apparatus of the second aspect of the present invention, the cartridge supporting a plurality of the image carriers and the writing means together is designed to be detachable relative to the apparatus body as described above, thereby improving the maintainability of the image carrier cartridge and reducing the running cost. In addition, the cartridge has information of color registration error such as positioning error of image carriers, whereby the color registration error can be corrected during the image formation by the image forming apparatus so as to achieve the image formation without color registration error. Further, the reduction in precision of machining and assembling the positioning member is allowed. Since the storage means stores information on color registration error inherent in each cartridge, the formation of an image without color registration error is obtained even if the cartridge is replaced.

An image carrier cartridge of a third aspect of the present invention for achieving the aforementioned object is designed to be detachable relative to an image forming apparatus of a tandem type which comprises at least two image forming stations each of which is composed of an image carrier, and a charging means, a writing means, a developing means, and a transfer means which are arranged around the image carrier, wherein the image forming apparatus forms a color image by passing a transfer medium through the respective stations. The image carrier cartridge supports a plurality of the image carriers together and comprises:

a positioning member for positioning the image carriers at proper relative positions;

writing means located at positions corresponding to the respective image carriers;

a transfer means arranged to be in contact with a plurality of the image carriers;

an electronic module having a storage means in which information on color registration error is stored; and a signal connecting means between the electronic module and the image forming apparatus body.

In the image carrier cartridge of the third aspect of the present invention, the information on color registration error is formed as follows: (1) The information on color registration error is formed on the basis of the respective writing positions of the image carriers. (2) The information on color registration error is formed on the basis of the respective transfer positions on the image carriers. (3) The information on color registration error is formed on the basis of the coefficient of linear expansion of the positioning member for the image carriers. (4) The information on color registration error is formed on the basis of the rotational error of the image carrier due to the driving force transmitting member for the image carriers provided on the image carrier cartridge.

In the image carrier cartridge of the third aspect of the present invention, driving force produced at one portion of the apparatus body diverges and is transmitted to all of the plurality of the image carriers within the image carrier cartridge. The image carrier cartridge has no cleaning means disposed around the image carriers for collecting remaining developer.

An image forming apparatus of the third aspect of the present invention is of a tandem type and comprises at least two image forming stations each of which is composed of an image carrier, and a charging means, a writing means, a developing means, and a transfer means which are arranged around the image carrier, wherein the image forming apparatus forms a color image by passing a transfer medium through the respective stations. The image forming apparatus comprises:

an image carrier cartridge having a positioning member for positioning the image carriers at proper relative positions; an electronic module having a storage means in which information on color registration error is stored; writing means located at positions corresponding to the respective image carriers; a transfer means arranged to be in contact with a plurality of the image carriers; and a signal connecting means between the electronic module and the image forming apparatus body, wherein the image carrier cartridge is designed to be detachable relative to the image forming apparatus body and supports a plurality of the image carriers together; and a correcting means for correcting color registration errors on the basis of a signal from the electronic module.

The image forming apparatus of the third aspect of the present invention, the information on color registration error stored in the storage means is information as described in any of the aforementioned (1) through (4).

According to the image carrier cartridge of the third aspect of the present invention, the cartridge supporting a plurality of the image carriers together is designed to be detachable relative to the apparatus body as described above, thereby improving the maintainability of the image carrier cartridge and reducing the running cost. In addition, the cartridge has information of color registration error such as positioning error of image carriers, whereby the color registration error can be corrected during the image formation by the image forming apparatus so as to achieve the image formation without color registration error. Further, the reduction in precision of machining and assembling the positioning member is allowed. Since the storage means stores information on color registration error inherent in each cartridge, the formation of an image without color registration error is obtained even if the cartridge is replaced.

According to the image forming apparatus of the third aspect of the present invention, a plurality of the image carriers and the writing means are attached to the image carrier cartridge at proper relative positions and the transfer means is arranged to be in contact with a plurality of the image carriers, wherein the image carrier cartridge is detachable relative to the apparatus body. The developing means are designed to be detachable relative to the image carriers housed in the image carrier cartridge, thereby improving positioning accuracy of the image carriers relative to each other and also improving the transfer position accuracy. Further, color registration errors due to positional error and error in parallelism of the image carrier, and error in transfer position can be prevented.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
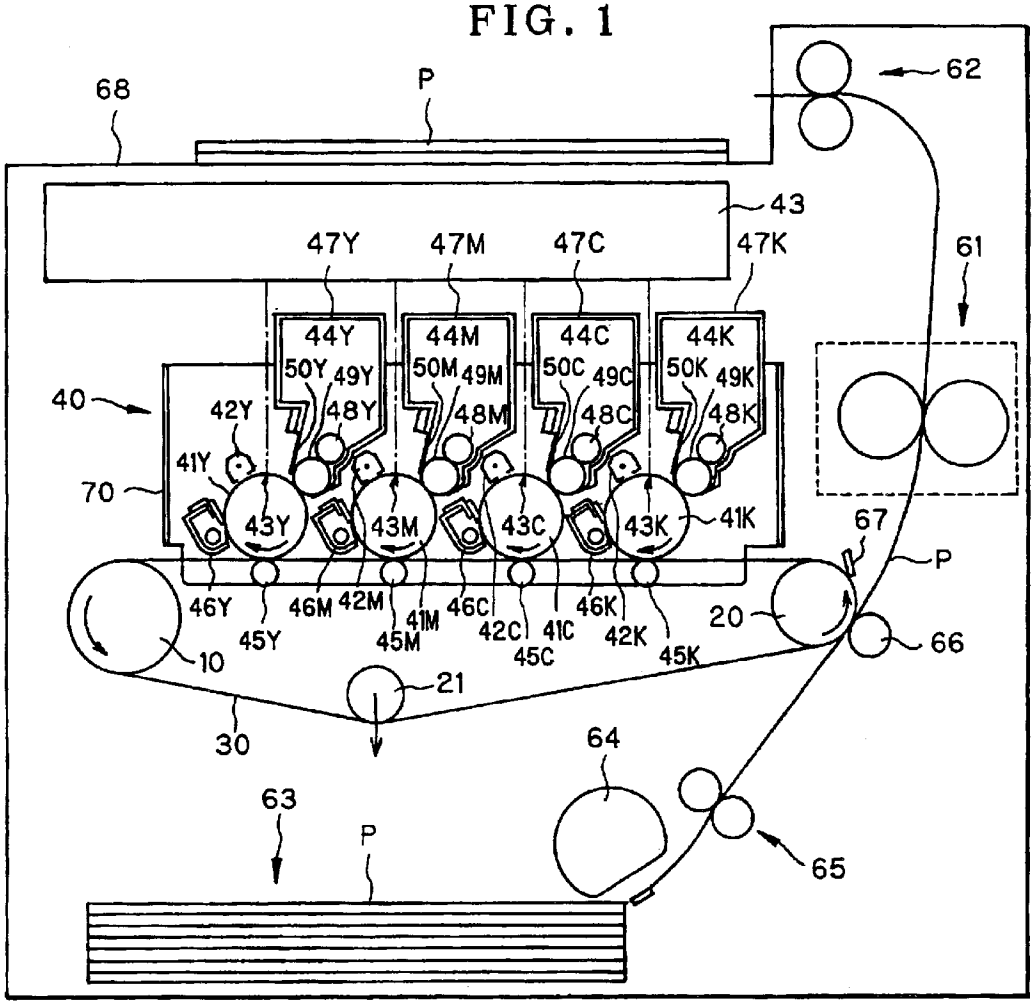
FIG. 1 is a front view showing the entire schematic structure of an image forming apparatus to which the present invention is adopted.

Hereinafter, an image carrier cartridge and an image forming apparatus of the present invention will be described with regard to embodiments. FIG. 1 is a front view showing the entire schematic structure of an image forming apparatus to which the present invention is adopted. As shown in FIG. 1, the image forming apparatus has an intermediate transfer belt 30 stretched between a driving roller 10 and a driven roller 20 with tension applied thereto by a tension roller 21 and driven to circulate in the direction of arrows shown in FIG. 1 (counter clockwise direction) by the driving roller 10. Four photoreceptors (photosensitive drums) 41K, 41C, 41M and 41Y are arranged at predetermined intervals to face the intermediate transfer belt 30. Each photoreceptor has a photosensitive layer on the outer peripheral surface thereof to serve as an image carrier. Suffixes "K", "C", "M", and "Y" added to reference numerals indicate black, cyan, magenta, and yellow, respectively. That is, the photoreceptors designated by reference numerals with such suffixes are photoreceptors for black, cyan, magenta, and yellow, respectively. The same is true for other members. The photoreceptors 41K, 41C, 41M and 41Y are driven to rotate in the direction of arrows shown in FIG. 1 (clockwise direction) synchronously with the driving of the intermediate transfer belt 30.

Arranged around each photoreceptor 41 (K, C, M, Y) are a corona charger 42 (K, C, M, Y), composed of a scorotron, as a charging means for uniformly charging the outer peripheral surface of the photoreceptor 41 (K, C, M, Y), an exposure position 43 (K, C, M, Y) for selectively exposing the outer peripheral surface of the photoreceptor 41 (K, C, M, Y), which has been uniformly charged by the charging means 42 (K, C, M, Y), to light corresponding to each color image emitted from an exposure unit 43 so as to form an electrostatic latent image. Also arranged are a developing device 44 (K, C, M, Y) for applying toner as a developer to the electrostatic latent image formed at the exposure position (K, C, M, Y) to form a visible image (toner image), a primary transfer roller 45 (K, C, M, Y) serving as transfer means for sequentially transferring the toner image developed by the developing device 44 (K, C, M,. Y) onto the intermediate transfer belt 30 as a primary transfer target, and a cleaning device 46 (K, C, M, Y) as cleaning means for removing the toner remaining on the surface of the photoreceptor 41 (K, C, M, Y) after the transfer of the toner image. The developing device 44 (K, C, M, Y) uses, for example, a non-magnetic single-component toner as a developer and comprises a developing cartridge 47 (K, C, M, Y) (see FIG. 3). The single-component developer stored in the developing cartridge 47 (K, C, M, Y) is conveyed to a development roller 49 (K, C, M, Y) through a supply roller 48 (K, C, M, Y) and the thickness of a developer layer adhering to the surface of the development roller 49 (K, C, M, Y) is regulated with a regulating blade 50 (K, C, M, Y). The development roller 49 (K, C, M, Y) is brought into contact with or pressed against the photoreceptor 41 (K, C, M, Y) to allow the developer to adhere to the surface of the photoreceptor 41 (K, C, M, Y) according to the electric potential level thereof, thereby developing the electrostatic latent image into a toner image.

Toner images of black, cyan, magenta and yellow formed by unicolor toner image forming stations for the four colors are sequentially primarily transferred onto the intermediate transfer belt 30 by a primary transfer bias voltage applied to the respective primary transfer rollers 45 (K, C, M, and Y). Accordingly, the toner images are superimposed on each other on the intermediate transfer belt 30 to form a full-color toner image, which is then secondarily transferred onto a recording medium "P" at a secondary transfer roller 66. The transferred full-color toner image is fixed on the recording medium "P" by passing between a pair of fixing rollers 61 which form a fixing device. Then, the recording medium "P" is discharged through a pair of sheet delivery rollers 62 onto an outfeed tray 68 formed on the top of the apparatus body. In FIG. 1, reference numeral 63 designates a sheet cassette in which a stack of a large number of recording media "P" is held, 64 designates a pickup roller for picking up the recording medium "P" from the sheet cassette 63 one by one, 65 designates a pair of gate rollers for regulating the timing at which each recording medium "P" is supplied to the secondary transfer portion at the secondary transfer roller 66. Moreover, numeral 66 designates the secondary transfer roller as a secondary transfer means for forming the secondary transfer portion together with the intermediate transfer belt 30, 67 designates a cleaning blade as cleaning means for removing the toner remaining on the surface of the intermediate transfer belt 30 after the secondary transfer.

The reason why the developing device 44K for black is located most upstream and the developing device 44Y for yellow is located most downstream in the circulating direction of the intermediate transfer belt 30 will be explained below. Upon the occurrence of fog, black is the most conspicuous color by its fog and yellow is the most inconspicuous color by its fog when transferred onto the recording medium "P". The phenomenon "fog" is caused by toner particles which are undesirably charged into a polarity opposite to the normal polarity by the developing device during reversal development or the like. According to the above arrangement, the black toner which is the most conspicuous color by its fog is first transferred to the intermediate transfer belt 30 so as to form the lowermost layer on the intermediate transfer belt 30. Since possible fog toner particles in the black toner continuously adhere to the intermediate transfer belt 30 by image force or the like, the toner particles are hardly transferred to the recording medium "P" at the secondary transfer portion. On the other hand, since the yellow toner which is the most inconspicuous color by its fog forms the uppermost layer on the intermediate transfer belt 30 so that possible fog toner particles in the yellow toner adhere as the uppermost layer on the intermediate transfer belt 30 , the toner particles are easily transferred to the recording medium "P". However, yellow fog toner is inconspicuous. Therefore, according to the arrangement as described above, the black toner which is the most conspicuous color by its fog is relatively hardly transferred to the recording medium "P" and the yellow toner which is the most inconspicuous color by its fog is relatively easily transferred to the recording medium "P", with the result that the fog does not stand out as a whole. In addition, since the non-magnetic single-component toner is used as a developer, the necessity of a carrier which is required in the case of using a two-component developer can be eliminated, thereby reducing the volume of each developing device 44 (K, C, M, Y) and thus reducing the size of the color image forming apparatus.

Figure 2:
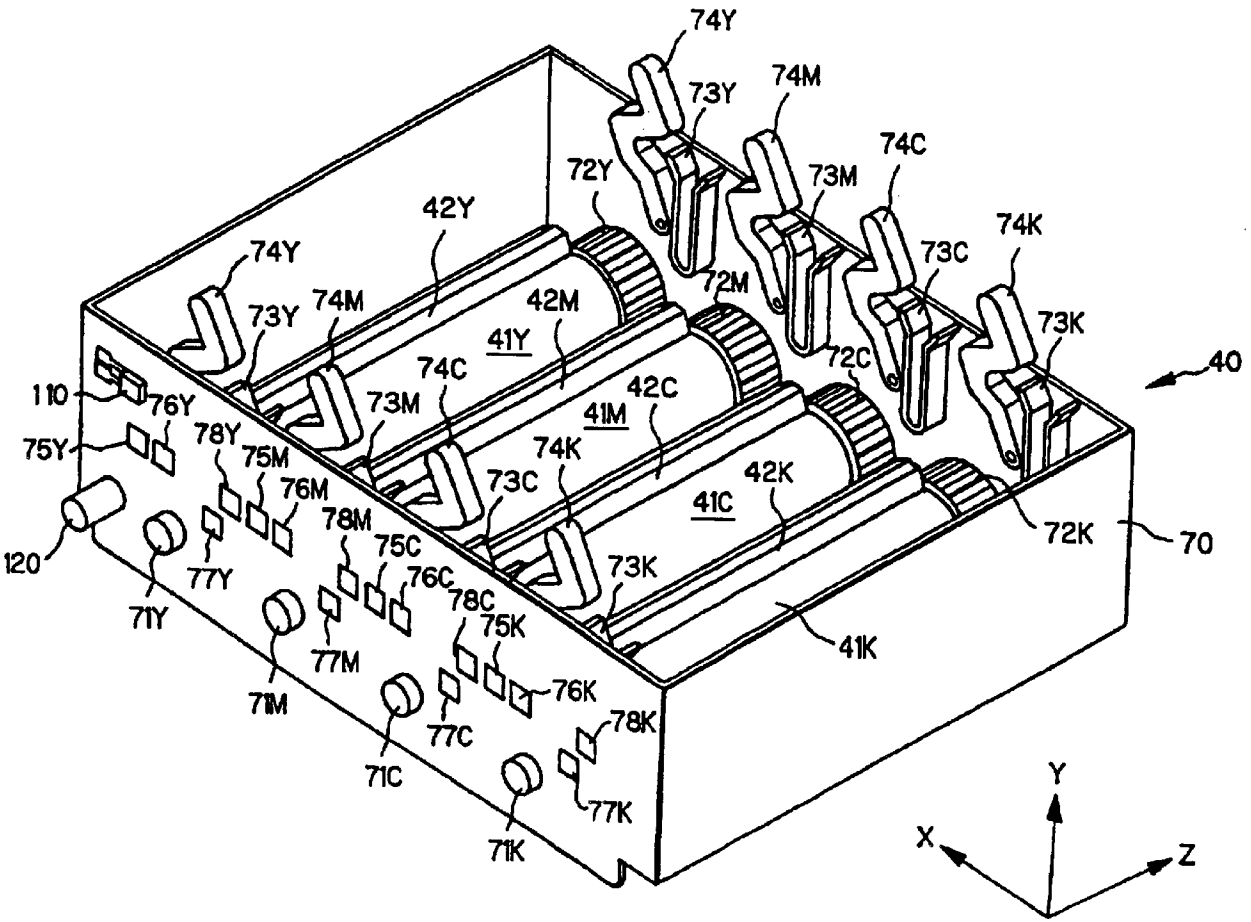
FIG. 2 is a perspective view of a photoreceptor cartridge alone in a state that developing cartridges are detached.
Figure 3:
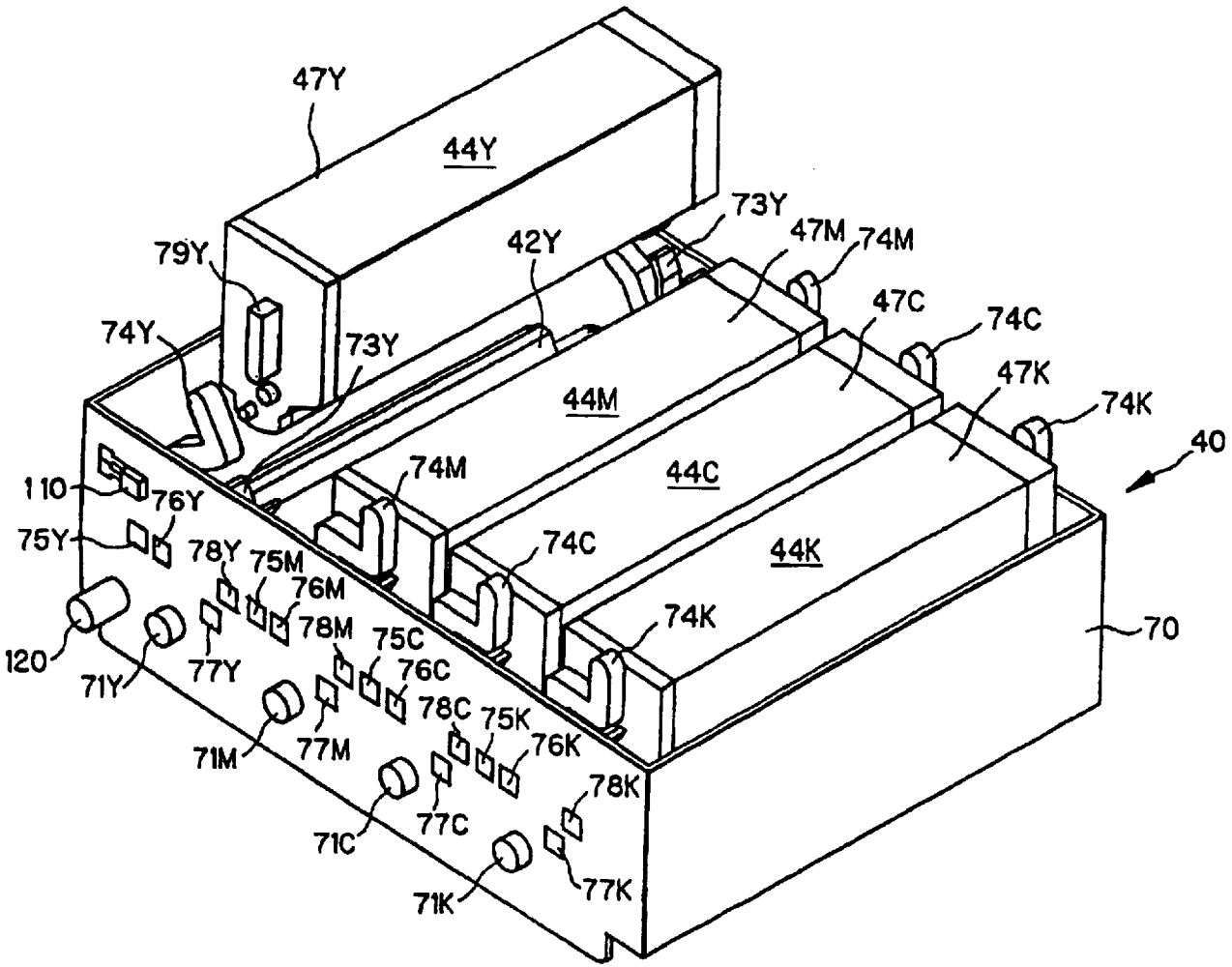
FIG. 3 is a perspective view of the photoreceptor cartridge in a state that some developing cartridges are attached and another developing cartridge is in the attaching process.

FIG. 2 is a perspective view of a photoreceptor cartridge 40 alone in a state that the developing devices 44K, 44C, 44M, and 44Y are detached. FIG. 3 is a perspective view of the photoreceptor cartridge 40 in a state that the developing devices 44K, 44C, and 44M are attached and the developing device 44Y is detached. The following description will be made as regard to FIG. 2 and FIG. 3.

A frame 70 has a rectangular shape. The four photoreceptors 41K, 41C, 41M, 41Y are disposed between both side plates of the rectangular frame 70 such that the photoreceptors 41K, 41C, 41M, 41Y are spaced apart from each other at predetermined interval and parallel to each other. The photoreceptors 41K, 41C, 41M, 41Y are rotatably supported by shafts 71K, 71C, 71M, 71Y, respectively. Gears 72K, 72C, 72M, 72Y are fixed to one end of the shafts 71 (K, C, M, and Y) of the photoreceptors 41 (K, C, M, and Y), respectively, so that the photo receptors 41 (K, C, M, and Y) are synchronized at the same speed via a gear train as will be described later to rotate in the direction of arrows in FIG. 1 (clockwise direction). Also arranged between side plates of the frame 70 are the corona chargers 42 (K, C, M, and Y) composed of scorotrons and the cleaning devices 46 (K, C, M, and Y) (blocked from view because they are behind the photoreceptors 41 (K, C, M, and Y) and the frame 70 as seen in FIG. 2) in place, which are associated with the photoreceptors 41 (K, C, M, and Y), respectively.

Further, electrodes 75 (K, C, M, and Y) for applying high voltage to discharge wires of the scorotrons of the respective corona chargers 42 (K, C, M, and Y), and electrodes 76 (K, C, M, and Y) for applying high voltage to charge grids of the scorotrons are disposed on one surface of the side plate of the frame 70. Also disposed on the one surface of the side plate of the frame 70 are electrodes 77 (K, C, M, and Y) for applying a developing bias voltage to the development rollers 49 (K, C, M, and Y), and electrodes 78 (K, C, M, and Y) for applying a supplying bias voltage to the supply rollers 48 (K, C, M, and Y) of the developing devices 44 (K, C, M, and Y) in a state that the developing devices 44 (K, C, M, and Y) are attached to the photoreceptor cartridge 40. In addition, an IC 110 is also disposed on the same side plate of the frame 70 as a storage means for storing manufacturing information, service condition information, and information on color registration error of the photoreceptor cartridges 40. The IC 110 is an electronic module. Numeral 120 designates a positioning pin for positioning the photoreceptor cartridge 40. The positioning pin 120 is designed to be fitted to a mounting member, not shown, disposed at a predetermined position of a frame of the apparatus body.

In the present invention, the positioning pin 120 is provided for positioning the photoreceptor cartridge 40 as described above. Accordingly, the photoreceptor cartridge 40 can be positioned at a predetermined position (reference position) defined in the apparatus body by the positioning pin 120, whereby the photoreceptors 41 (K, C, M, and Y) accommodated in the frame 70 can be positioned at the predetermined relative positions at once. The information on color registration error stored in the IC 110 is information on color registration error caused by positional error among the photoreceptors (image carriers) as will be described later. Before shipment, it can be judged whether color registration error is caused in the apparatus as a product, for example, by comparing a test pattern to the reference pattern. The information on color registration error as a result of the judgment is stored in the IC 110 as an inherent value of the product. According to the present invention, since the photoreceptor cartridge 40 has the information on color registration error, it is not required to increase the precision of machining and assembling the positioning member, that is, reduction in precision of machining and assembling the positioning member is allowed.

When the photoreceptor cartridge 40 is attached to the apparatus body, the electrodes 75 (K, C, M, and Y), the electrodes 76 (K, C, M, and Y), the electrodes 77 (K, C, M, and Y), the electrodes 78 (K, C, M, and Y), and the IC 110 are automatically connected to a power circuit and a control circuit of the apparatus body. At the same time, the respective shafts 71 (K, C, M, and Y) of the photoreceptors 41 (K, C, M, and Y) are automatically connected to a ground for earthing. On upper portions of the both side plates of the frame 70, guide grooves 73 (K, C, M, and Y) for receiving the developing devices 44 (K, C, M, and Y) are arranged at positions corresponding to the photoreceptors 41 (K, C, M, and Y). In addition, fixing levers 74 (K, C, M, and Y) are pivotally mounted for fixing the developing devices 44 (K, C, M, and Y) received by the guide grooves 73 (K, C, M, and Y), respectively.

Disposed on both end surfaces of the developing cartridge 47 (K, C, M, Y) of each developing device 44 (K, C, M, Y) are guide projections 79 (K, C, M, Y) to be inserted through upper open ends of the guide grooves 73 (K, C, M, Y) and to be received by the guide groove 73 (K, C, M, Y) (only one of the guide projections 79Y of the developing cartridge 47Y is shown in FIG. 3). To attach the developing device 44 (K, C, M, Y) to the corresponding photoreceptor 41 (K, C, M, Y), the guide projections 79 (K, C, M, Y) are inserted into the guide grooves 73 (K, C, M, Y) from above and, after that, the fixing levers 74 (K, C, M, Y) are pivotally moved to fix the guide projections 79. To remove the developing cartridge 47 (K, C, M and Y) for replacement or the like, the fixing levers 74 (K, C, M, Y) are pivotally moved in the opposite direction so as to open the guide grooves 73 (K, C, M, Y) and the developing cartridge 47 (K, C, M, Y) are pulled out upwardly along the guide grooves 73 (K, C, M, Y).

The direction of arrow "X" (hereinafter, "X" direction) in FIG. 2 is the feeding direction of the recording medium, the direction of arrow "Z" (hereinafter, "Z" direction) is a direction perpendicular to the feeding direction of the recording medium in the horizontal direction and a direction parallel to the shafts 71 (K, C, M, and Y) of the photoreceptors (K, C, M, Y), and the direction of arrow "Y" (hereinafter, "Y" direction) is a direction perpendicular to the feeding direction of the recording medium in the vertical direction. The needs of the "X", "Y", "Z" directions will be described later with regard to the process of correcting the color registration error according to the present invention. In the embodiment shown in FIG. 3, the developing cartridges 47 (K, C, M, and Y) composing the respective developing devices 44 (K, C, M, and Y) can be attached to and detached from the photoreceptors (K, C, M, and Y), respectively. Therefore, only one of the developing devices 44 (K, C, M, Y) which has reached the end of its life can be replaced, thereby avoiding the replacement of the other developing devices 44 (K, C, M, and Y) which are still usable. Therefore, the running cost can be reduced.

Figure 4:
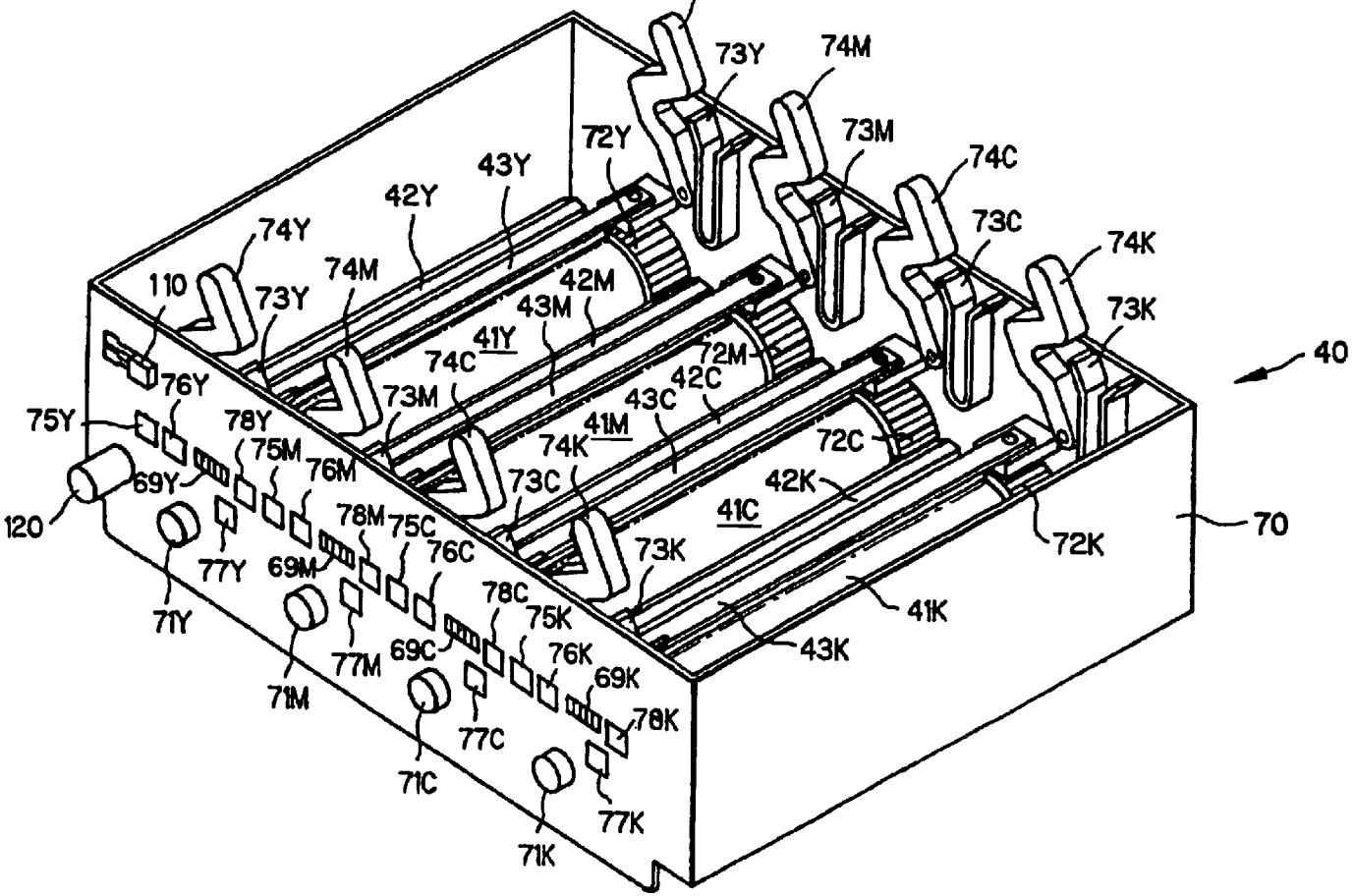
FIG. 4 is a perspective view of a photoreceptor cartridge alone in a state that developing devices are detached.
Figure 5:
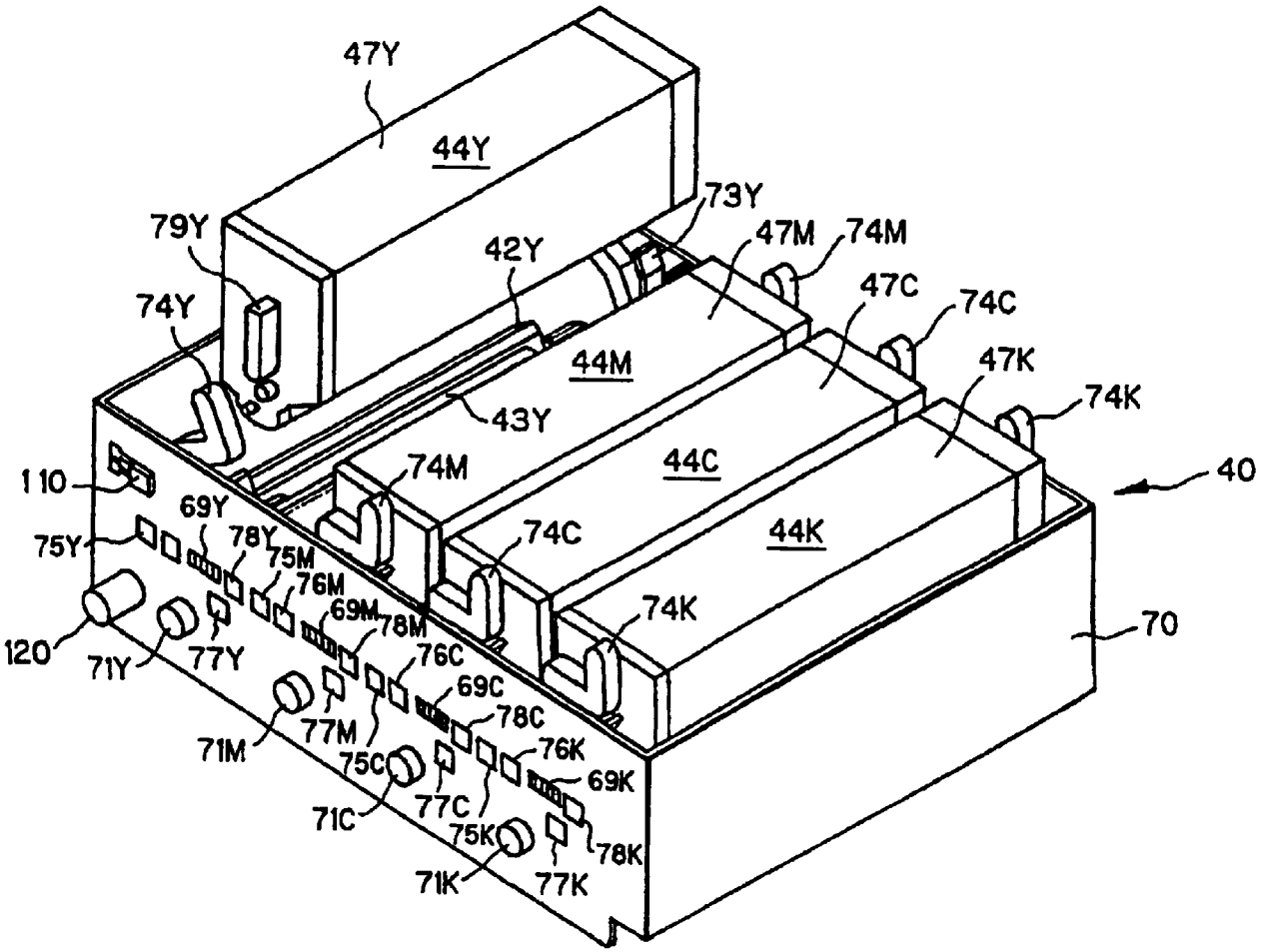
FIG. 5 is a perspective view of the photoreceptor cartridge in a state that some developing cartridges are attached and another developing cartridge is in the attaching process.

FIG. 4 is a perspective view of a photoreceptor cartridge 40 alone having another structure in a state that developing devices 44K, 44C, 44M, 44Y are detached and FIG. 5 is a perspective view of the photoreceptor cartridge 40 in a state that the developing devices 44K, 44C, 44M are attached and the developing device 44Y is detached. Hereinafter, the different points in the structure of FIG. 4 and FIG. 5 from the structure of FIG. 2 and FIG. 3 will be described.

In FIG. 4 and FIG. 5, electrodes 75 (K, C, M, and Y) for applying high voltage to discharge wires of the scorotrons, and electrodes 76 (K, C, M, and Y) for applying high voltage to grids of the scorotrons of the respective corona chargers 42 (K, C, M, and Y) are disposed on one surface of the side plate of the frame 70. Electrodes 69 (K, C, M, and Y) for applying emission control signals to LED line heads of the exposure devices 43 (K, C, M, and Y) are also disposed on the same surface of the side plate of the frame 70. In the same manner, disposed on one surface of the side plate of the frame 70 are electrodes 77 (K, C, M, and Y) for applying a developing bias voltage to the development rollers 49 (K, C, M, and Y), and electrodes 78 (K, C, M, and Y) for applying a supplying bias voltage to the supply rollers 48 (K, C, M, and Y) in a state that the developing devices 44 (K, C, M, Y) are attached to the photoreceptor cartridge 40.

Also in the embodiment shown in FIG. 4 and FIG. 5, a positioning pin 120 is provided for positioning the photoreceptor cartridge 40. Accordingly, the photoreceptor cartridge 40 can be positioned at the predetermined position (reference position) defined in the apparatus body by the positioning pin 120, whereby the photoreceptors 41 (K, C, M, and Y) accommodated in the frame 70 can be positioned at the predetermined relative positions at once.

When the photoreceptor cartridge 40 is attached to the apparatus body, the electrodes 75 (K, C, M, and Y), the electrodes 76 (K, C, M, and Y), the electrodes 69 (K, C, M, and Y), the electrodes 77 (K, C, M, and Y), the electrodes 78 (K, C, M, and Y), and an IC 110 are automatically connected to the power circuit and the control circuit of the apparatus body. At the same time, the respective shafts 71 (K, C, M, and Y) of the photoreceptors 41 (K, C, M, and Y) are automatically connected to a ground for earthing.

Figure 6:
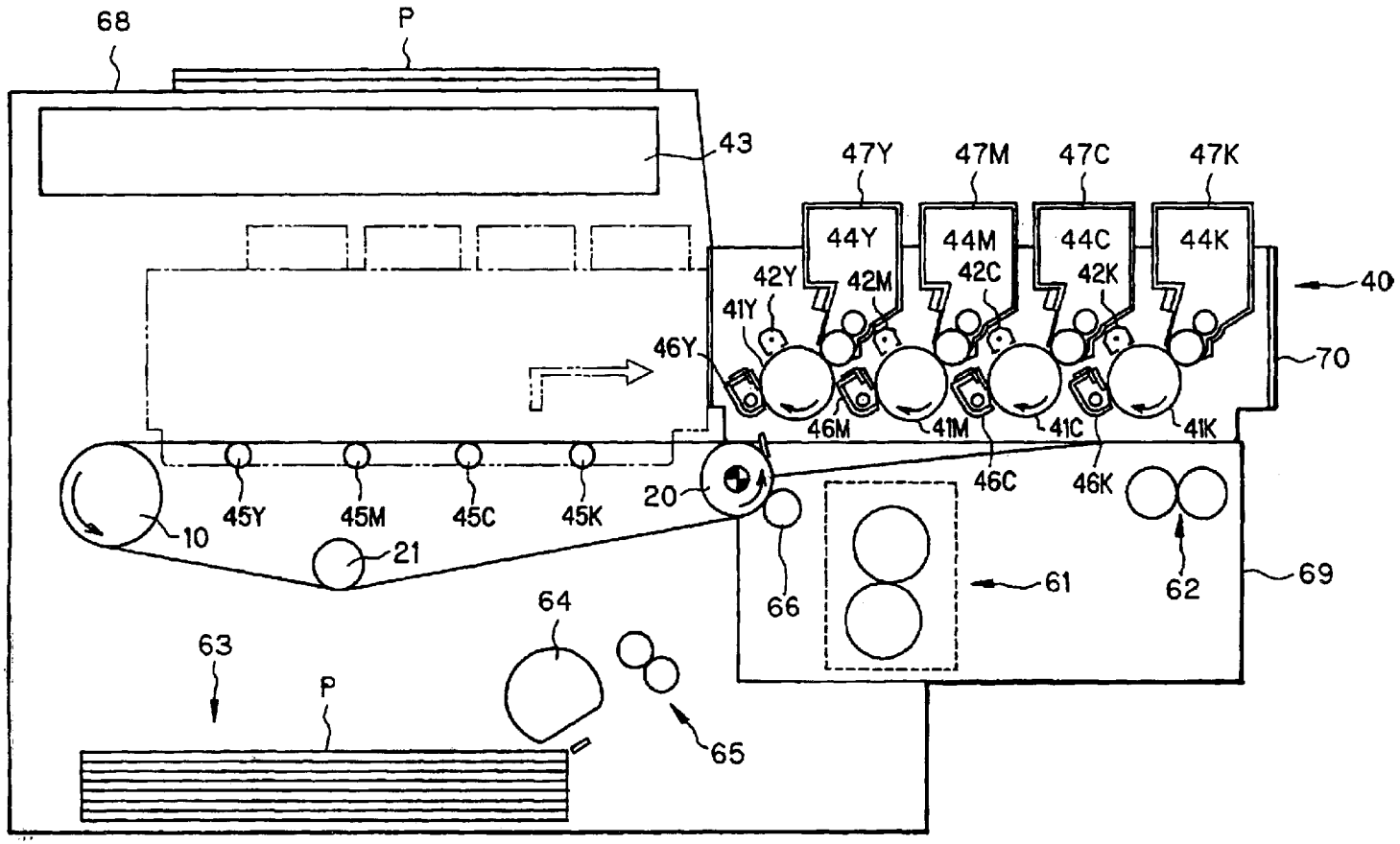
FIG. 6 is a front view showing the photoreceptor cartridge in a state removed from an apparatus body of the structure shown in FIG. 1.

According to the present invention, as shown in the front views of FIG. 1 and FIG. 6, in the image forming apparatus as mentioned above, the four photoreceptors 41K, 41C, 41M, and 41Y, the corona chargers 42 (K, C, M, and Y) and the cleaning devices 46 (K, C, M, and Y) which are arranged around the respective photoreceptors 41K, 41C, 41M, 41 are set together as the single photoreceptor cartridge 40 so that these can be integrally drawn to be detached from the apparatus body and can be integrally attached to the apparatus body. In this case, the developing devices 44K, 44C, 44M, and 44Y which are associated with the photoreceptors 41K, 41C, 41M, and 41Y are designed such that these can be attached to and detached from the photoreceptor cartridge 40.

Referring to FIG. 6, the four photoreceptors 41K, 41C, 41M, and 41Y, the corona chargers 42 (K, C, M, and Y) and the cleaning devices 46 (K, C, M, and Y) which are associated with the photoreceptors 41K, 41C, 41M, and 41Y are mounted in the frame 70 of the photoreceptor cartridge 40 in such a manner that these are positioned relative to each other. In FIG. 6, the photoreceptor cartridge 40 can be drawn out from the apparatus body by lifting and then sliding the photoreceptor cartridge 40 as shown by an outline arrow. For this, the pair of fixing rollers 61 and the pair of delivery rollers 62 are fixed to a side plate 69 which can be pivotally moved about the driven roller 20 as a pivot axis. By moving the pair of fixing rollers 61 and the pair of delivery rollers 62 away, an opening for allowing the photoreceptor cartridge 40 to be drawn out from the apparatus body is formed. In a state that the photoreceptor cartridge 40 is drawn out from the apparatus body as mentioned above, the photoreceptors 41 (K, C, M, and Y) are separated from the intermediate transfer belt 30. Therefore, the photoreceptor cartridge 40 can be detached from the apparatus body and a new photoreceptor cartridge 40 can be installed.

Figure 7:
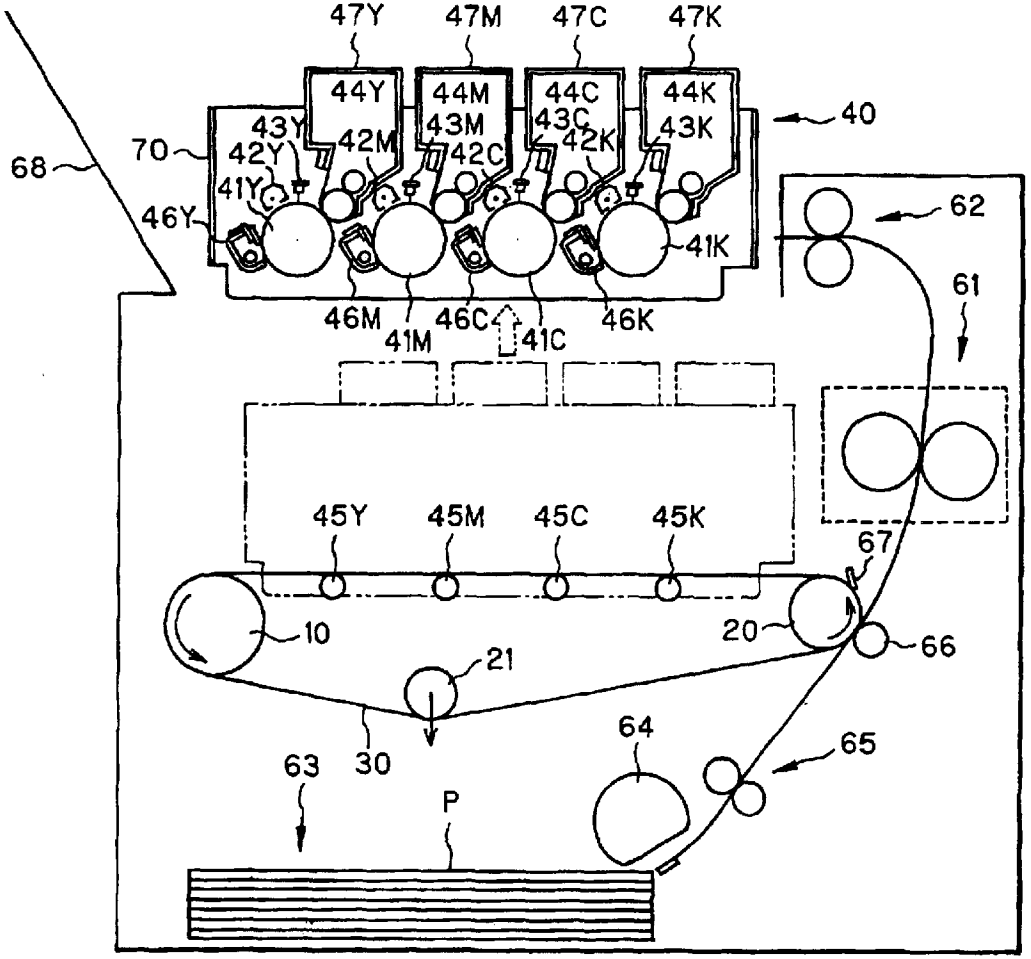
FIG. 7 is a front view showing another embodiment in a state that a photoreceptor cartridge is removed from an apparatus body.

FIG. 7 is a front view showing another embodiment in a state that a photoreceptor cartridge 40 is removed from an apparatus body. As shown in FIG. 7, the four photoreceptors 41K, 41C, 41M, and 41Y, the corona chargers 42 (K, C, M, and Y), the exposure devices 43 (K, C, M, and Y) and the cleaning devices 46 (K, C, M, and Y) which are arranged around the respective photoreceptors 41K, 41C, 41M, 41Y are accommodated together in the photoreceptor cartridge 40. The photoreceptor cartridge 40 can be drawn to be detached from the apparatus body and can be attached to the apparatus body. In this case, the developing devices 44K, 44C, 44M, and 44Y which are associated with the photoreceptors 41K, 41C, 41M, and 41Y are designed such that these can be attached to and detached from the photoreceptor cartridge 40. Referring to FIG. 7, the four photoreceptors 41K, 41C, 41M, and 41Y, the corona chargers 42 (K, C, M, and Y), the exposure devices 43 (K, C, M, and Y) and the cleaning devices 46 (K, C, M, and Y) which are associated with the photoreceptors 41K, 41C, 41M, and 41Y are mounted in a frame 70 of the photoreceptor cartridge 40 in such a manner that these are positioned relative to the each other. The photoreceptor cartridge 40 can be drawn out from the apparatus body by lifting the photoreceptor cartridge 40 as shown by an outline arrow in FIG. 7.

For this, the outfeed tray 68 is supported at its one end such that it can be pivotally moved upwardly. By moving the outfeed tray 68 away from the top of the apparatus body, an opening for allowing the photoreceptor cartridge 40 to be drawn out from the apparatus body is formed.

In a state that the photoreceptor cartridge 40 is drawn out from the apparatus body as mentioned above, the photoreceptors 41 (K, C, M, and Y) are separated from the intermediate transfer belt 30. Therefore, the photoreceptor cartridge 40 can be detached from the apparatus body and a new photoreceptor cartridge 40 can be installed. As shown in FIG. 2, the four photoreceptors 41K, 41C, 41M, and 41Y, the corona chargers 42 (K, C, M, and Y), the exposure devices 43 (K, C, M, and Y) and the cleaning devices 46 (K, C, M, and Y) which are associated with the photoreceptors 41K, 41C, 41M, and 41Y are mounted in the frame 70 of the photoreceptor cartridge 40 in such a manner that these are positioned relative to each other. The maintenance, checking, and replacement can be done for respective parts in the state that the photoreceptor cartridge 40 is drawn out form the apparatus body.

Figure 8:
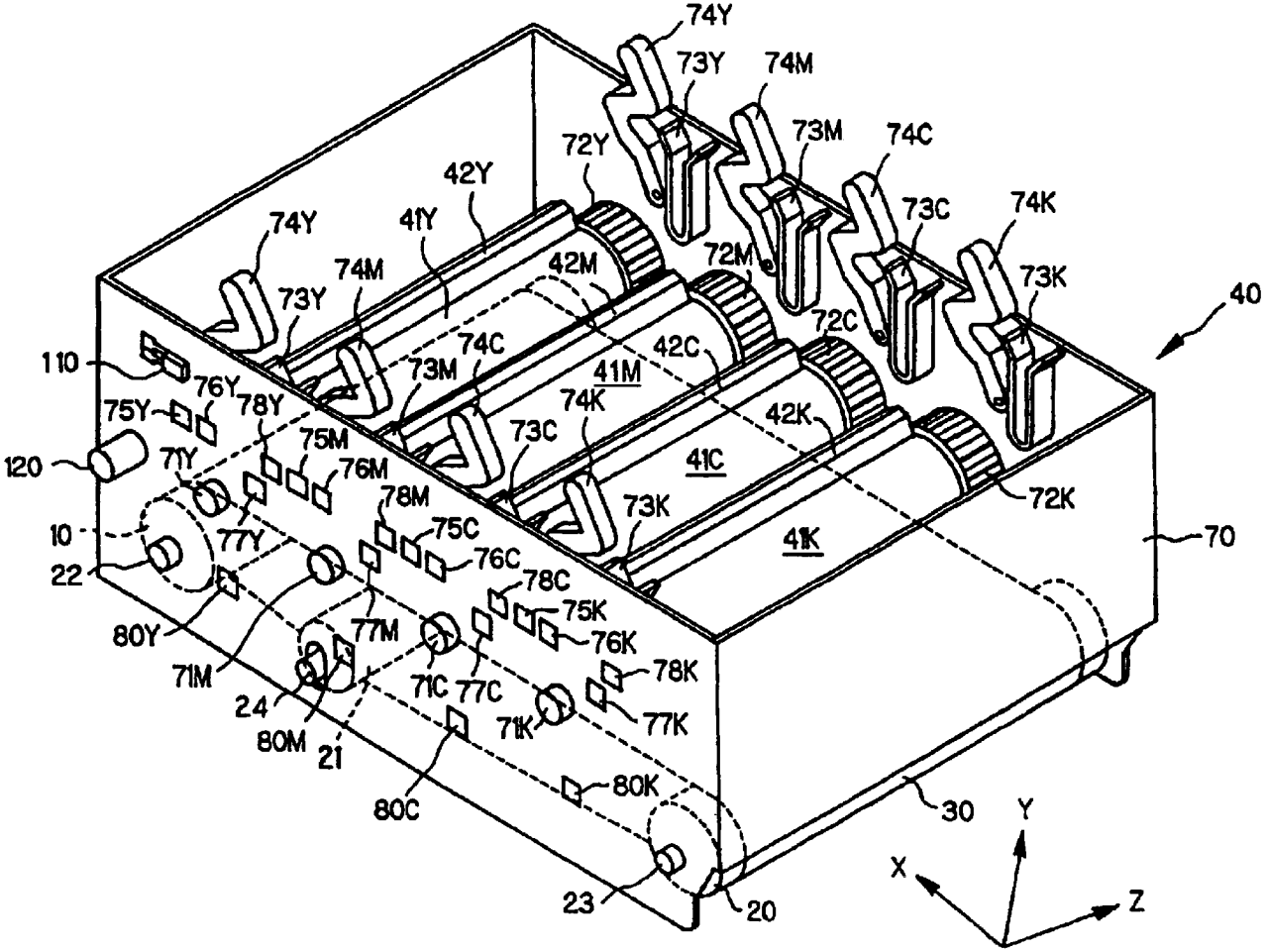
FIG. 8 is a perspective view showing another embodiment of a photoreceptor cartridge alone in a state that developing devices are detached.

FIG. 8 is a perspective view of a photoreceptor cartridge 40 alone in a state that the developing devices 44K, 44C, 44M, 44Y are detached. A perspective view of the photoreceptor cartridge 40 of this embodiment in a state that the developing devices 44K, 44C, 44M are attached and the developing device 44Y is detached is the same as FIG. 3. Hereinafter, the different points in the structure of FIG. 8 from the structure of FIG. 2 will be described. A driving roller 10, a driven roller 20, and a tension roller 21 around which an intermediate transfer belt 30 is wound and stretched with some tension are rotatably disposed by shafts 22, 23, 24, respectively such that these are arranged in parallel to each other and spaced apart from each other by predetermined distances. Primary transfer rollers 45 (K, C, M, and Y) which are associated with the photoreceptors 41 (K, C, M, and Y), respectively are mounted at the respective predetermined positions so that electrodes 80 (K, C, M, and Y) for applying a primary transferring voltage to the primary transfer rollers 45 (K, C, M, and Y) are provided on the same surface of the side plate of a frame 70.

Also in the embodiment shown in FIG. 8, a positioning pin 120 is provided for positioning the photoreceptor cartridge 40. Accordingly, the photoreceptor cartridge 40 can be positioned at a predetermined position (reference position) defined in the apparatus body by the positioning pin 120, whereby the photoreceptors 41 (K, C, M, and Y) accommodated in the frame 70 can be positioned at the predetermined relative positions at once. Since the information on color registration error is stored in a IC 110 as an inherent value of the apparatus as a product, it is not required to increase the precision of machining and assembling the positioning member, that is, reduction in precision of machining and assembling the positioning member is allowed. Also in the embodiment, since the respective developing cartridges 47 (K, C, M, and Y) composing the developing devices 44 (K, C, M, and Y) can be separately detached from the respective photoreceptors 41 (K, C, M, and Y), only one of the developing devices 44 (K, C, M, and Y) which has reached the end of its life can be replaced, thereby avoiding the replacement of the other developing devices 44 (K, C, M, and Y) which are still usable. Therefore, the running cost can be reduced.

Figure 9:
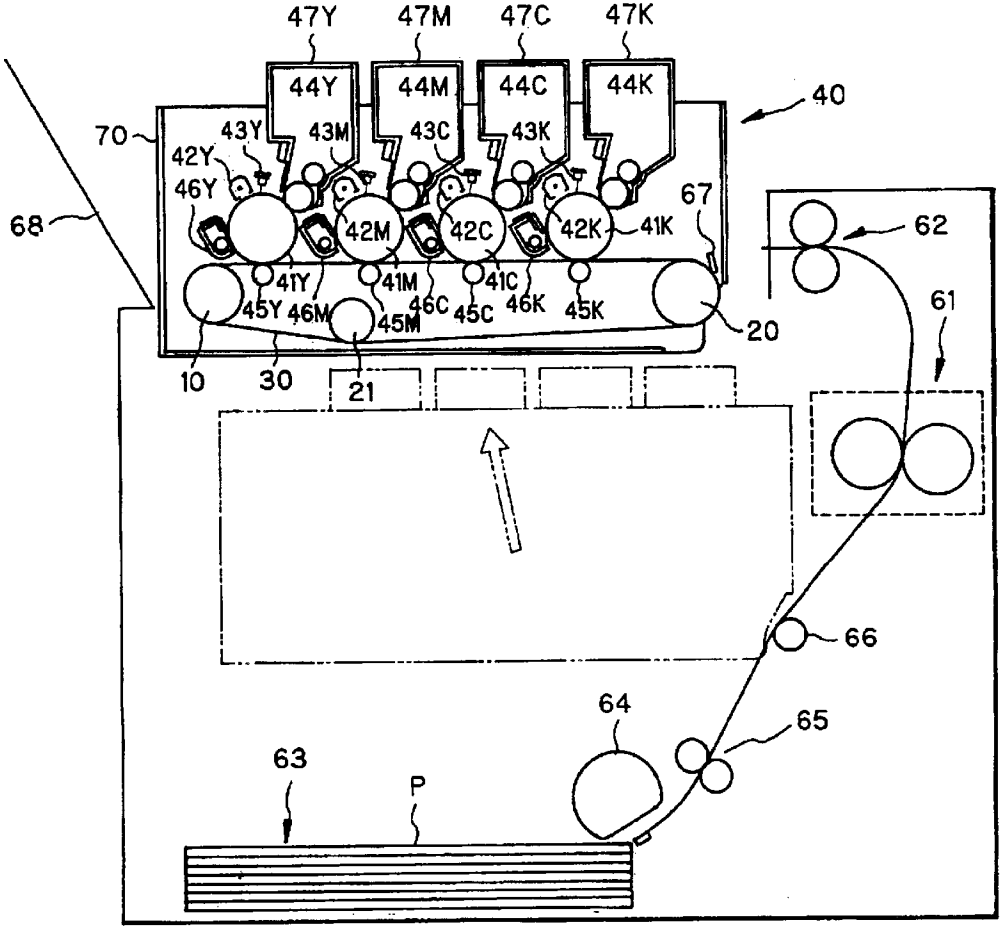
FIG. 9 is a front view showing an embodiment in a state that the photoreceptor cartridge is removed from an apparatus body.

FIG. 9 is a front view showing a state that a photoreceptor cartridge 40 shown in FIG. 8 is removed from the apparatus body. Referring to FIG. 9, since the exposure unit at the top of the apparatus body is omitted in this embodiment, the photoreceptor cartridge 40 can be drawn out from the apparatus body by lifting the photoreceptor cartridge 40 substantially upwardly as shown by an outline arrow in FIG. 9. For this, the outfeed tray 68 is supported at its one end such that it can be pivotally moved upwardly. By moving the outfeed tray 68 away from the top of the apparatus body, an opening for allowing the photoreceptor cartridge 40 to be drawn out from the apparatus body is formed. Therefore, in the state that the photoreceptor cartridge 40 is drawn out from the apparatus body, the photoreceptor cartridge 40 can be detached from the apparatus body and a new photoreceptor cartridge 40 can be installed. According to this structure, since the exposure devices 43 (K, C, M, and Y), the photoreceptor 41 (K, C, M, and Y), the intermediate transfer belt 30 , and the primary transfer rollers 45 (K, C, M, and Y) are set as the single photoreceptor cartridge 40, almost all of factors of color registration error can be controlled to be eliminated during the manufacturing process in a factory, thereby providing an image forming apparatus capable of providing high quality images with extremely little color registration error.

In this embodiment, the four photoreceptors 41K, 41C, 41M, and 41Y, the corona chargers 42 (K, C, M, and Y), the exposure devices 43 (K, C, M, and Y) and the cleaning devices 46 (K, C, M, and Y) which are associated with the photoreceptors 41K, 41C, 41M, and 41Y, the intermediate transfer belt 30 , the driving roller 10, the driven roller 20 and the tension roller 21 around which the intermediate transfer belt 30 is wound with some tension, the primary transfer rollers 45 (K, C, M, and Y) pressing the intermediate transfer belt 30 against the photoreceptors 41 (K, C, M, and Y), and a cleaning blade 67 for cleaning the intermediate transfer belt 30 are mounted in the frame 70 of the photoreceptor cartridge 40 in such a manner that these are positioned relative to the each other. In the state that the photoreceptor cartridge 40 having the aforementioned structure is drawn out from the apparatus body, the photoreceptor cartridge 40 can be detached from the apparatus body and a new photoreceptor cartridge 40 can be installed.

Figure 10:
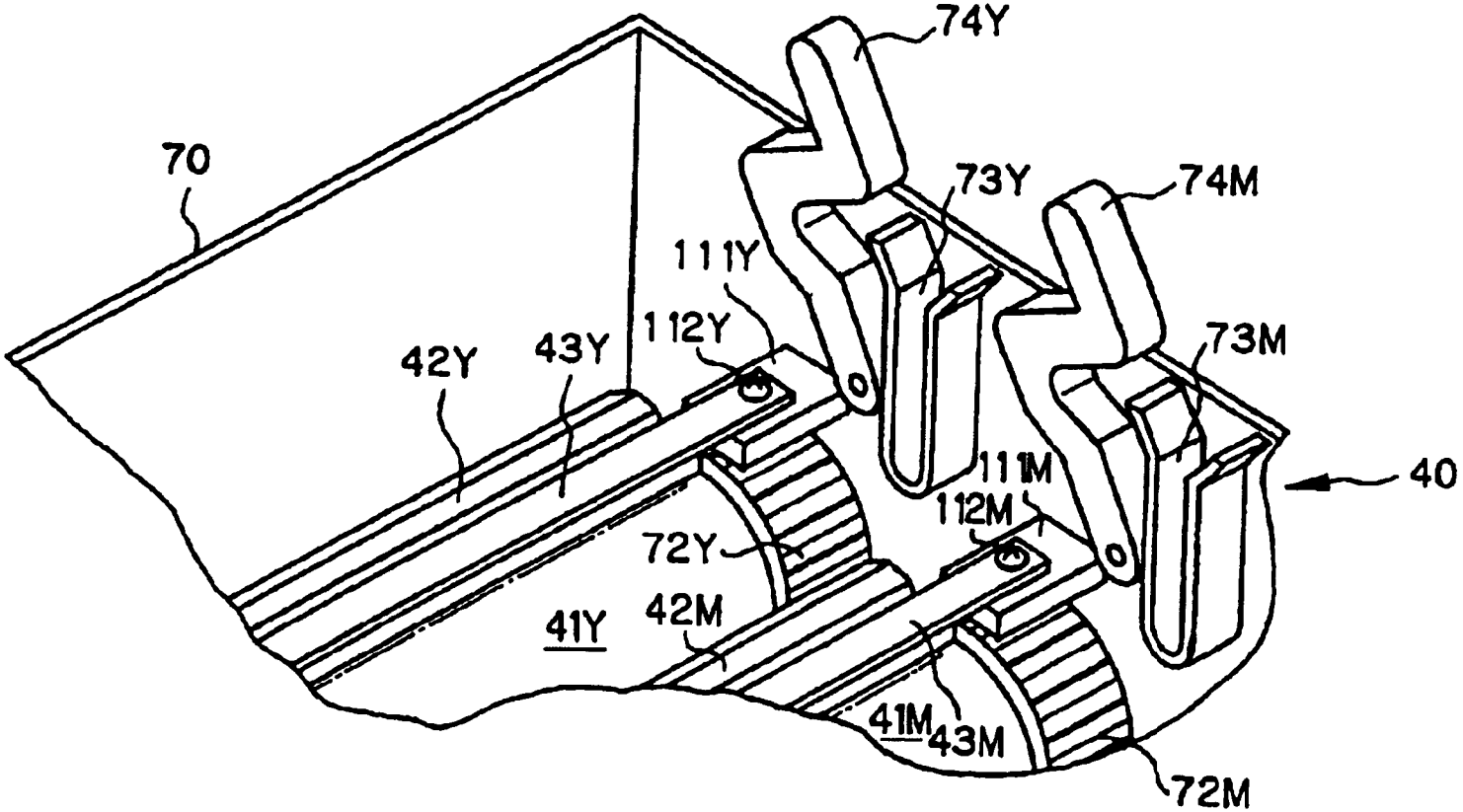
FIG. 10 is a perspective view showing an example of the structure for mounting exposure devices to a frame of the photoreceptor cartridge.

Now, an example of the structure for mounting exposure devices 43 (K, C, M, and Y) will be described with reference to an enlarged perspective view of FIG. 10. In FIG. 10, only a portion including one end of the photoreceptors 41Y and 41M of the photoreceptor cartridge 40 is shown. For mounting the exposure device 43 (K, C, M, Y) to an exactly defined position around the corresponding photoreceptor 41 (K, C, M, Y) and parallel to the corresponding photoreceptor 41 (K, C, M, Y), mounting projections 111 (K, C, M, Y) are disposed to extend from the inner surfaces of both side plates of the frame 70 toward each other. Each mounting projection 111 (K, C, M, Y) is provided with a positioning hole into which a positioning pin is fitted and a screw hole (both not shown) formed therein. Positioning pins 115 which are disposed on both end portions of a long substrate 113 (FIG. 11) of each exposure device 43 (K, C, M, Y) are fitted in the positioning holes of the opposing mounting projections 111 (K, C, M, Y). Then, fixing screws 112 (K, C, M, Y) are screwed into the screw holes of the mounting projections 111 (K, C, M, Y) through holes 114 formed in both end portions of the long substrate 113 (FIG. 11), thereby fixing the long substrate 113. In this manner, the exposure devices 43 (K, C, M, and Y) are fixed at the respective predetermined positions.

Figure 11:
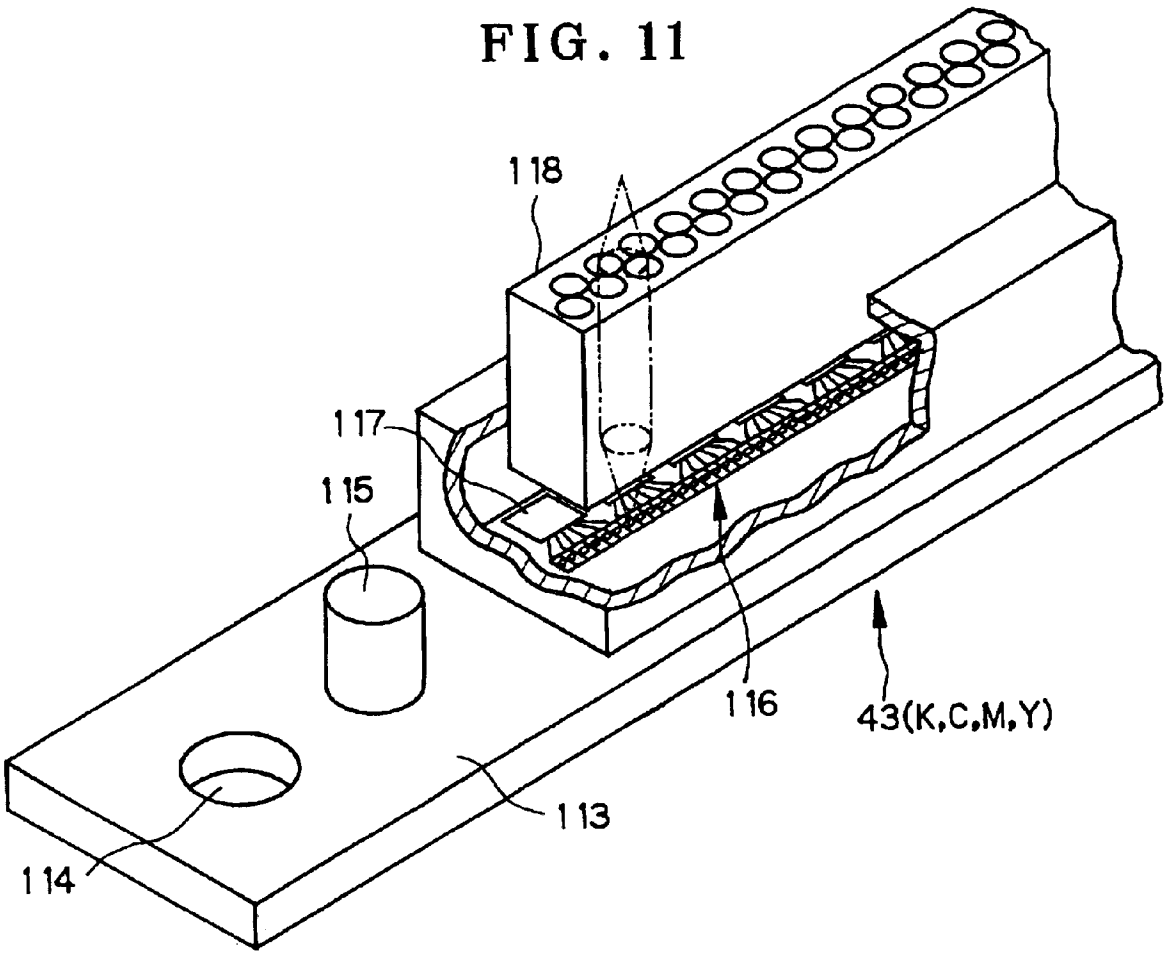
FIG. 11 is a perspective view of an exposure device which is structured as an LED line head composed of LED arrays.

FIG. 11 is a perspective view of one of the exposure devices 43 (K, C, M, Y) which are structured as LED line heads composed of LED arrays 116. As described above, the exposure devices 43 (K, C, M, and Y) are set on the long substrate 113 extending between the both side plates of the frame 70. Each exposure device 43 (K, C, M, Y) comprises an LED array 116 for forming a linear image parallel to its axis on the corresponding photoreceptor 41 (K, C, M, Y). The LED array 116 is disposed on the long substrate 113 and has LEDs each of which is connected to a driver IC 117 for controlling the emission of light. The long substrate 113 has positioning pins 115 disposed on both end portions thereof and holes 114 for mounting screws formed in both end portions thereof. By the positioning pins 115 and the holes 114, the long substrate 113 is fixed in its exact position relative to the corresponding photoreceptor 41 (K, C, M, Y) of the photoreceptor cartridge 40. In front of the LED array 116, a gradient index rod lens array 118 is fixed integrally to the LED array 116. By the condensing function of the gradient index rod lens array 118, an array of light points emitted from the LED array 116 are condensed onto the surface of the corresponding photoreceptor 41 (K, C, M, Y).

Figure 12:
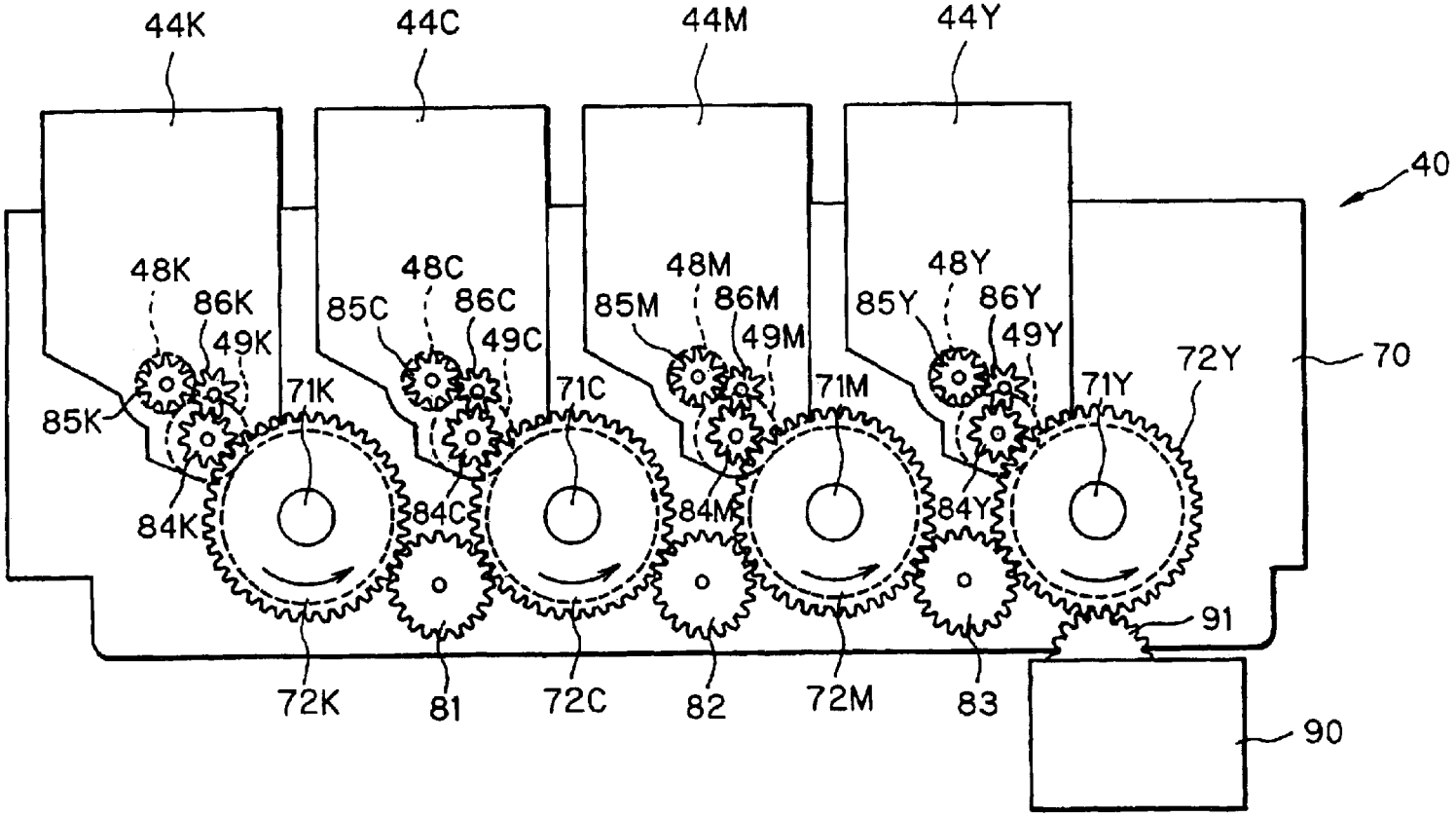
FIG. 12 is a front view showing one arrangement of a mechanism for rotating the photoreceptors housed in the photoreceptor cartridge in synchronization with each other.

Description will now be made as regard to a mechanism for rotating the photoreceptors 41K, 41C, 41M, and 41Y housed in the photoreceptor cartridge 40 in synchronization with each other to prevent causing a color registration error when the photoreceptor cartridge 40 is attached to the apparatus body. FIG. 12 is a front view showing one arrangement of the mechanism.

In FIG. 12, the gears 72K, 72C, 72M, and 72Y are fixed to one respective ends of the shafts 71 (K, C, M, and Y) of the photoreceptors 41 (K, C, M, and Y) as described in the above. The gears 72K, 72C, 72M, and 72Y are formed by molding with the same mold. Disposed between the gears 72K, 72C, 72M, and 72Y are three idle gears 81, 82, and 83 for transferring rotational force, thereby composing a gear train. A driving gear 91 meshing with one gear of the gear train, i.e. with the gear 72Y in the illustrated example, is connected with a driving unit 90 of the apparatus body side. As the photoreceptor cartridge 40 is installed at the predetermined position of the apparatus body, the driving gear 91 automatically meshes with the gear 72Y. A development roller gear 84 (K, C, M, Y) is fixed to one end of the shaft of the development roller 49 (K, C, M, Y) of each developing device 44 (K, C, M, Y). A supply roller gear 85 (K, C, M, Y) is fixed to one end of the shaft of each supply roller 48 (K, C, M, Y). An idle gear 86 (K, C, M, Y) is arranged between the development roller gear 84 (K, C, M, Y) and the supply roller gear 85 (K, C, M, Y). The development roller gear 84 (K, C, M, Y) meshes with the gear 72 (K, C, M, Y) of the photoreceptor 41 (K, C, M, Y). Accordingly, the development roller 49 (K, C, M, Y) and the supply roller 48 (K, C, M, Y) of the developing device 44 (K, C, M, Y) are driven to rotate in synchronization with the rotation of the photoreceptor 41 (K, C, M, Y).

According to the structure as described above, as the driving gear 91 of the single driving unit 90 of the apparatus body side is driven, driving force diverges and is transmitted so as to drive all of the four photoreceptors 41 (K, C, M, and Y), the development rollers 49 (K, C, M, and Y) and the supply rollers 48 (K, C, M, and Y) of the developing devices 44 (K, C, M, and Y) which are associated with the photoreceptors 41 (K, C, M, and Y) to rotate in synchronization with each other. In this arrangement, since there is only one meshing point for transmitting the driving force when the photoreceptor cartridge 40 is installed, the working efficiency for installation of the photoreceptor cartridge 40 is improved. Since the reference for positioning of the photoreceptor cartridge 40 is the driving gear 91, the meshing accuracy is improved, thereby providing an image forming apparatus capable of providing high quality images with little color registration error and little banding (irregularity in density in a direction perpendicular to the feeding direction). The rotational force transmitting mechanism allowing the rotation of the photoreceptors 41K, 41C, 41M, and 41Y in synchronization with each other is not limited to the gear train and may be a belt or chain.

Figure 13:
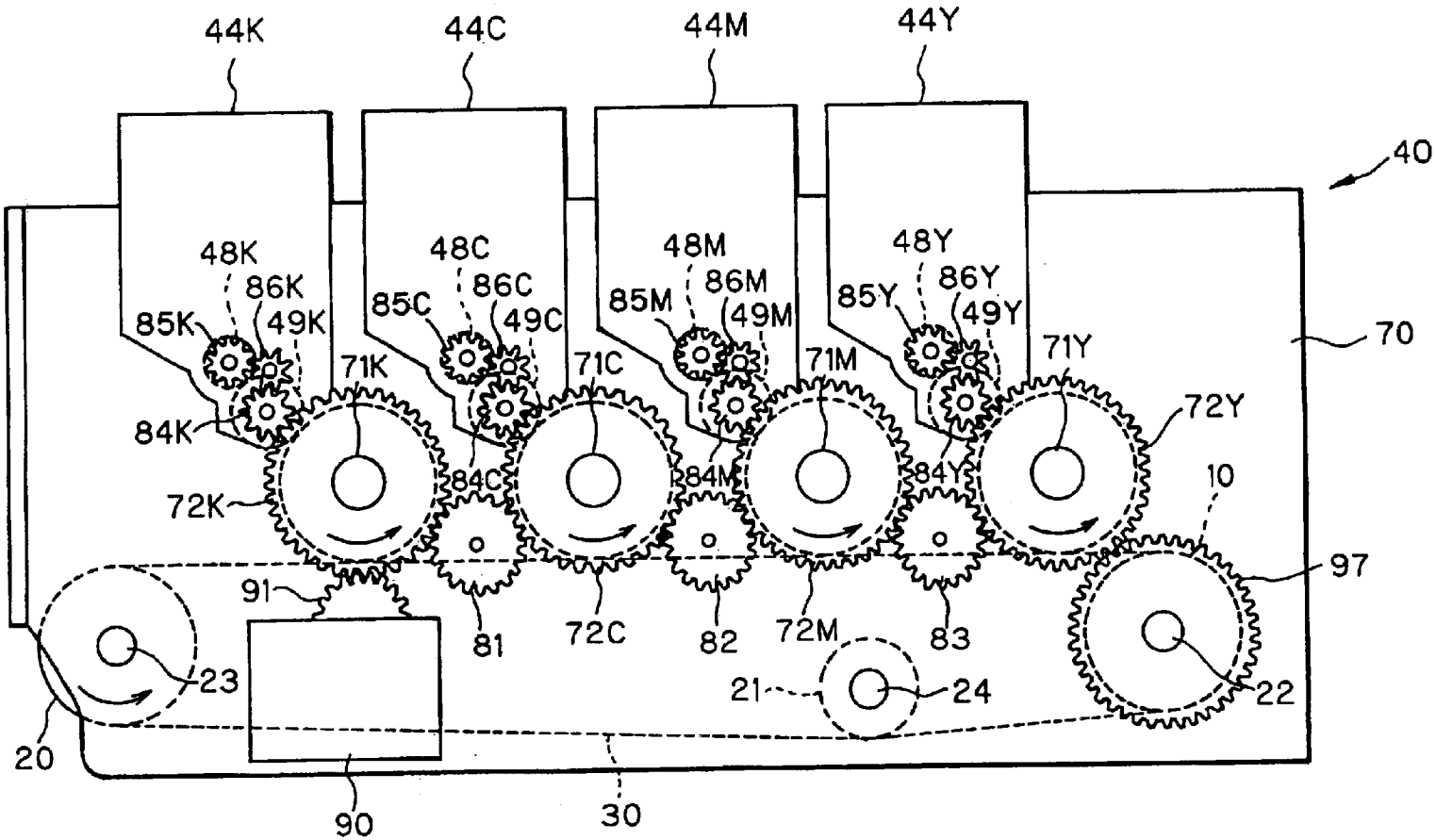
FIG. 13 is a front view showing another arrangement of mechanism for rotating the photoreceptors housed in the photoreceptor cartridge in synchronization with each other.

FIG. 13 is a front view showing another arrangement of the mechanism for rotating the photoreceptors 41 (K, C, M, Y) housed in a photoreceptor cartridge 40 in synchronization with each other and is a corresponding drawing of FIG. 8. As described in the above, the gears 72K, 72C, 72M, and 72Y are fixed to one respective end of the shafts 71 (K, C, M, and Y) of the photoreceptors 41 (K, C, M, and Y). The gears 72K, 72C, 72M, and 72Y are formed by molding with the same mold. Disposed between the gears 72K, 72C, 72M, and 72Y are three idle gears 81, 82, and 83 for transferring rotational force, thereby composing a gear train. A gear 97 rotating about the shaft 22 is fixed to one end of the driving roller 10. The gear 97 meshes with the gear 72Y for rotating the photoreceptor 41Y. Accordingly, the gears 72K, 81, 72C, 82, 72M, 83, 72Y, and 97 compose a series of the gear train. A driving gear 91 meshing with one gear of the gear train, i.e. with the gear 72K in the illustrated example, is connected with a driving unit 90 of the apparatus body side. As the photoreceptor cartridge 40 is installed at the predetermined position of the apparatus body, the driving gear 91 automatically meshes with the gear 72K. A development roller gear 84 (K, C, M, Y) is fixed to one end of the shaft of the development roller 49 (K, C, M, Y) of each developing device 44 (K, C, M, Y). A supply roller gear 85 (K, C, M, Y) is fixed to one end of the shaft of each supply roller 48 (K, C, M, Y). An idle gear 86 (K, C, M, Y) is arranged between the development roller gear 84 (K, C, M, Y) and the supply roller gear 85 (K, C, M, Y). The development roller gear 84 (K, C, M, Y) meshes with the gear 72 (K, C, M, Y) of the photoreceptor 41 (K, C, M, Y).

In the example of FIG. 13, because of the arrangement as mentioned above, the development roller 49 (K, C, M, Y) and the supply roller 48 (K, C, M, Y) of the developing device 44 (K, C, M, Y) are driven to rotate in synchronization with the rotation of the photoreceptor 41 (K, C, M, Y). Therefore, by rotating the driving gear 91 of the single driving unit 90 of the apparatus body side, all of the four photoreceptors 41 (K, C, M, and Y), the development rollers 49 and the supply rollers 48 (K, C, M, and Y) of the developing devices 44 (K, C, M, and Y) which are associated with the photoreceptors 41 (K, C, M, and Y) can be driven to rotate in synchronization with each other. Here, it is preferable to set the diameter of the driving roller 10 to achieve a velocity differential of 1% to 5% between the feeding velocity of the intermediate transfer belt 30 by the driving roller 10 and the peripheral velocity of the photoreceptor 41 (K, C, M, Y). With the velocity differential between the photoreceptor 41 (K, C, M, Y) and the intermediate transfer belt 30 , toner is mechanically moved during the primary transfer of the toner image, thereby increasing the transfer efficiency. In the example of prior art, when only the image carrier (photoreceptor) is replaced, the peripheral velocity of the image carrier varies because of a tolerance of profile of the image carrier so that the velocity differential between the image carrier and the intermediate transfer belt should vary.

Variation in velocity differential causes a problem of reducing the transfer efficiency in case of too small velocity differential and a problem of deteriorating the image quality in case of too large velocity differential. Therefore, according to this embodiment, the photoreceptors 41 (K, C, M, and Y) and the intermediate transfer belt 30 are integrally mounted in the photoreceptor cartridge 40, thereby reducing the variation in velocity differential between the photoreceptors 41 (K, C, M, and Y) and the intermediate transfer belt 30 , for example, by selecting the profile of the driving roller 10 to correspond to the profile of the photoreceptors 41 (K, C, M, and Y), thereby providing an image forming apparatus with improved transfer efficiency and without deterioration in image quality. In the arrangement as shown in FIG. 13, since there is only one meshing point for transmitting the driving force when the photoreceptor cartridge 40 is installed, the working efficiency for installation of the photoreceptor cartridge 40 is improved. Since the reference for positioning of the photoreceptor cartridge 40 is the driving gear 91, the meshing accuracy is improved, thereby providing an image forming apparatus capable of providing high quality images with little color registration error and little banding (irregularity in density in a direction perpendicular to the feeding direction). Therefore, by rotating the driving gear 91 of the single driving unit 90 of the apparatus body side, all of the four photoreceptors 41 (K, C, M, and Y), the development rollers 49 and the supply rollers 48 (K, C, M, and Y) of the developing devices 44 (K, C, M, and Y) which are associated with the photoreceptors 41 (K, C, M, and Y) can be driven to rotate in synchronization with each other. It should be noted that the rotational force transmitting mechanism allowing the rotation of the photoreceptors 41K, 41C, 41M, and 41Y in synchronization with each other is not limited to the gear train and may be a belt or chain.

Figure 14:
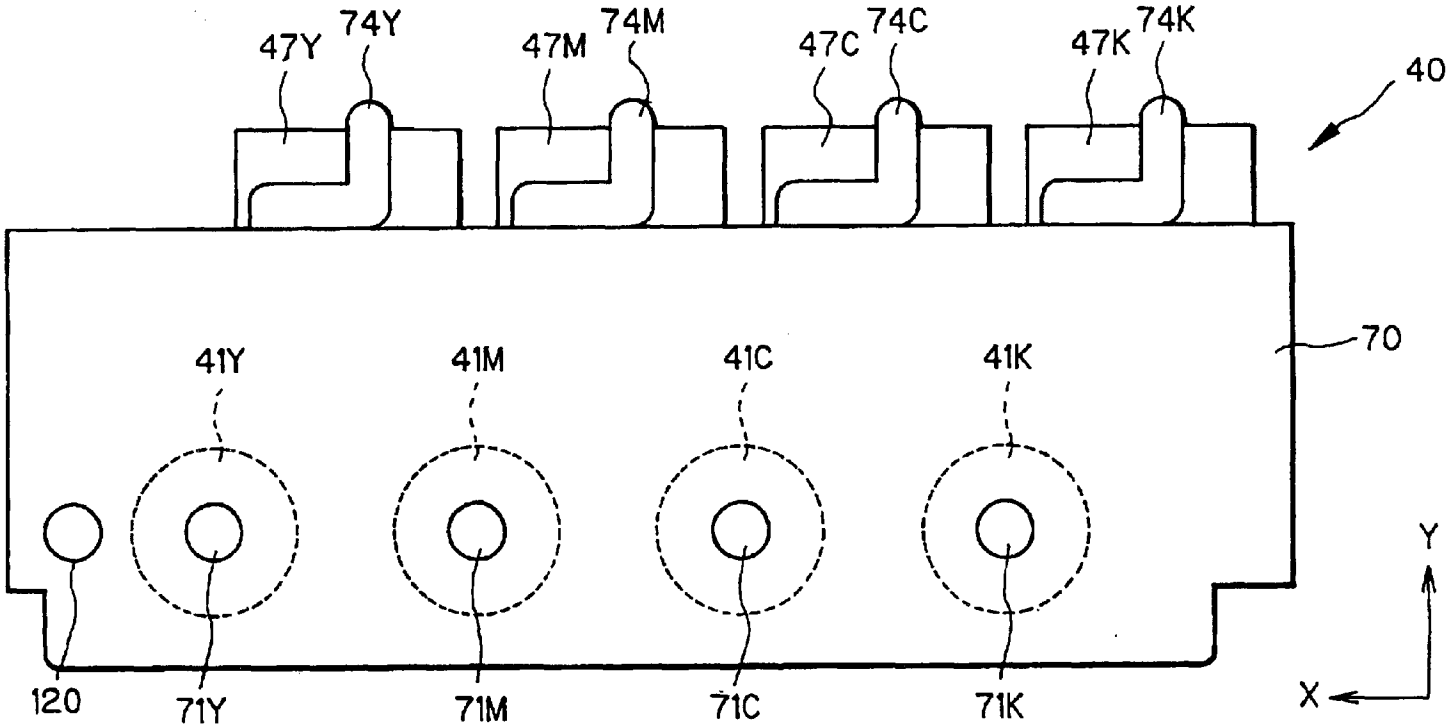
FIG. 14 is an illustration for explaining an example of cases that color registration error occurs.

FIG. 14 is an illustration for explaining an example of cases that color registration error occurs. The shafts 71 (K, C, M, and Y) of the photoreceptors 41 (K, C, M, and Y) are supported by the positioning members disposed on the frame 70 of the photoreceptor cartridge 40. Due to factors such as tolerance of diameter of the photoreceptors 41 (K, C, M, and Y) and the machining accuracy of the shafts, positional error may be created relative to the rated value in the feeding direction X of the recording medium or in the direction Y perpendicular to the direction X in a vertical direction. The positional error leads to color registration error. In the present invention, information about color registration error is obtained on the basis of the positions of the image carriers. By employing a correcting means as will be described, the color registration error due to the relative positional error of the image carriers can be corrected. When the position of any of the image carriers (photoreceptors) is shifted on the basis of the position of the positioning pin 120 of the photoreceptor cartridge 40, information about color registration error on the basis of the position of the positioning pin 120 is obtained. This means that the positional information of the image carriers relative to the apparatus body is obtained so that the absolute position of respective colors of image can be corrected. The correction of the absolute position of image will be described later.

Figure 15:
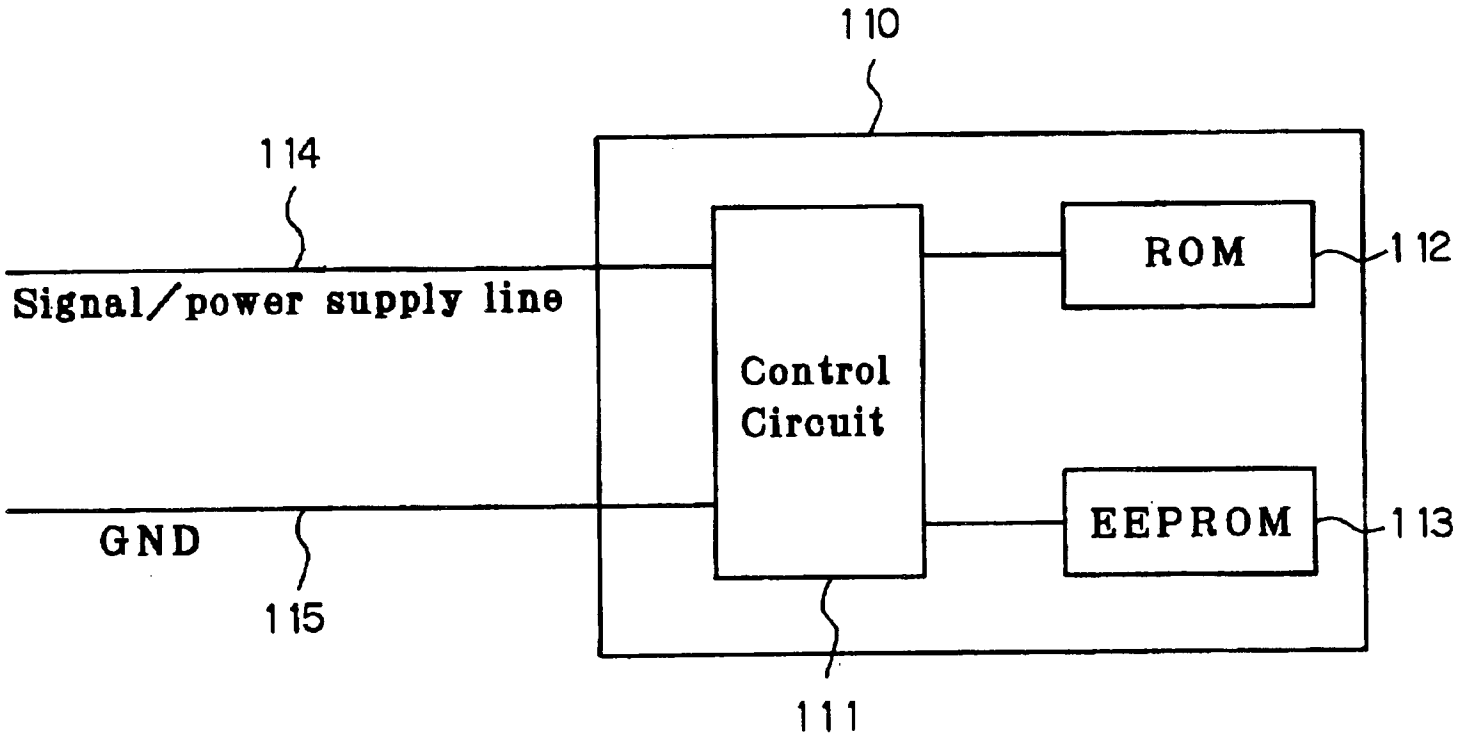
FIG. 15 is a block diagram showing an electronic module.

FIG. 15 is a block diagram showing an example of the structure of the electronic module (IC) 110 attached to the frame 70 of the photoreceptor cartridge 40. In FIG. 15, numeral 112 designates a ROM for storing inherent information such as the serial number and the date of manufacture of the apparatus, 113 designates an EEPROM for storing the aforementioned information on color registration error and the revolutions of the photoreceptors. The EEPROM 113 is a program ROM of which data can be electrically deleted and capable of reading out and writing data. Numeral 111 designates a control circuit for controlling the ROM 112 and EEPROM 113. Connected to the control circuit 111 are two cables, that is, a signal/power supply line 114 and a ground (GND) 115.

Figure 16:
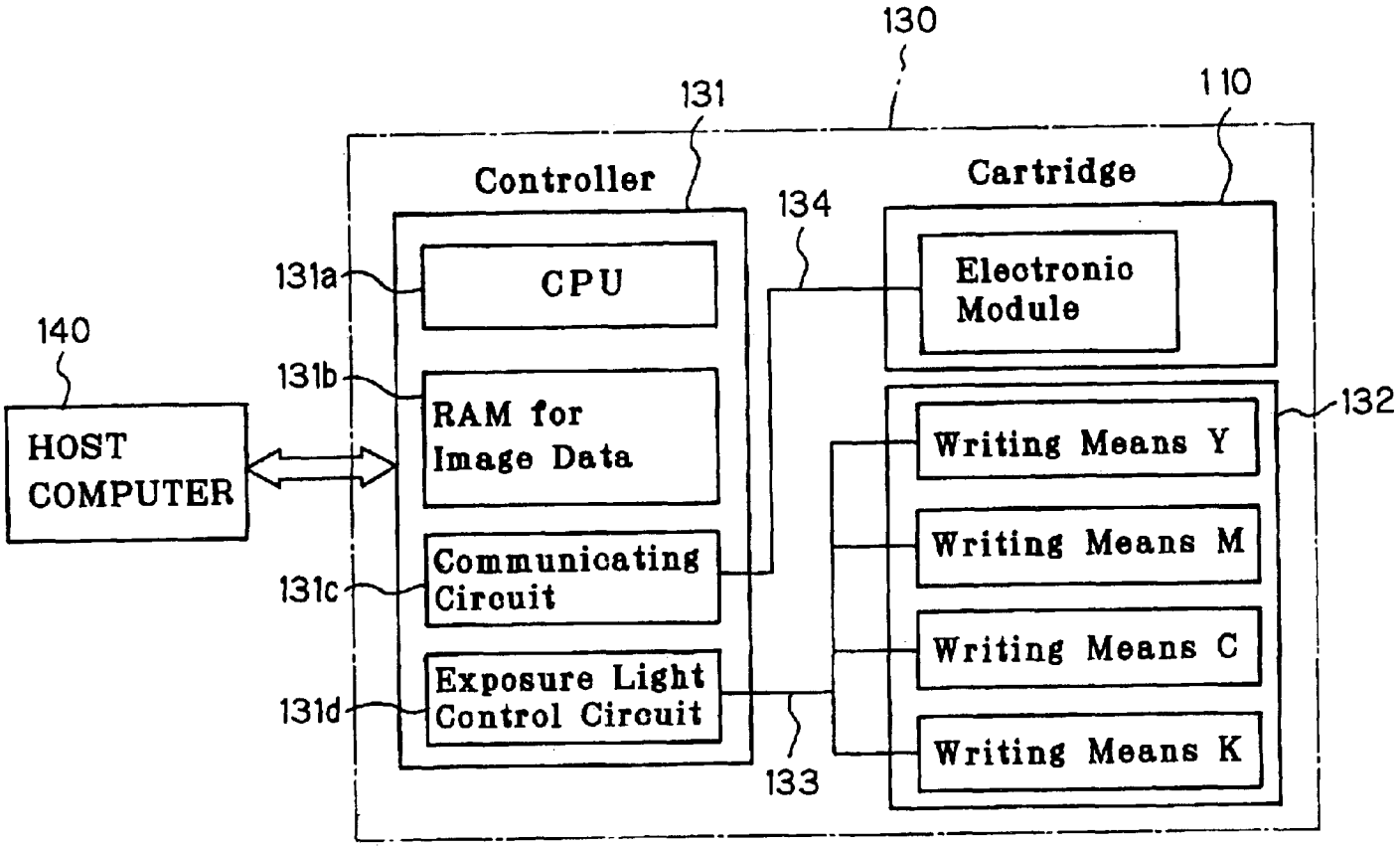
FIG. 16 is a block diagram showing a control section.

FIG. 16 is a block diagram showing an example of a control section 130 for correcting a color registration error in the image forming apparatus on the basis of the information on color registration error stored in the aforementioned electronic module 110. In FIG. 16, the control section 130 includes a controller 131. The controller 131 comprises a CPU (central processing unit) 131*a*, a RAM 131*b* for image data, a communication circuit 131*c*, and an exposure light control circuit 131*d*. The controller 131 functions as a color registration error correcting means. The information about color registration error stored in the EEPROM 113 of the electronic module 110 is sent to the communication circuit 131*c* through signal line 134 through the control circuit 111. Information on color registration error received by the communication circuit 131*c* is transmitted to the CPU 131*a*. The CPU 131*a* outputs a predetermined signal corresponding to the information on color registration error and thus corrects the image data stored in the RAM 131*b* for image data, thereby conducting the correction of color registration error.

The exposure light control circuit 131*d* sends a signal to the writing means 132 (Y, M, C, K) through the signal line 133, thereby conducting a predetermined exposure light control relative to each writing means 132 (Y, M, C, K). The exposure light control is equivalent to an operation of controlling the exposure unit 43 using a light beam emitted from a laser light source, for example, in an embodiment of FIG. 1. The control section 130 is connected to a host computer 140 and starts its control program according to a signal from the host computer 140. The color registration error correction data may be sent to the host computer 140 and the color registration error correction data of the apparatus may be stored in the host computer 140. In this case, the host computer 140 carries out the image processing on the basis of the received color registration error correction data and sends printing data after correction processing to the controller. According to this printing data, the printing is conducted. By conducting such processing, the structure of the controller is simplified, thereby reducing the cost of the image forming apparatus.

Figure 17:
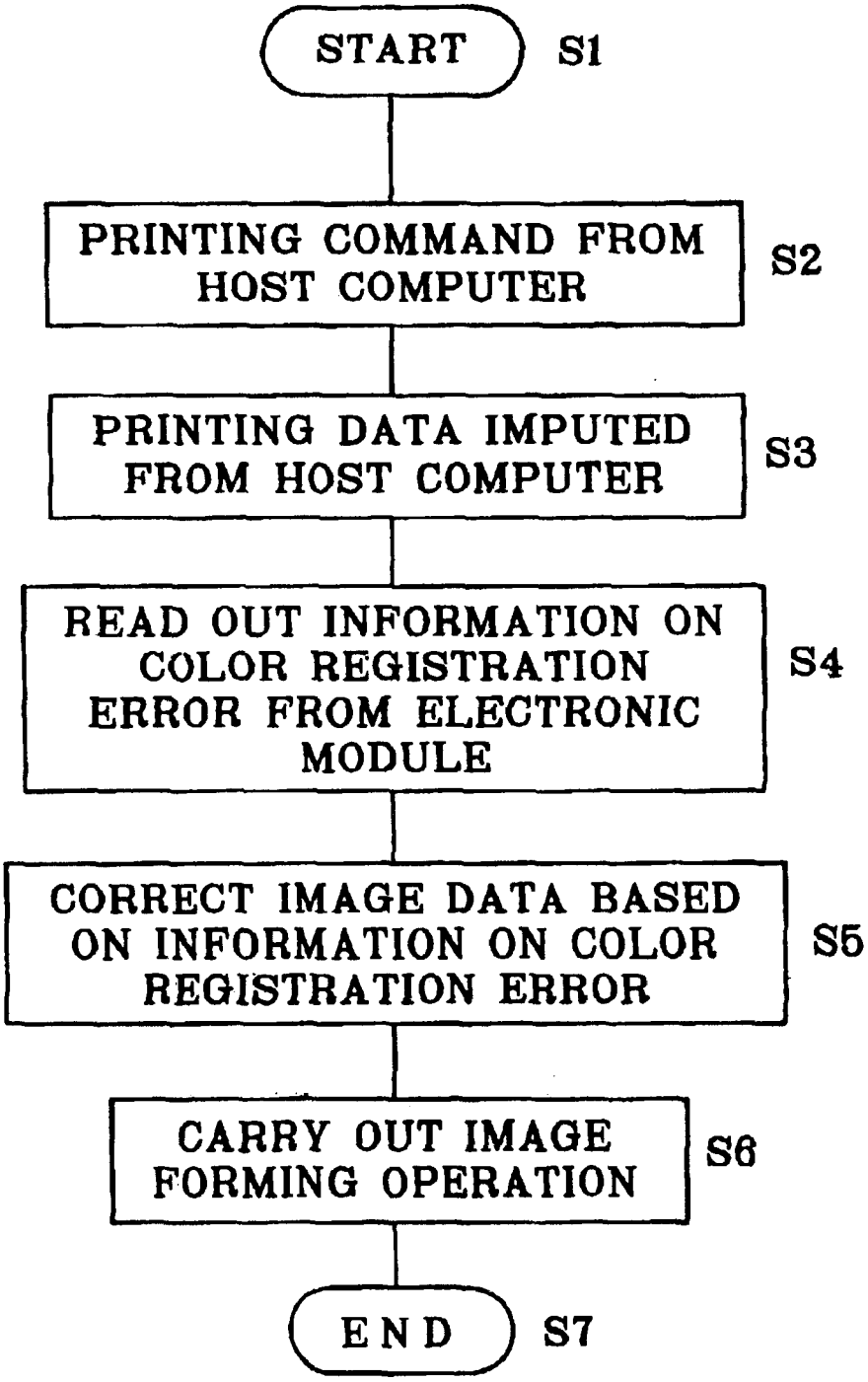
FIG. 17 is a flow chart showing the correction procedures.

FIG. 17 is a flow chart showing the procedures of the color registration error correction of the present invention. Referring to FIG. 17, the control section 130 starts the process program (Step S1) and then receives a printing command from the host computer 140 (Step S2). Sequentially, printing data is inputted from the host computer 140 (Step S3). The CPU 131*a* reads out information on color registration error from the electronic module 110 (Step S4) and corrects image data stored in the RAM for image data (Step S5). Then, the action of forming an image is carried out (Step S6) and the processing program is ended (Step S7).

Figure 18A:
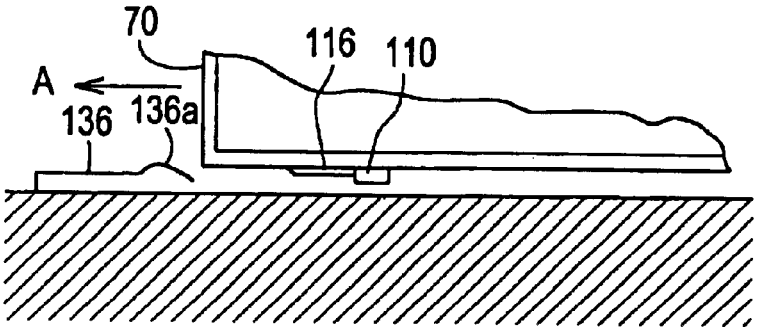
FIGS. 18(*a*), 18(*b*), 18(*c*) are illustrations showing examples of signal communicating means between an electronic module to an controller.
Figure 18B:
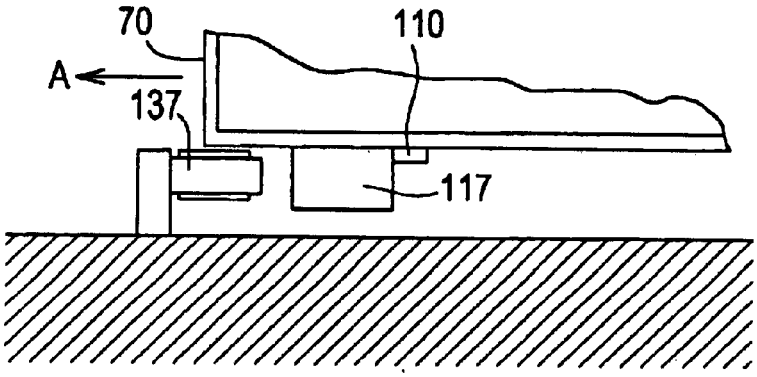
Figure 18C:
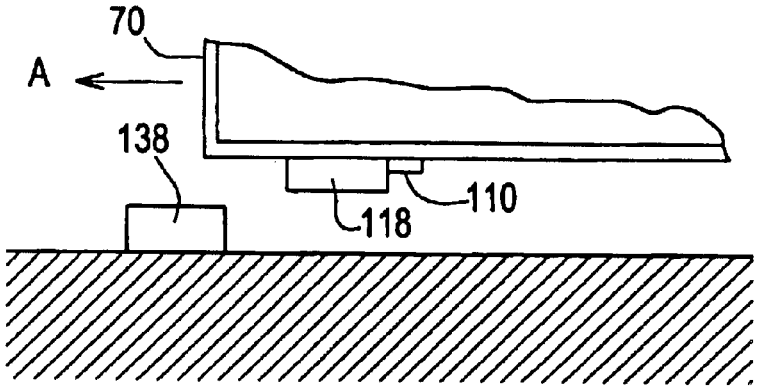

FIGS. 18(*a*), 18(*b*), 18(*c*) are illustrations showing examples of the signal communicating means for transmitting a signal from the electronic module 110 to the controller 131. FIG. 18(*a*) shows an example employing a contact electrode 116 electrically connected to the electronic module 110. A contact electrode 136 made of an elastic metal piece is disposed on the apparatus body side. A contact portion 136*a* of the contact electrode 136 is curved to project upwardly. The frame 70 of the photoreceptor cartridge is moved in a direction of arrow "A" so as to bring the contact electrode 116 into contact with the contact electrode 136. During this, the electronic module 110 and the controller 131 are electrically connected.

Though the structure shown in FIG. 18(*a*) can be relatively easily achieved, it has a problem that the contact between the contact electrodes 116 and 136 may be unstable, for example, when the photoreceptor cartridge is moved. FIG. 18(*b*) shows an example improved to solve the problem. In FIG. 18(*b*), numeral 117 designates a female connector fixed to the frame 70 and numeral 137 designates a male connector fixed to the apparatus body side. By moving the frame 70 in a direction of arrow "A", the female connector 117 and male connector 137 are engaged with each other, whereby the electronic module 110 and the controller 131 are electrically connected. The male connector 137 may be fixed to the frame 70 and the female connector 117 may be fixed to the apparatus body.

In the structure shown in FIG. 18(*b*), the female connector 117 and the male connector 137 are engaged and thus mechanically fixed. Therefore, the example of FIG. 18(*b*) is superior to the example of FIG. 18(*a*) in that the electric connection between the electronic module 110 and the controller 131 is stable even when the frame 70 is moved. However, the contact resistance between the connectors may be changed so as to make the signal transmission unstable when the female connector 117 and the male connector 137 are engaged unless these connectors are accurately aligned. FIG. 18(*c*) shows an example of solving the problems of the example of FIGS. 18(*a*) and 18(*b*). In the example of FIG. 18(*c*), an antenna 118 electrically connected to the electronic module 110 is disposed on the frame 70 and an antenna 138 is disposed on the apparatus body.

In the structure as mentioned above, when the frame 70 is moved in a direction of arrow "A", signals can be transmitted between the electronic module 110 and the controller 131 without contact through the antennas 118 and 138. Therefore, suitable transmission of signals can be done even when the frame 70 is moved. In case of employing the structure of FIG. 18(*a*) or FIG. 18(*b*) for connection between the electronic module 110 and the control section 130, in FIG. 16, the connecting section is provided instead of the communicating circuit 131*c* of the controller 131. In case of employing the structure of FIG. 18(*c*), the signal line 134 shown in FIG. 16 is actually omitted.

Table 1 is a table showing examples of correcting color registration errors on the basis of the information on color registration error according to the present invention.

TABLE 1

| Item | Information on color registration Error | Mode of Color Registration Error | Correcting Method |
|---|---|---|---|
| (1) | Positional error of image carrier (YMCK) in "X" direction | Variation in start position of writing an image in "X" direction | Correct the start timing for writing an image in "X" direction |
| (2) | Positional error of image carrier (YMCK) in "Y" direction | Variation in width of image in "Z" direction | Modulate the writing clock for writing an image |
| (3) | Error in diameter of image carrier (YMCK) | Variation in width of image in "Z" direction | Modulate writing clock for writing an image |
| (4) | Error in parallelism of image carrier (YMCK) (Parallelism is based on a "XZ" plane) | Inclination of image | Correct the error by rearranging image data |
| (5) | Coefficient of linear expansion of positioning member | Variation in start position of writing an image in "X" direction (when the apparatus temperature varies) | Correct the start timing for writing image according to the apparatus temperature |

Figure 19A:
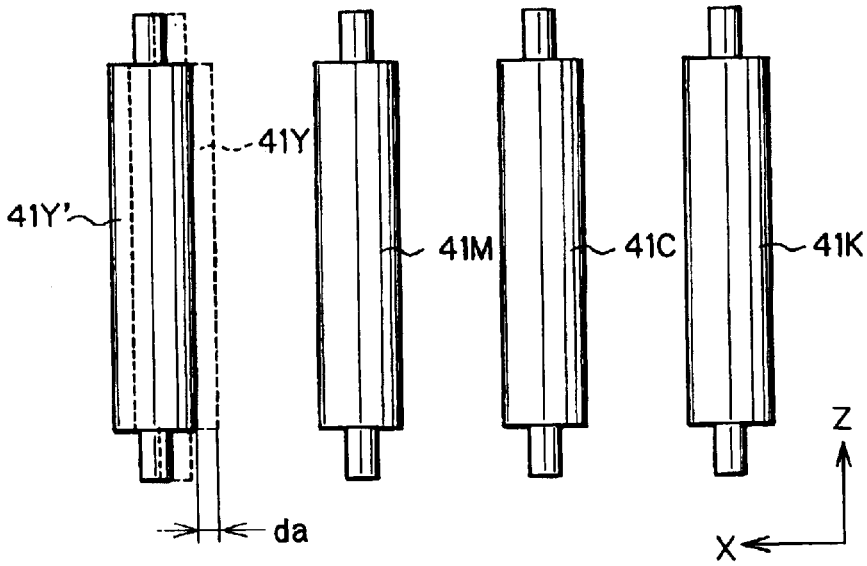
FIGS. 19(*a*), 19(*b*) are illustrations for explaining an example of color registration error of an image carrier cartridge of the first embodiment according to the present invention.
Figure 19B:
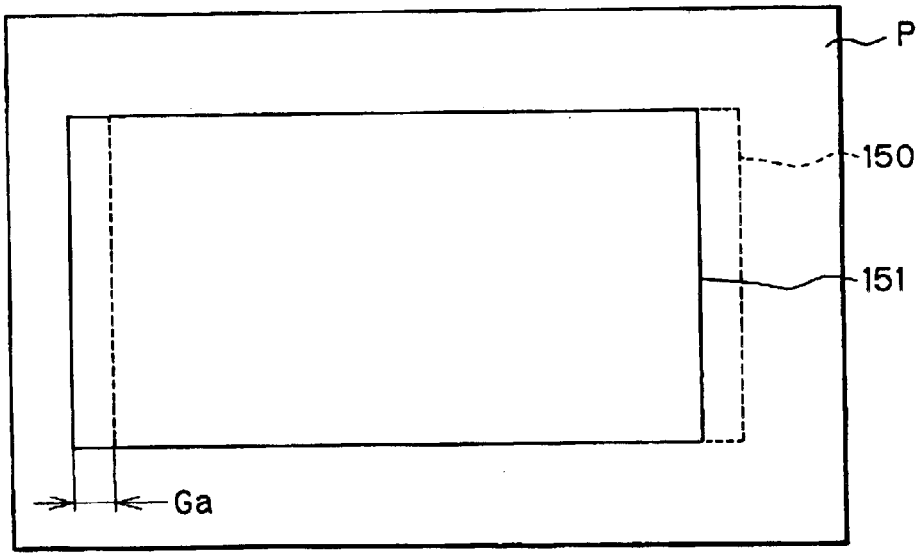
Figure 23A:
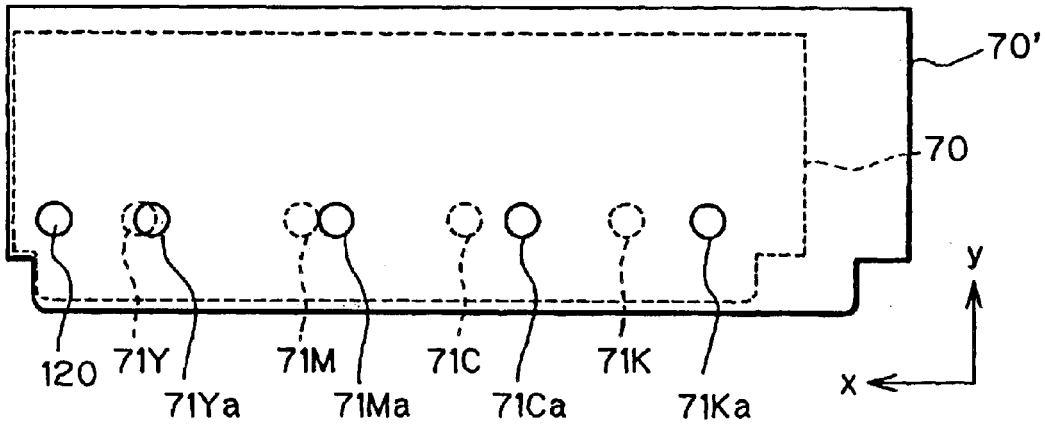
FIGS. 23(*a*), 23(*b*) are illustrations for explaining an example of color registration error of an image carrier cartridge of the first embodiment according to the present invention.
Figure 23B:
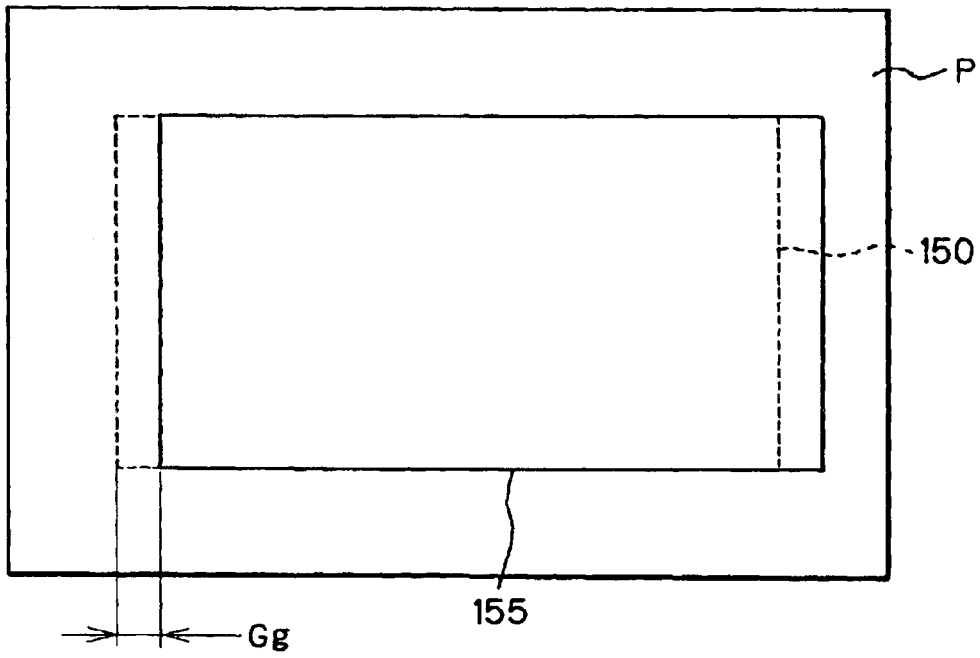

Now, the following will be concrete description on how to correct color registration errors with respect to the items in Table 1, respectively, referring to FIG. 19(*a*) through FIG. 23(*b*). FIGS. 19(*a*), 19(*b*) correspond to the item (1) in Table 1. FIG. 19(*a*) shows an example in which among photoreceptors (image carriers) 41 (Y, M, C, and K), the photoreceptor 41Y is shifted by "da" from the normal position indicated by broken lines in the "X" direction to the position indicated by 41Y'. The mode of color registration error created in this case is "Variation in start position of writing an image in "X" direction. In this case, an image on a recording medium "P" is not formed on the normal image position 150 indicated by broken lines and is formed in a position 151 shifted by "Ga" from the normal position in the "X" direction.

To resolve this problem, the start timing of writing an image in the "X" direction is corrected. That is, according to the shifted position (i.e. whether the position is shifted to the right or to the left as seen in a plane of the drawing) and the shifted amount of the photoreceptor 41Y in the "X" direction, it is determined to hasten or delay the start timing of writing an image in the "X" direction. Further, the starting time for writing the image in the "X" direction. By conducting the correction as mentioned above, the image can be formed on the normal position (absolute position) 150.

Figure 20A:
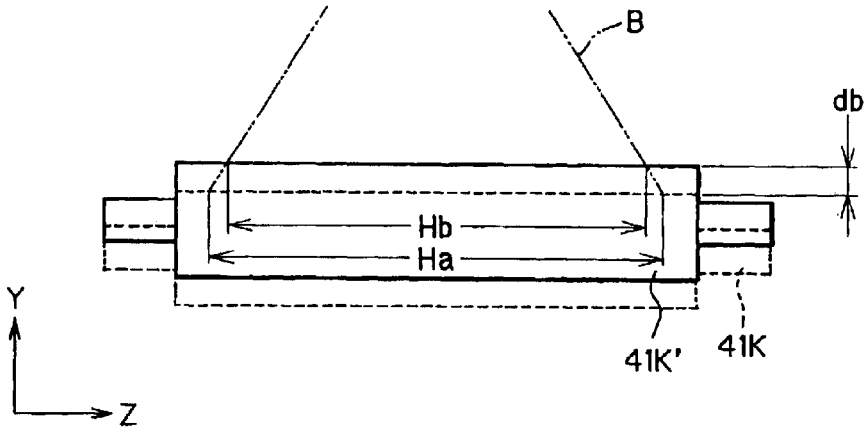
FIGS. 20(*a*), 20(*b*) are illustrations for explaining an example of color registration error of an image carrier cartridge of the first embodiment according to the present invention.
Figure 20B:
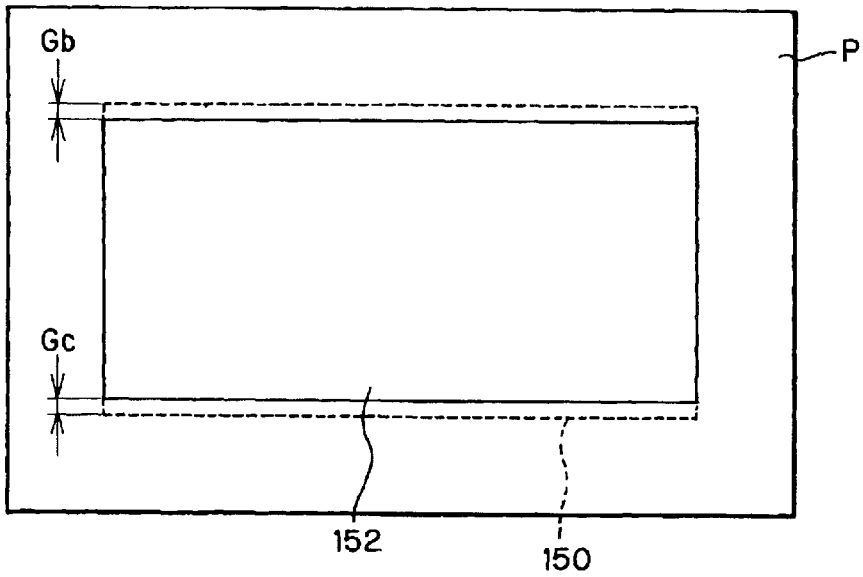

FIGS. 20(*a*), 20(*b*) correspond to the item (2) in Table 1. FIG. 20(*a*) shows an example in which among the photoreceptors (image carriers) 41 (Y, M, C, and K), the photoreceptor 41K is shifted by "db" from the normal position indicated by broken lines in the "Y" direction to the position indicated by 41K'. In this case, an image on a recording medium P is formed in a position 152 which is shifted by "Gb" and "Gc" in the width directions relative to the normal image position 150 as shown in FIG. 20(*b*). The mode of color registration error created in this case is "Variation in width of image in "Z" direction". The reason is that the range, on which a light beam B is incident, of the rotational surface of the photoreceptor 41K is narrowed on both sides of the rotational surface in the "Z" direction from the normal range "Ha" into a range "Hb" as shown in FIG. 20(*a*). In the example of FIGS. 20(*a*), 20(*b*), the correction of color registration error is conducted by controlling the pulse-width modulation (PWM) to enlarge the pulse width.

Figure 21A:
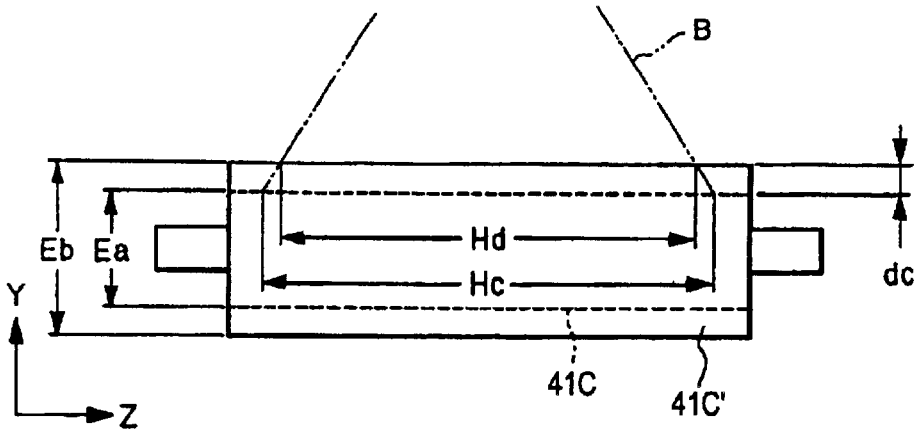
FIGS. 21(*a*), 21(*b*) are illustrations for explaining an example of color registration error of an image carrier cartridge of the first embodiment according to the present invention.
Figure 21B:
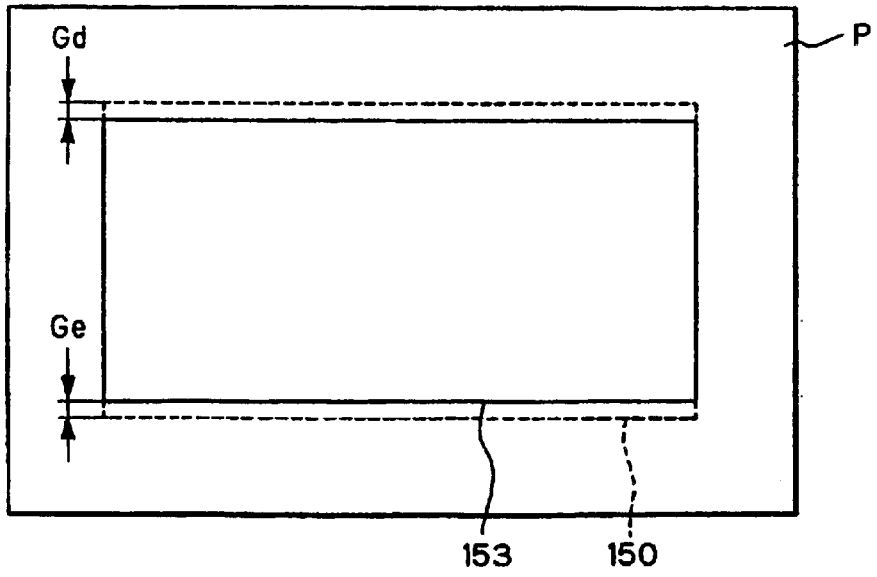

FIGS. 21(*a*), 21(*b*) correspond to the item (3) in Table 1. FIG. 21(*a*) shows an example in which among the photoreceptors (image carriers) 41 (Y, M, C, and K), the photoreceptor 41C has a diameter Eb which is larger than the normal diameter Ea, by an amount dc, indicated by broken lines so that the rotational surface is located at a position 41C'. In this case, an image on a recording medium P is formed in a position 153 which is shifted by "Gd" and "Ge" in the width directions relative to the normal image position 150 as shown in FIG. 21(*b*). The mode of color registration error created in this case is "Variation in width of image in "Z" direction" similarly to the example of FIGS. 20(*a*), 20(*b*). The reason is that the range, on which a light beam B is incident, on the rotational surface of the photoreceptor 41C is narrowed on both sides of the rotational surface in the "Z" direction from the normal range "Hc" into a range "Hd" as shown in FIG. 21(*a*). In the example of FIGS. 21(*a*), 21(*b*), the correction of color registration error is conducted by controlling the pulse-width modulation (PWM) to enlarge the pulse width in the same manner as the example of FIGS. 20(*a*), 20(*b*). As described in the above, according to the present invention, the color registration errors due to dimensional errors such as diameter of the respective image carrier can be corrected.

Figure 22A:
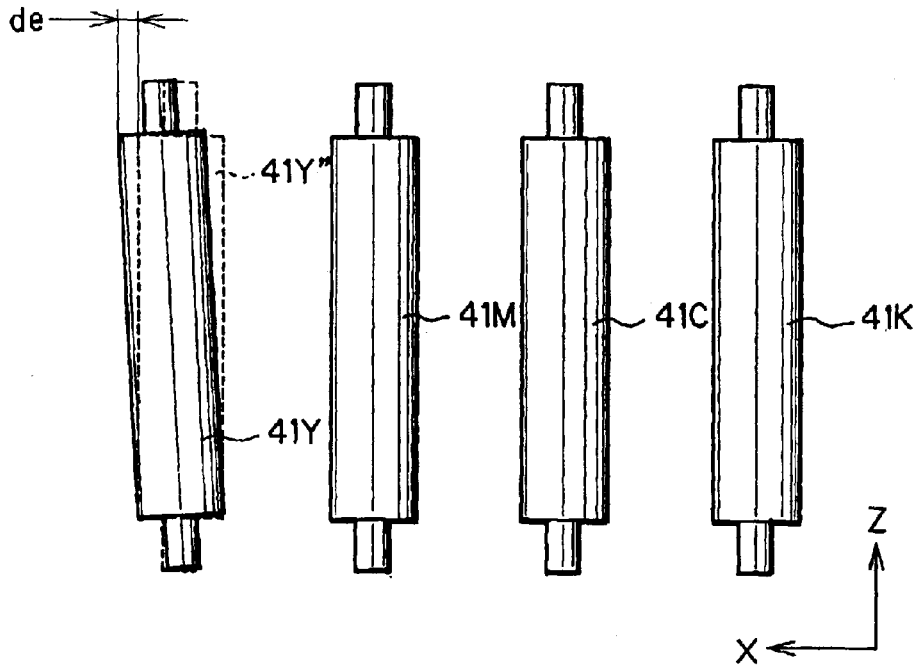
FIGS. 22(*a*), 22(*b*) are illustrations for explaining an example of color registration error of an image carrier cartridge of the first embodiment according to the present invention.
Figure 22B:
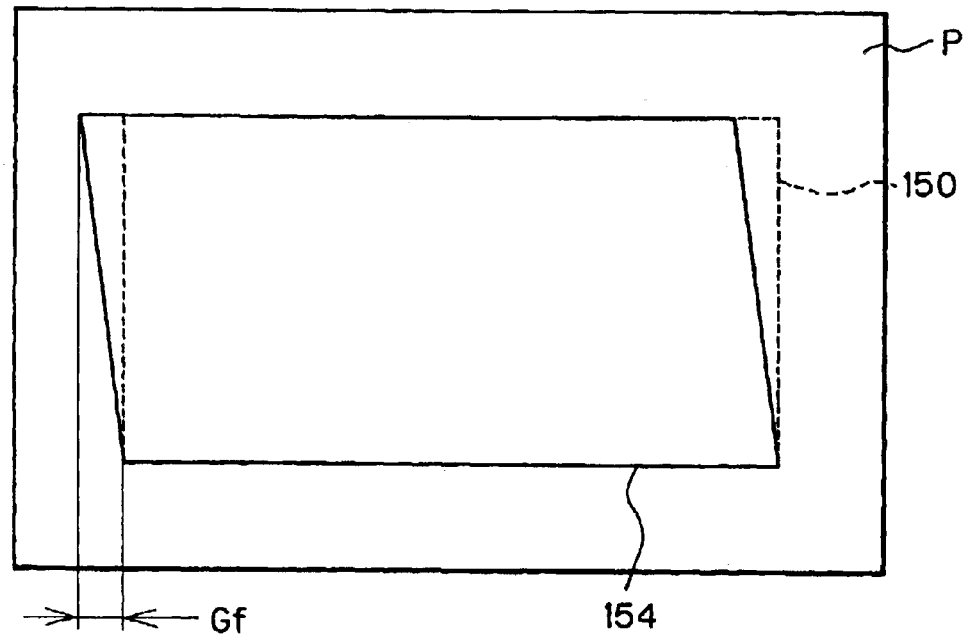

FIGS. 22(*a*), 22(*b*) correspond to the item (4) in Table 1 and show an example of color registration error due to error in parallelism of an image carrier. FIG. 22(*a*) shows an example in which among the photoreceptors (image carriers) 41 (Y, M, C, and K), the photoreceptor 41Y is inclined by "de" from the normal position indicated by broken lines so that the rotational surface is located at a position 41Y". In this case, an image 154 formed on a recording medium "P" is inclined by "Gf" relative to the normal image position 150. That is, the mode of color registration error created in this case is "Inclination of image". In this case, the correction of image error is conducted by rearranging the image data.

FIGS. 23(*a*), 23(*b*) correspond to the item (5) in Table 1. FIG. 23(*a*) shows an example in which the coefficient of linear expansion of a positioning member for the frame 70 holding the photoreceptors (image carriers) 41 (Y, M, C, and K) is increased because of increase in temperature, with the result that the frame 70 varies from the normal position indicated by broken lines to a position 70' indicated by solid lines (in this figure, the variation is shown in an exaggerated form). The photoreceptors are consequently shifted from the normal position to the positions indicated by 71 (Ya, Ma, Ca and Ka). In this case, an image 155 formed on a recording medium "P" is shifted by "Gg" relative to the normal image position 150 as shown in FIG. 23(*b*). That is, the mode of color registration error created in this case is "Variation in start position of writing an image in "X" direction when the apparatus temperature varies". In this case, the correction of image error is conducted by correcting the start timing for writing an image according to the apparatus temperature. In the example of FIG. 23(*b*), the start timing for writing an image is earlier than the normal state. As described in the above, the color registration errors due to variations in linear expansion of the positioning member or alteration in coefficient of linear expansion because the material is changed can be corrected.

Table 2 is a table showing other examples of correcting color registration errors on the basis of the information on color registration error according to the present invention.

TABLE 2

| Item | Information on color registration Error | Mode of Color Registration Error | Correcting Method |
|---|---|---|---|
| (1) | Positional error of image carrier (YMCK) in "X" direction | Variation in start position of writing an image in "X" direction | Correct the start timing for writing an image in "X" direction |
| (2) | Error of writing position in rotational direction of image carrier (YMCK) | Variation in start position of writing an image in "X" direction | Correct the start timing for writing an image in "X" direction |
| (3) | Error of writing position in "Z" direction of image carrier (YMCK) | Variation in start position of writing an image in "Z" direction | Correct the start timing for writing an image in "Z" direction |
| (4) | Error in parallelism of writing means relative to the axis of image carrier (YMCK) | Inclination of image | Correct the error by rearranging image data |
| (5) | Error in parallelism of image carrier (YMCK) (Parallelism is based on a "XZ" plane) | Inclination of image | Correct the error by rearranging image data |
| (6) | Coefficient of linear expansion of positioning member | Variation in start position of writing an image in "X" direction (when the apparatus temperature varies) | Correct the start timing for writing an image according to the apparatus temperature |

TABLE 2-continued

| Item | Information on color registration Error | Mode of Color Registration Error | Correcting Method |
|---|---|---|---|
| (7) | Decentering and the direction of decentering of gear of image carrier (YMCK) | Variation in position of image in "X" direction | Correct the error by rearranging image data or correcting the writing timing |

Figure 24A:
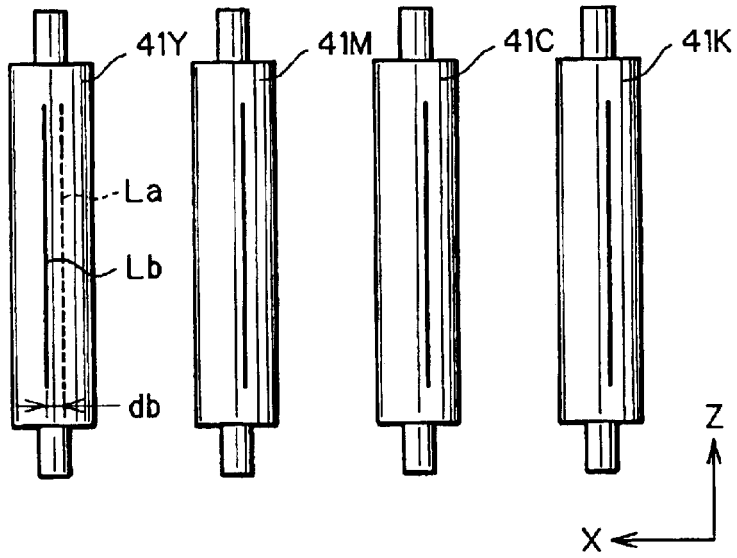
FIGS. 24(*a*), 24(*b*) are illustrations for explaining an example of color registration error of an image carrier cartridge of the second embodiment according to the present invention.
Figure 24B:
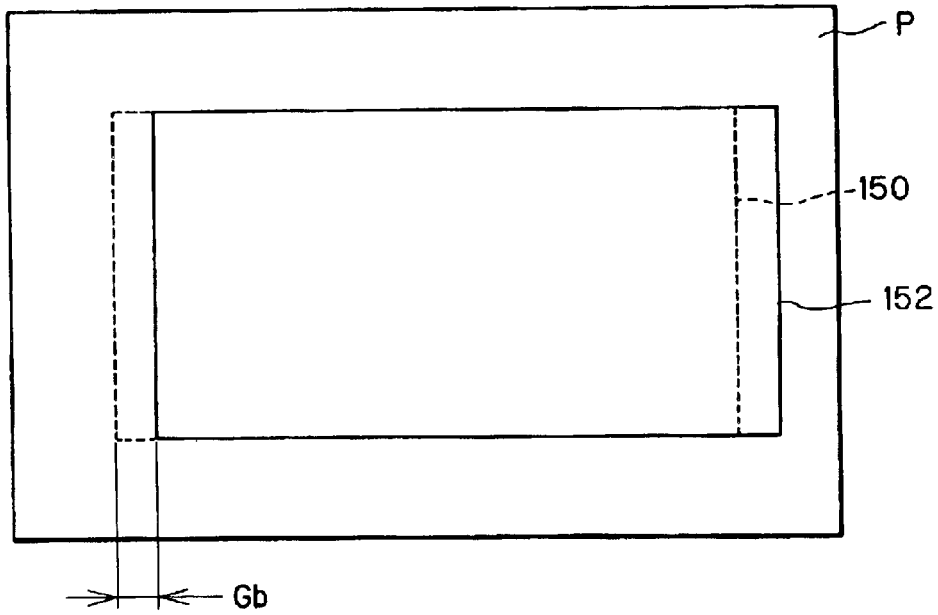
Figure 28A:
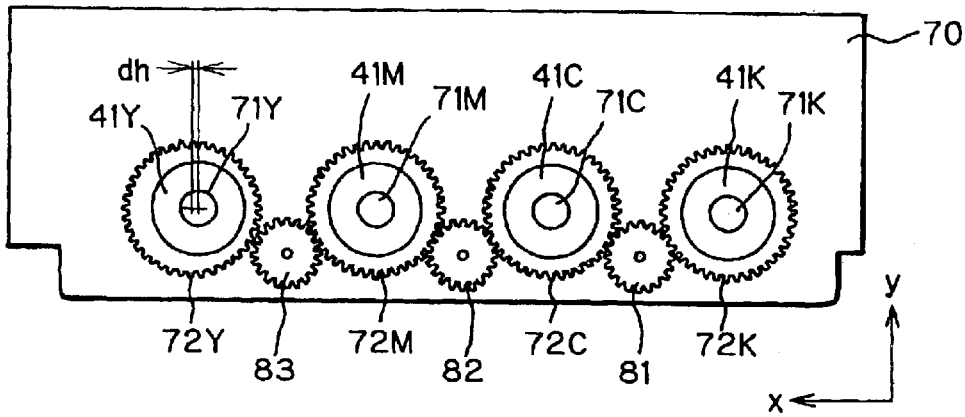
FIGS. 28(*a*), 28(*b*) are illustrations for explaining an example of color registration error of an image carrier cartridge of the second embodiment according to the present invention.
Figure 28B:
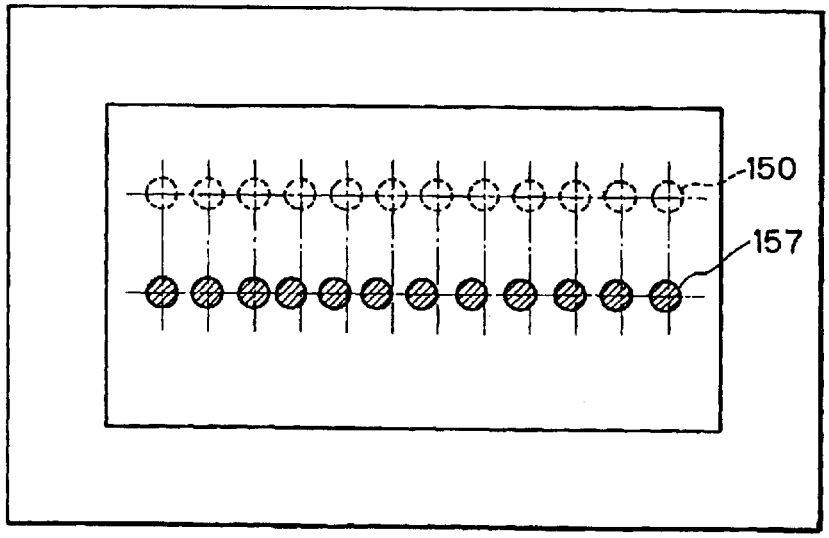

The following will be concrete description on how to correct color registration errors with respect to the items in Table 2, respectively, referring to FIG. 24(*a*) through FIG. 28(*b*). The item (1) in Table 2 is the same as the item (1) of Table 1 (FIGS. 19(*a*), 19(*b*)).

FIGS. 24(*a*), 24(*b*) correspond to the item (2) in Table 2. FIG. 24(*a*) shows an example in which among the photoreceptors (image carriers) 41 (Y, M, C, and K), the start position of writing in the "X" direction relative to the photoreceptor 41Y is shifted by "db" from the normal position "La" indicated by a broken line to a position "Lb". In this case, an image position 152 formed on a recording medium "P" is shifted by "Gb" relative to the normal image position 150 in the "X" direction as the feeding direction of the recording medium "P" as shown in FIG. 24(*b*). The mode of color registration error created in this case is "Variation in start position of writing an image in "X" direction". In this case, the correction of image error is achieved by correcting the start timing for writing an image. In the example as described in the above, since the start position "Lb" of writing in the "X" direction relative to the photoreceptor 41Y is shifted by "db" in the direction of hastening the start timing from the normal position "La", the start timing of writing an image in the "X" direction is corrected to be delayed by "db", thereby preventing the occurrence of color registration error.

Figure 25A:
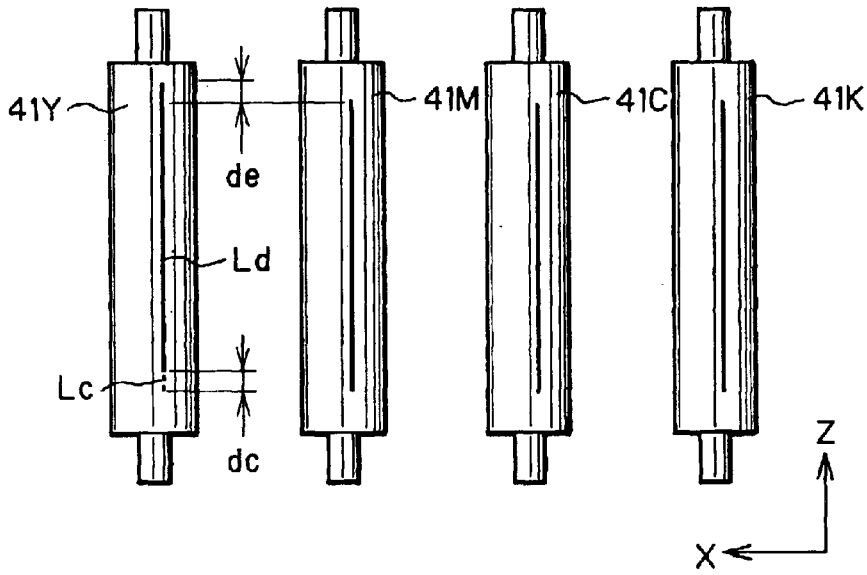
FIGS. 25(*a*), 25(*b*) are illustrations for explaining an example of color registration error of an image carrier cartridge of the second embodiment according to the present invention.
Figure 25B:
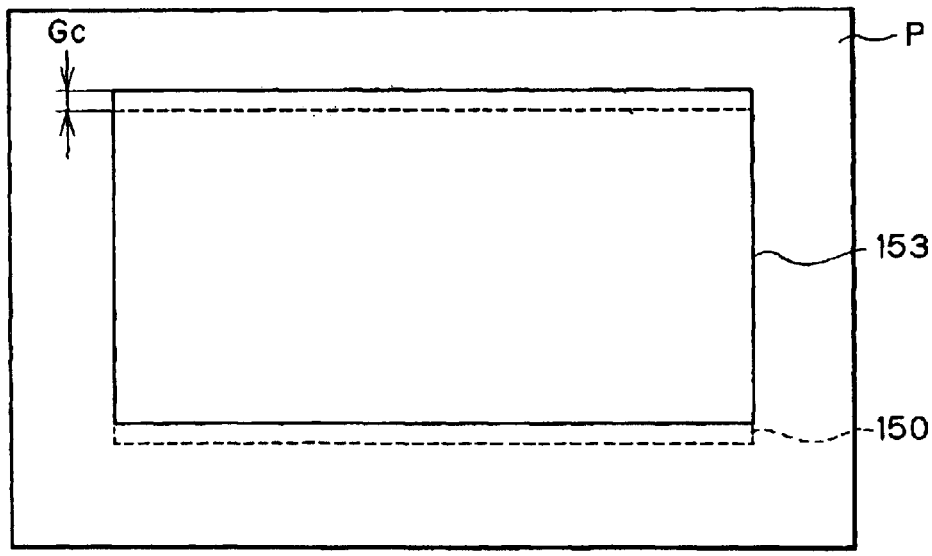

FIGS. 25(*a*), 25(*b*) correspond to the item (3) in Table 2. FIG. 25(*a*) shows an example in which among the photoreceptors (image carriers) 41 (Y, M, C, and K), the start position of writing in the "Z" direction of the photoreceptor 41Y is shifted by "dc" from the normal position "Lc" to a position "Ld". In this example, an image is formed in a position protruding by "de" from the normal position in the "Z" direction of the photoreceptor 41Y. In this case, an image on the recording medium "P" is formed in a position 153 shifted by "Gc" in the width direction (upwardly in the drawing) relative to the normal image position 150 as shown in FIG. 25(*b*). The mode of color registration error created in this case is "Variation in start position of writing an image in "Z" direction". The correction of color registration error of the example of FIGS. 25(*a*), 25(*b*) is conducted by correcting the position of image in the "Z" direction. That is, the light-emitting pixels of an LED array are shifted to move the image position of light emitted from the LED array by "dc", thereby forming the image at the normal image position "Lc".

Figure 26A:
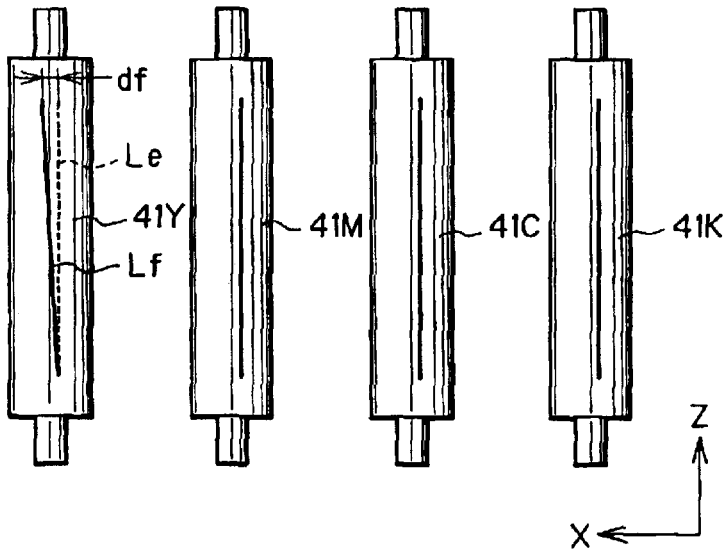
FIGS. 26(*a*), 26(*b*) are illustrations for explaining an example of color registration error of an image carrier cartridge of the second embodiment according to the present invention.
Figure 26B:
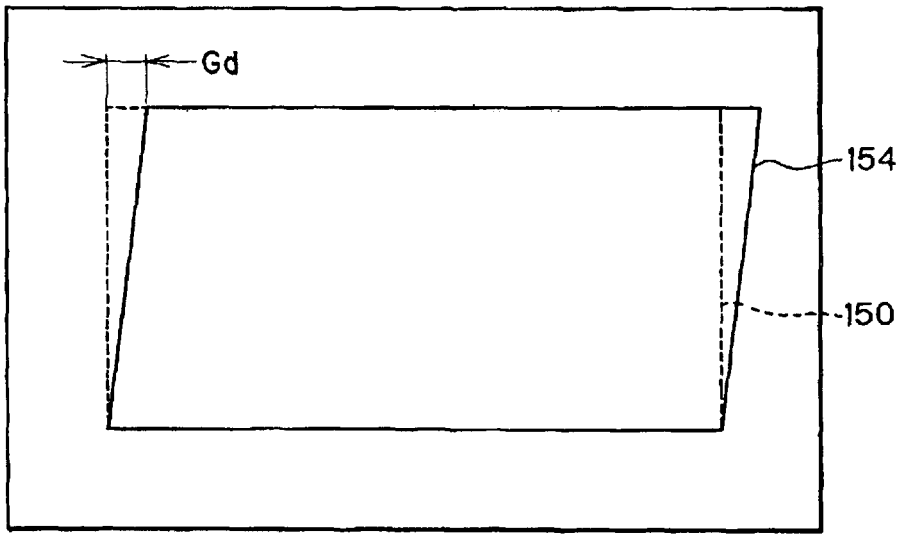

FIGS. 26(*a*), 26(*b*) correspond to the item (4) in Table 2 and show an example of color registration error due to error in parallelism of writing means. FIG. 24(*a*) shows an example in which there is an error in parallelism of the writing means Lf relative to the normal position Le indicated by broken lines of the photoreceptor 41Y among the photoreceptors (image carriers) 41 (Y, M, C, and K). In this example, the writing means Lf is inclined by "df" relative to the normal position Le of the image carrier. In this case, an image 154 formed on a recording medium "P" is inclined by "Gd" relative to the normal image position 150. That is, the mode of color registration error created in this case is "Inclination of image". In this case, the correction of image error is conducted by rearranging the image data.

Figure 27A:
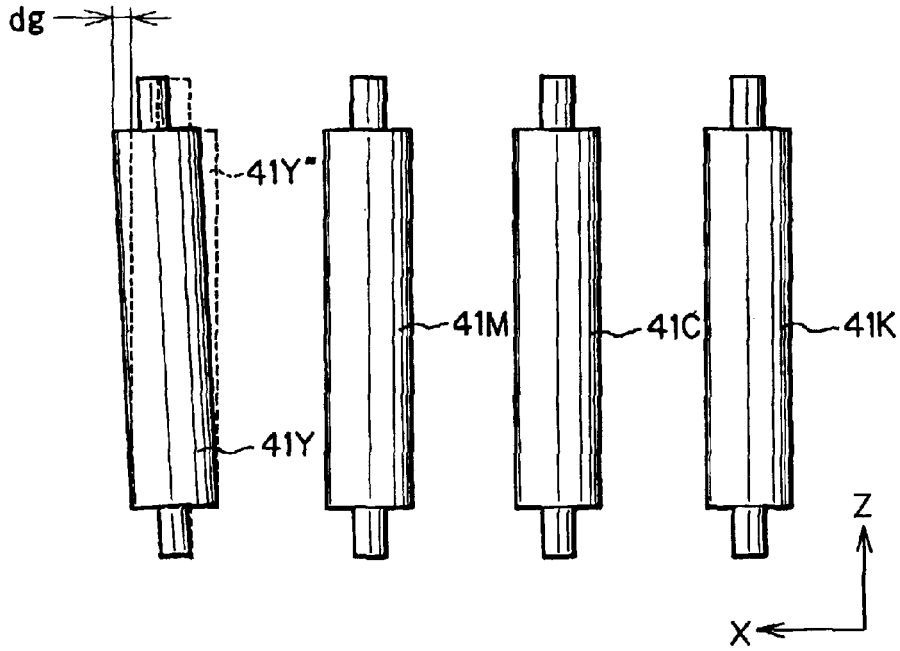
FIGS. 27(*a*), 27(*b*) are illustrations for explaining an example of color registration error of an image carrier cartridge of the second embodiment according to the present invention.
Figure 27B:
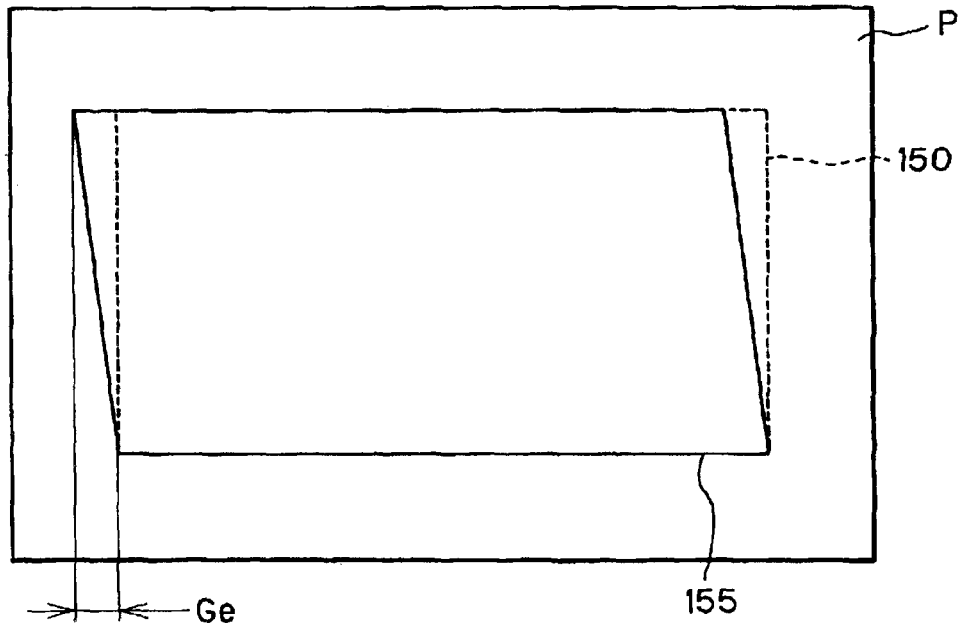

FIGS. 27(*a*), 27(*b*) correspond to the item (5) in Table 2 and show an example of color registration error due to error in parallelism of an image carrier. FIG. 27(*a*) shows an example in which among the photoreceptors (image carriers) 41 (Y, M, C, and K), the photoreceptor 41Y is inclined by "dg" from the normal position indicated by broken lines so that the rotational surface is located at a position 41Y". In this case, an image 155 formed on the recording medium "P" is inclined by "Ge" relative to the normal image position 150 as shown in FIG. 27(*b*). That is, the mode of color registration error created in this case is "Inclination of image". In this case, the correction of image error is conducted by rearranging the image data.

The item (6) in Table 2 is the same as the item (5) of Table 1 (FIGS. 23(*a*), 23(*b*)). FIGS. 28(*a*), 28(*b*) correspond to the item (7) in Table 2 and show an example of color registration error due to decentering and the direction of the decentering of the gear of an image carrier. Referring to FIG. 28(*a*), the shafts 71 (Y, M, C, and K) and the gears 72 (Y, M, C, and K) of the photoreceptors (image carriers) 41 (Y, M, C, and K), and idle gears 81 through 83 are arranged. The gears 72 (Y, M, C, and K) are formed by using the same mold. For example, since the gear 72Y of the image carrier 41Y is decentered, the shaft 71Y is arranged at a position shifted by "dh" from the normal position. In this case, information on color registration error due to the decentering and the direction of the decentering (in the illustrated example, the shaft 71Y is shifted from the normal position to the right as seen in the drawing) of the gear of the image carrier is obtained. As shown in FIG. 28(*b*), an image 157 shifted in the "X" direction relative to the normal image position 150 is formed. That is, the mode of color registration error created in this case is "Variation in position of image in "X" direction". In this case, the correction of image error is conducted by rearranging the image data or correcting the timing of writing an image. As described in the above, according to the present invention, the correction of color registration errors can be conducted on the basis of information on color registration errors which is obtained based on the rotational error of an image carrier by the force transmitting member provided on the image carrier cartridge.

Table 3 is a table showing other examples of correcting color registration errors on the basis of the information on color registration error according to the present invention.

TABLE 3

| Item | Information on color registration Error | Mode of Color Registration Error | Correcting Method |
|---|---|---|---|
| (1) | Error of start position for writing image in "X" direction | Variation in start position of writing an image in "X" direction | Correct the start timing for writing an image in "X" direction |
| (2) | Error of writing position in "Z" direction of image carrier (YMCK) | Variation in start position of writing an image in "Z" direction | Correct the start timing for writing an image in "Z" direction |
| (3) | Error of inclination of image | Inclination of image | Correct the error by rearranging image data |
| (4) | Coefficient of linear expansion of positioning member | Variation in start position of writing an image in "X" | Correct the start timing for writing an image according |

TABLE 3-continued

| Item | Information on color registration Error | Mode of Color Registration Error | Correcting Method |
|---|---|---|---|
| | | direction (when the apparatus temperature varies) | to the apparatus temperature |
| (5) | Decentering and the direction of decentering of gear of image carrier (YMCK) | Variation in position of image in "X" direction | Correct the error by rearranging image data or correcting the writing timing |

Figure 29A:
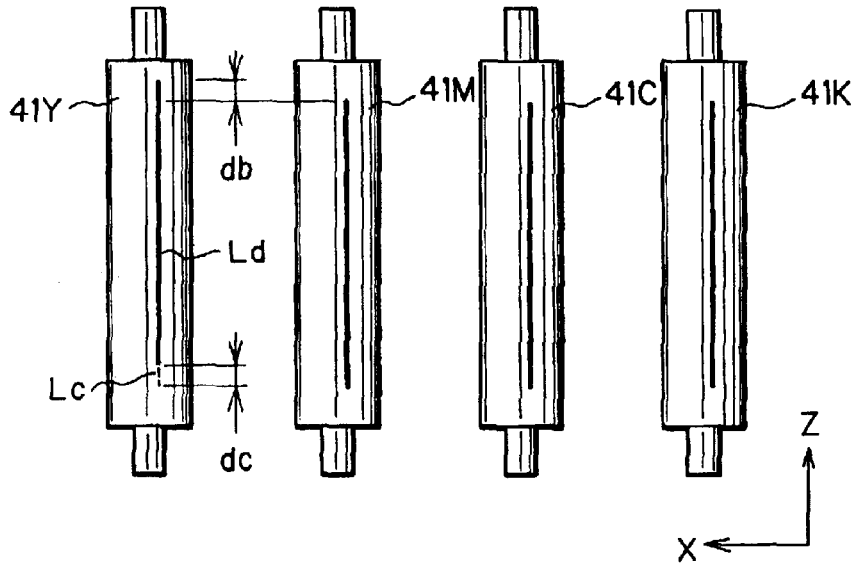
FIGS. 29(*a*), 29(*b*) are illustrations for explaining an example of color registration error of an image carrier cartridge of the third embodiment according to the present invention.
Figure 29B:
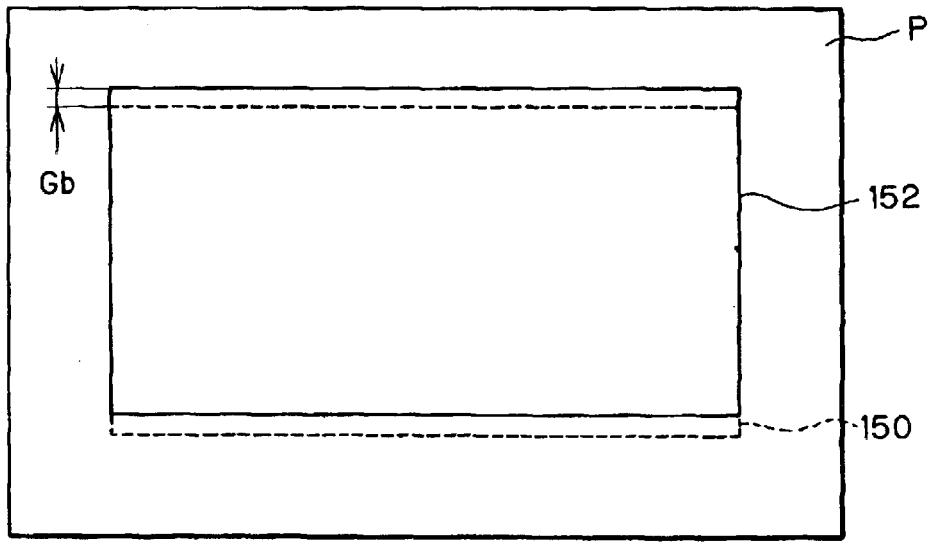
Figure 32A:
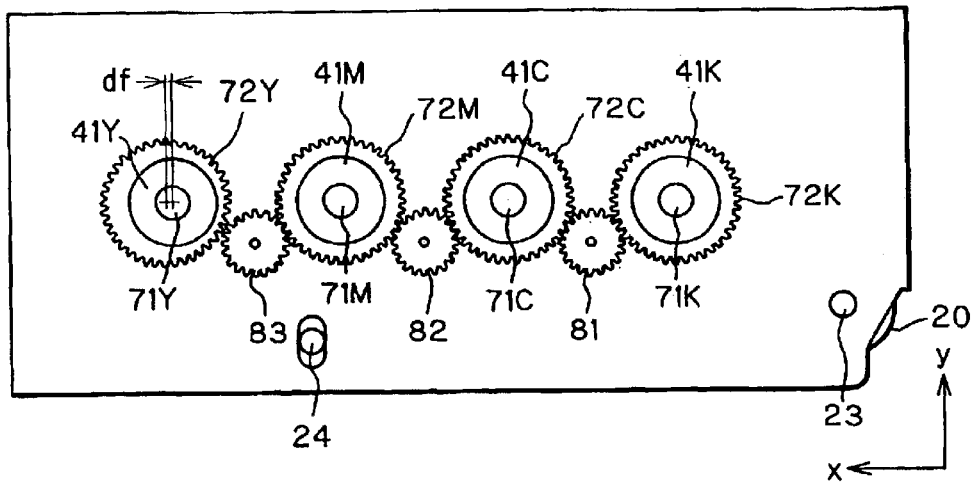
FIGS. 32(*a*), 32(*b*) are illustrations for explaining an example of color registration error of an image carrier cartridge of the third embodiment according to the present invention.
Figure 32B:
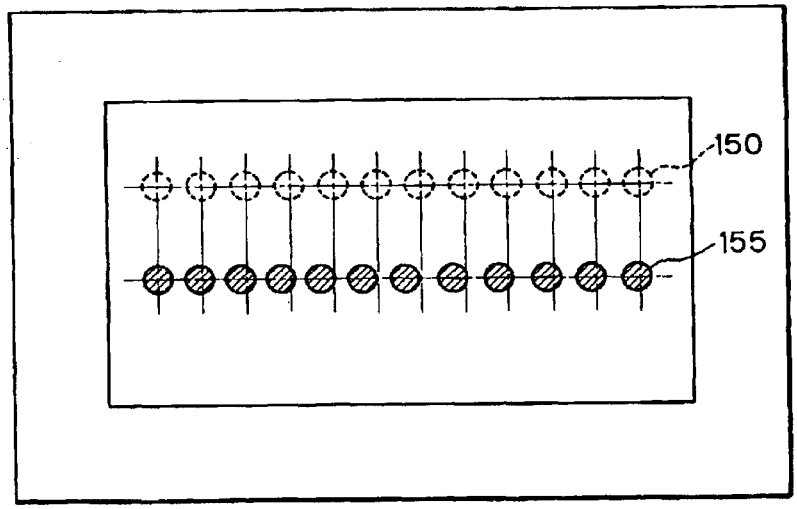

The following will be concrete description on how to correct color registration errors with respect to the items in Table 3, respectively, referring to FIG. 29(*a*) through FIG. 32(*b*). The item (1) in Table 3 is substantially the same as the item (1) of Table 1 (FIGS. 19(*a*), 19(*b*)). FIGS. 29(*a*), 29(*b*) correspond to the item (2) in Table 3. FIG. 29(*a*) shows an example in which among the photoreceptors (image carriers) 41 (Y, M, C, and K), the start position of writing in the "Z" direction relative to the photoreceptor 41Y is shifted by "dc" from the normal position "Lc" indicated by a broken line to a position "Ld". In this example, an image is formed in a position protruding by "db" from the normal position in the "Z" direction of the image photoreceptor 41Y. In this case, an image position 152 formed on a recording medium "P" is shifted by "Gb" in the width direction (upwardly in the drawing) relative to the normal image position 150 as shown in FIG. 29(*b*). The mode of color registration error created in this case is "Variation in start position of writing an image in the "Z" direction". The correction of color registration error of the example of FIGS. 29(*a*), 29(*b*) is conducted by correcting the position of image in the "Z" direction. That is, the light-emitting pixels of an LED array are shifted to move the image position of light emitted from the LED array by "dc", thereby forming the image at the normal image position "Lc".

Figure 30A:
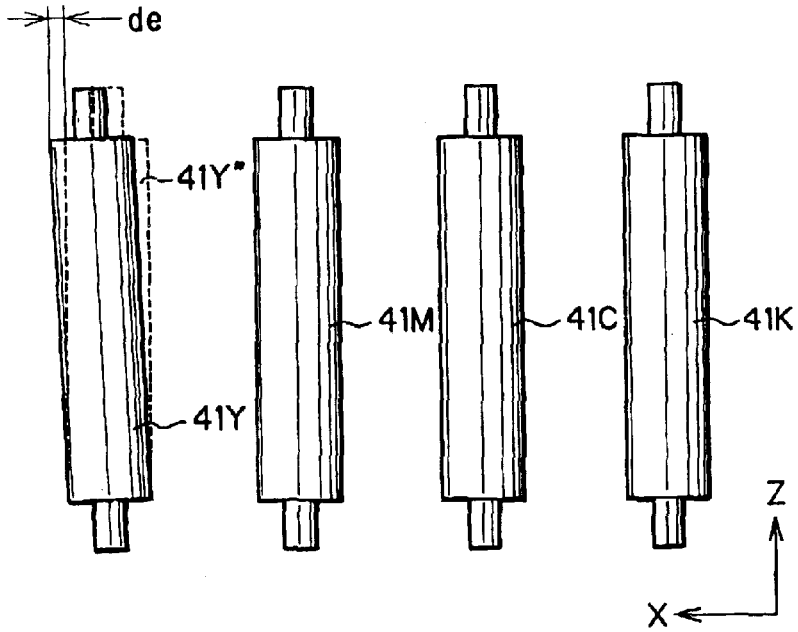
FIGS. 30(*a*), 30(*b*) are illustrations for explaining an example of color registration error of an image carrier cartridge of the third embodiment according to the present invention.
Figure 30B:
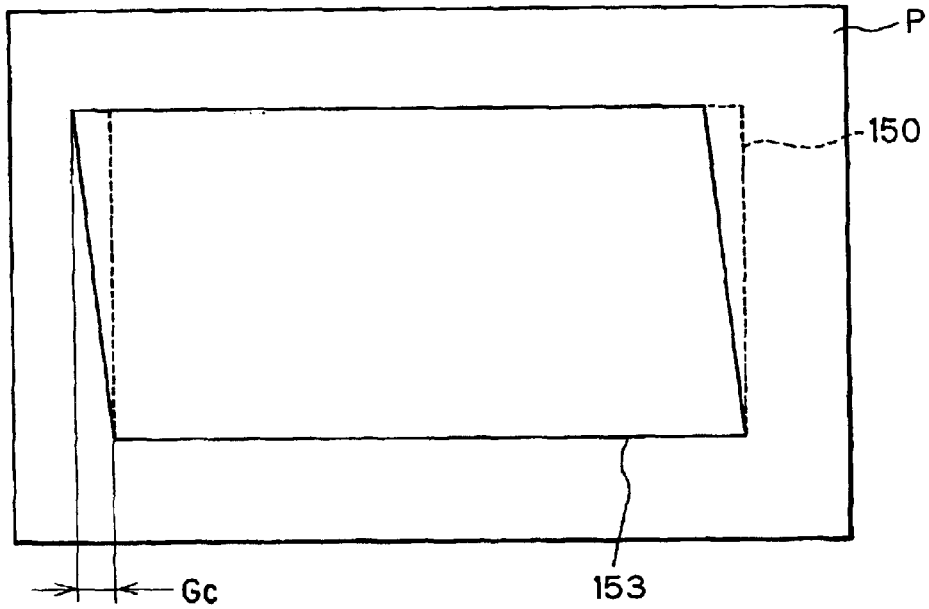

FIGS. 30(*a*), 30(*b*) correspond to the item (3) in Table 3 and show an example of color registration error due to transfer error of image. FIG. 30(*a*) shows an example in which an image is transferred as if the photoreceptor 41Y among the photoreceptors (image carriers) 41 (Y, M, C, and K) is inclined by "de" from the normal position indicated by broken lines so that the rotational surface is located at a position 41Y",. In this case, an image 153 formed on the recording medium "P" is inclined by "Gc" relative to the normal image position 150 as shown in FIG. 30(*b*). That is, the mode of color registration error created in this case is "Inclination of image". In this case, the correction of image error is conducted by rearranging the image data.

Figure 31A:
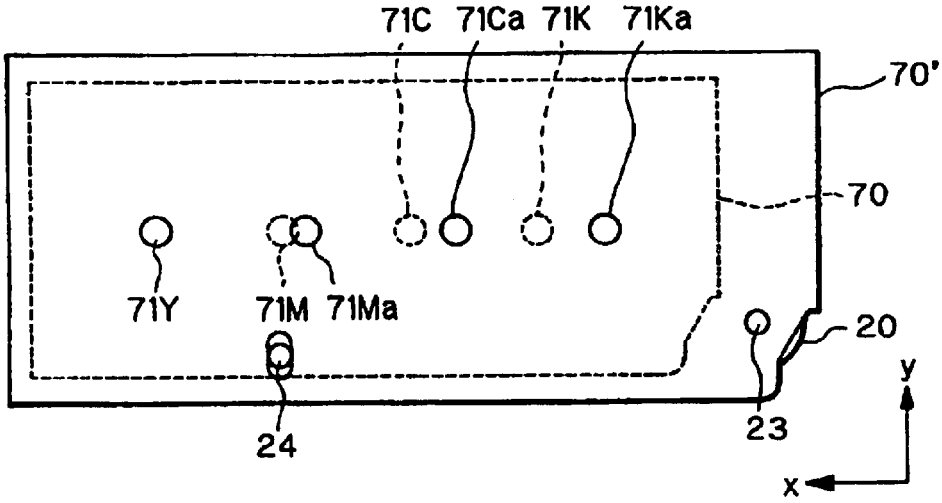
FIGS. 31(*a*), 31(*b*) are illustrations for explaining an example of color registration error of an image carrier cartridge of the third embodiment according to the present invention.
Figure 31B:
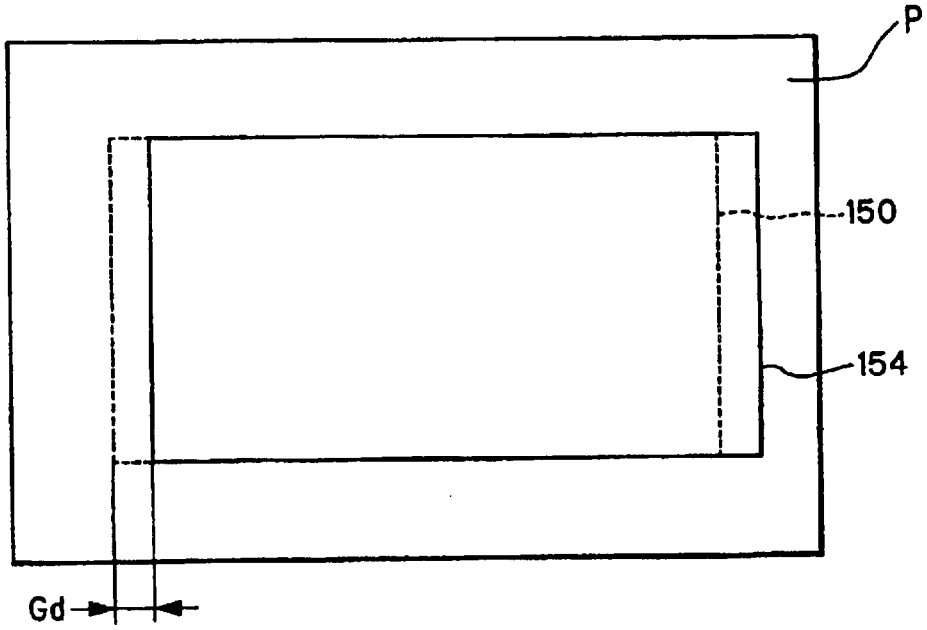

FIGS. 31(*a*), 31(*b*) correspond to the item (4) in Table 3 and show an example of color registration error due to linear expansion of the positioning member. FIG. 31(*a*) shows an example in which the coefficient of linear expansion of a positioning member for the frame 70 holding the photoreceptors (image carriers) 41 (Y, M, C, and K) is increased because of increase in temperature, with the result that the frame 70 varies from the normal position indicated by broken lines to a position 70' indicated by solid lines (in this figure, the variation is shown in an exaggerated form) and the photoreceptors are consequently shifted to positions indicated by 71 (Ma, Ca and Ka). In this case, an image 154 formed on a recording medium "P" is shifted by "Gd" relative to the normal image position 150 as shown in FIG. 31(*b*). That is, the start timing for writing an image is earlier than the normal state. The mode of color registration error created in this case is "Variation in start position of writing an image in "X" direction when the apparatus temperature varies". In this case, the correction of image error is conducted by correcting the start timing for writing an image according to the apparatus temperature. In the example of FIG. 31(*b*), the color registration error is corrected by delaying the start timing of writing an image from the normal state. Accordingly, the color registration errors due to variations in linear expansion of the positioning member or alteration in coefficient of linear expansion because the material is changed can be corrected.

FIGS. 32(*a*), 32(*b*) correspond to the item (5) in Table 3 and show an example of color registration error due to decentering and the direction of the decentering of the gear of an image carrier. Referring to FIG. 32(*a*), the shafts 71 (Y, M, C, and K) and the gears 72 (Y, M, C, and K) of the photoreceptors (image carriers) 41 (Y, M, C, and K), and idle gears 81 through 83 are arranged. The gears 72 (Y, M, C, and K) are formed by using the same mold. In addition, the shaft 23 of the driving roller 20 and the shaft 24 of the tension roller are supported. For example, since the gear 72Y of the image carrier 41Y is decentered, the shaft 71Y is arranged at a position shifted by "df" from the normal position. In this case, information on color registration error due to the decentering and the direction of the decentering (in the illustrated example, the shaft 71Y is shifted from the normal position to the right as seen in the drawing) of the gear of the image carrier is obtained. As shown in FIG. 32(*b*), an image 155 shifted in the "X" direction relative to the normal image position 150 is formed. That is, the mode of color registration error created in this case is "Variation in position of image in "X" direction". In this case, the correction of image error is conducted by rearranging the image data or correcting the timing of writing an image. As described in the above, according to the present invention, the correction of color registration errors can be conducted on the basis of information on color registration errors which is obtained based on the rotational error of an image carrier by the force transmitting member provided on the image carrier cartridge.

In case of a cartridge employing a laser scanning optical system as the exposure device, information that any of the photoreceptors (image carriers) 41 (Y, M, C, and K) is in a position shifted in the "Y" direction from the normal position may be obtained besides the aforementioned information on color registration errors. The mode of color registration error created in this case is "Variation in width of image in "Z" direction". In this case, the color registration error is corrected by modulating the writing clock for writing an image. Also in case of a cartridge employing a laser scanning optical system as the exposure device, information that any of the photoreceptors (image carriers) 41 (Y, M, C, and K) has a diameter different from the normal diameter, i.e. information on color registration error due to the dimensional error of an image carrier may be obtained. The mode of color registration error created in this case is "Variation in width of image in "Z" direction". In this case, the color registration error is corrected by modulating the writing clock for writing an image.

By the way, among apparatuses of electrophotographic type for forming a latent image on an image carrier and developing the latent image with toner to form a toner image, and then transferring the toner image to a transfer medium, there is a so-called cleaner-less type. The apparatus of this type has no cleaning device as shown in FIG. 1 so that non-transferred toner remaining on the image carrier is collected by a developing device (for example, Japanese Patent Publication H06-77166). In case of employing the cleaner-less type, the cleaning devices 46 (K, C, M, and Y) shown in FIG. 1 are omitted so that the apparatus has a structure as shown in FIG. 33.

Figure 33:
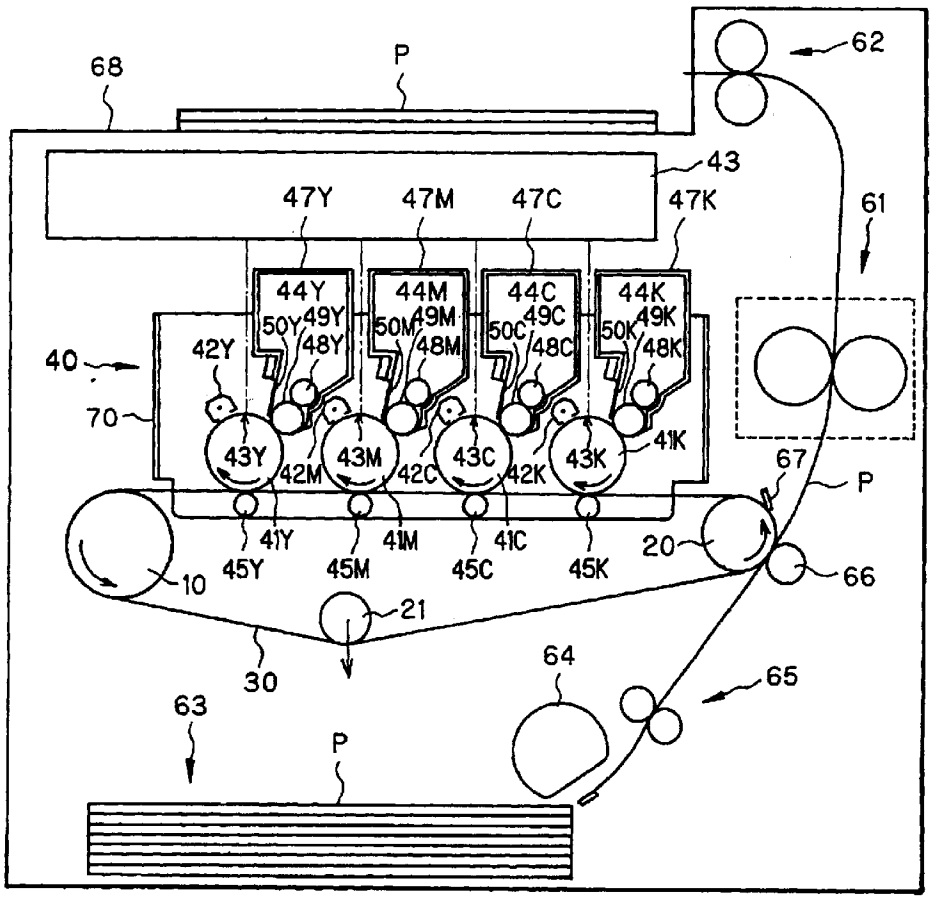
FIG. 33 is a front view showing the entire schematic structure of a color image forming apparatus employing a cleaner-less type.

Except that the cleaning devices 46 (K, C, M, and Y) are not provided, the structure of the apparatus shown in FIG. 33 is substantially the same as that of the apparatus shown in FIG. 1, so the description about the structure and the function will be omitted. Also in this case, the photoreceptor cartridge 40 comprises four photoreceptors 41K, 41C, 41M, and 41Y and corona chargers 42 (K, C, M, and Y) which are arranged around the photoreceptors 41K, 41C, 41M, and 41Y, respectively, similarly to the case of FIG. 1 and FIG. 2. By employing the structure without a cleaning device, the size of the photoreceptor cartridge 40 and the apparatus body can be reduced. In addition, reaction force can be reduced because some reaction force applied to the photoreceptors 41 (K, C, M, and Y) is created due to the blades of the cleaning devices. This reduces the deformation of the frame 70. Therefore, the color registration error created by misalignment of the photoreceptors 41 (K, C, M, and Y) due to the deformation of the frame 70 can be prevented.

Figure 34:
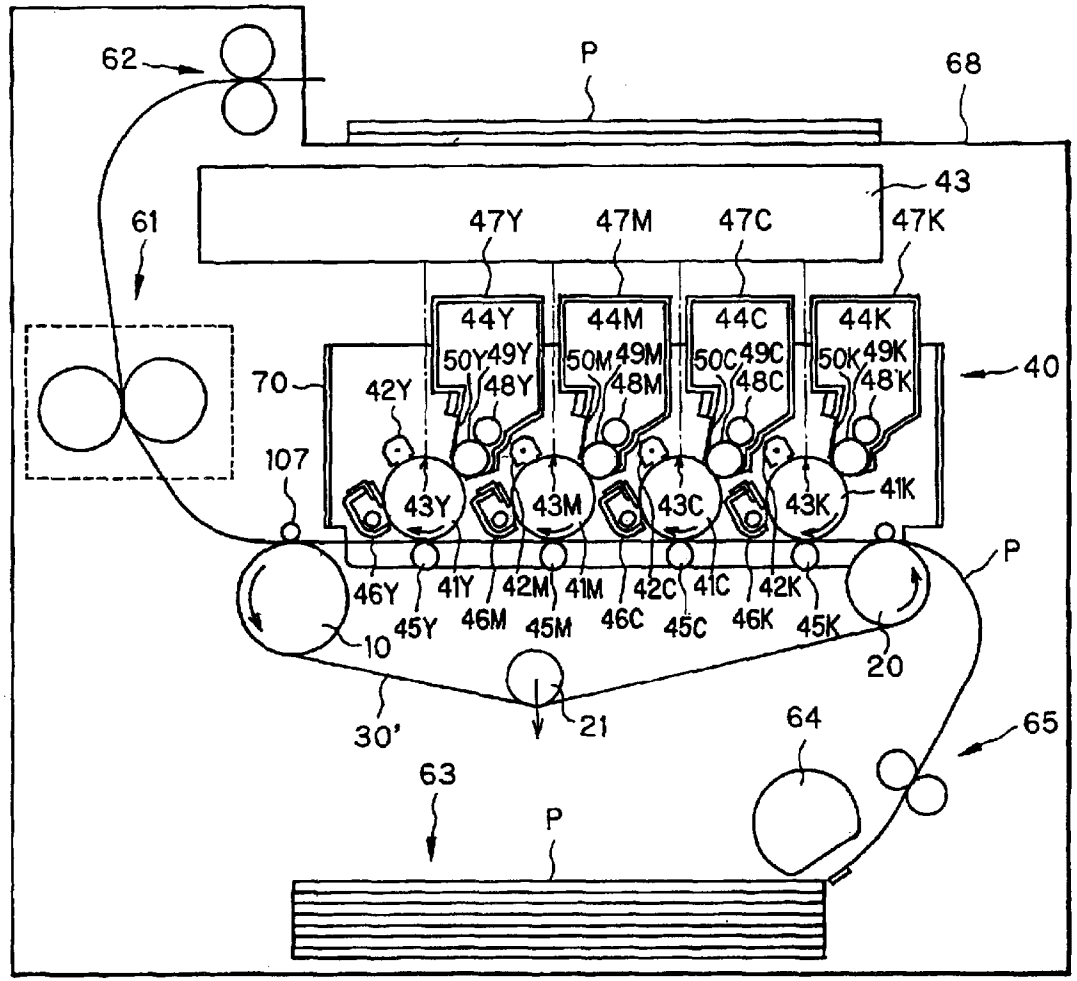
FIG. 34 is a front view showing the entire schematic structure of a color image forming apparatus employing a recording medium holding belt instead of an intermediate transfer belt.

The above embodiments have been explained with regard to the aspect in which four photoreceptors 41 (K, C, M, and Y) are accommodated together in the photoreceptor (image carrier) cartridge 40 in the image forming apparatus of tandem type employing the intermediate transfer belt 30 (FIG. 1). The present invention may be adopted to another aspect. FIG. 34 is a front view showing an apparatus of which structure is different from the aforementioned structure. The different points in the structure of FIG. 34 from the structure of FIG. 1 will be described. In the example of FIG. 34, a recording medium holding belt 30' is employed instead of the intermediate transfer belt 30. Recording media are picked up from a sheet cassette 63 by a pick-up roller 64 one by one. The recording medium (paper) "P" is fed by the recording medium holding belt 30' at the right time which is defined by a pair of gate rollers 65 to come in synchronization with electrostatic latent images formed on the photoreceptors 41 (K, C, M, and Y) by exposure.

Toner images formed on the photoreceptors 41 (K, C, M, and Y) are sequentially transferred to the recording medium "P" fed by the recording medium holding belt 30' by the function of primary transfer rollers 45 (K, C, M, Y). These toner images are superposed on each other so as to form a full-color toner image on the recording medium "P". The recording medium "P" with the full-color toner image is peeled off from the recording medium holding belt 30' by a peeling roller 107. Then, the recording medium "P" passes through a pair of fixing rollers 61 as the fixing section, thereby fixing the full-color toner image on the recording medium "P". After that, the recording medium "P" is discharged through a pair of sheet delivery rollers 62 onto an outfeed tray 68 formed on the top of the apparatus body.

The structure of the photoreceptor cartridge 40 of the example of FIG. 34 is the same as that of FIG. 1. As mentioned above, the present invention may be adopted to an image forming apparatus of a tandem type using a recording medium holding belt, not a type using an intermediate transfer belt, in which a recording medium is held and carried by the recording medium holding belt and toner images are transferred to the recording medium. Accordingly, the present invention may be adopted to a type using a recording medium holding belt, instead of an intermediate transfer belt, in which a recording medium such as a paper sheet is held and carried by a recording medium holding belt and toner images formed by a plurality of unicolor toners are sequentially transferred to the recording medium so that the toner images of plural colors are superposed on each other and then fixed.

Figure 35:
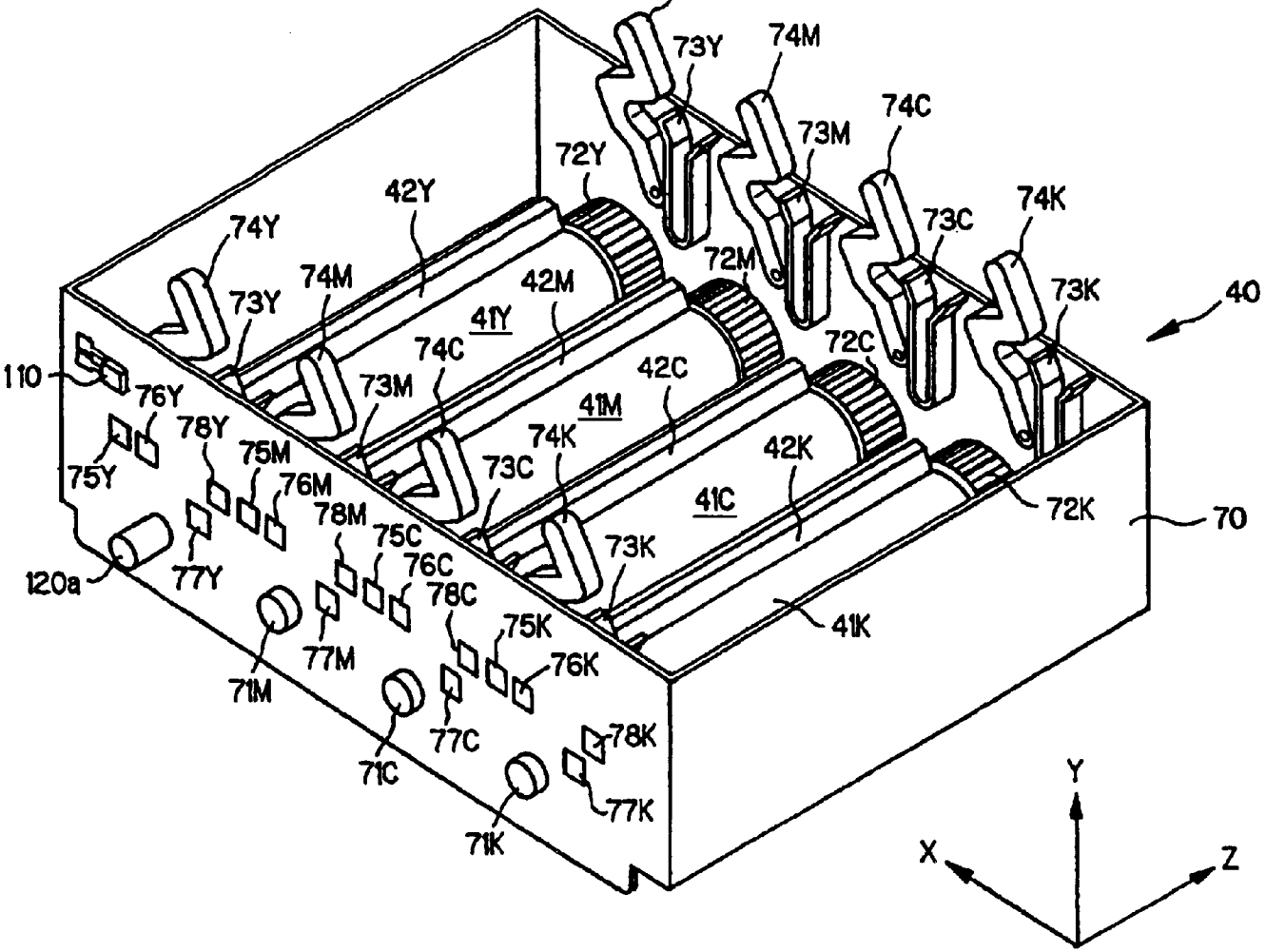
FIG. 35 is a perspective view showing another embodiment of the present invention.

FIG. 35 is a perspective view showing another embodiment of the present invention. Only different points from the structure shown in FIG. 2 will be described. The embodiment of FIG. 35 comprises a member 120*a* which functions as the shaft 71 Y for the photoreceptor 41Y and the positioning pin for the photoreceptor cartridge 40. Since such a member having two functions as the shaft of the photoreceptor and the positioning pin, the number of parts is reduced and the manufacturing cost is reduced in comparison with the structure of FIG. 2. The shaft of the image carrier functioning as the positioning pin for positioning the photoreceptor cartridge 40 relative to the apparatus body is the shaft of the image carrier for reference color (in this embodiment, the photoreceptor 41Y for yellow which is the most inconspicuous color by its fog). Therefore, the information on color registration error obtained in this embodiment is the information about positions of the other image carriers with reference to the image carrier for the reference color. Therefore, the information about positions of the image carriers relative to the body can be held and the absolute position of images for the respective colors can be corrected. Further, the need of holding information about the position of the image carrier for the reference color can be eliminated, thereby reducing the memory capacity of the storage means.

Figure 36:
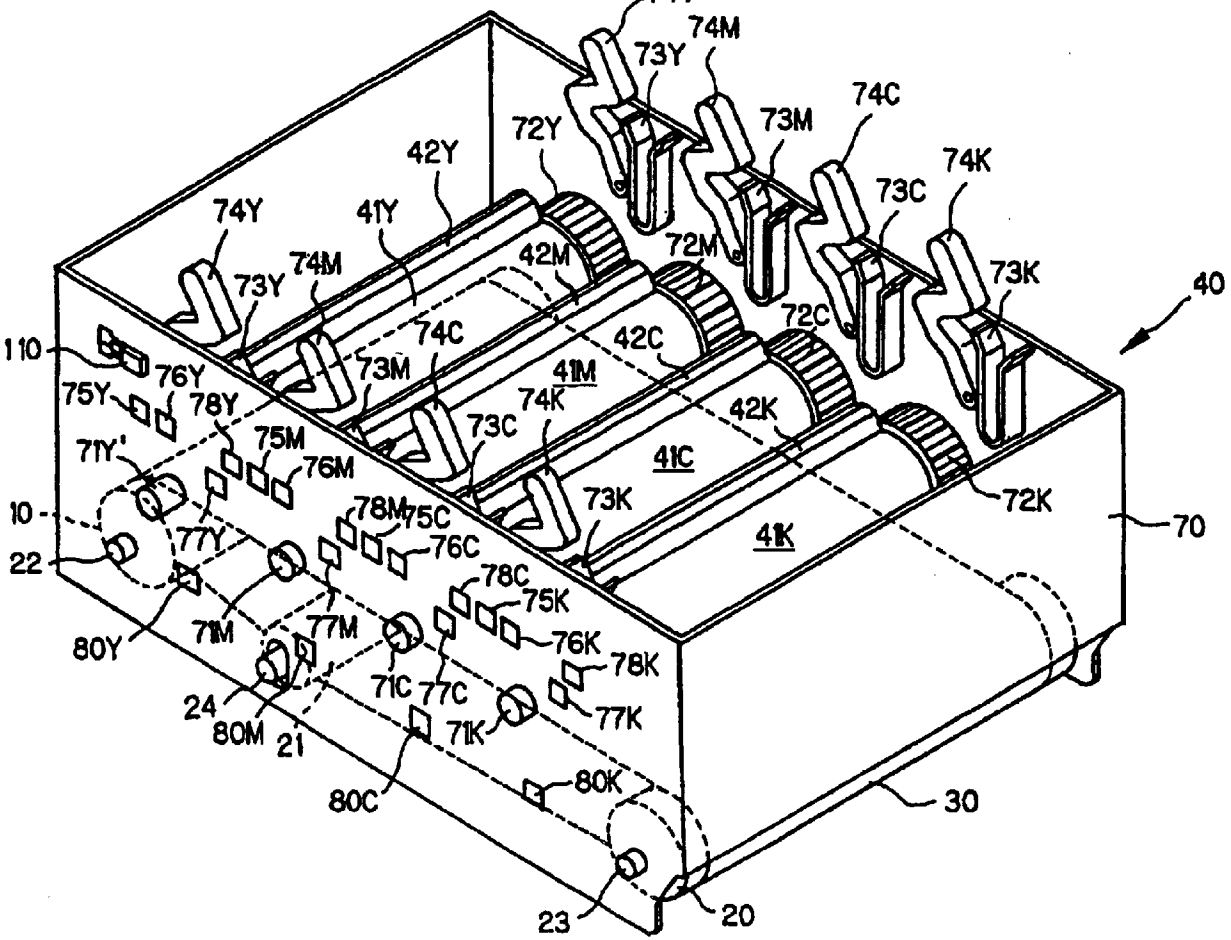
FIG. 36 is a perspective view showing another embodiment of the present invention.

FIG. 36 is a perspective view showing another embodiment of the present invention. Only different points from the structure shown in FIG. 8 will be described. The embodiment of FIG. 36 comprises a member 71Y which functions as the shaft 71 Y for the photoreceptor 41Y and the positioning pin for the photoreceptor cartridge 40. Since such a member having two functions as the shaft of the photoreceptor and the positioning pin, the number of parts is reduced and the manufacturing cost is reduced in comparison with the structure of FIG. 8. The shaft of the image carrier functioning as the positioning pin for positioning the photoreceptor cartridge 40 relative to the apparatus body is the shaft of the image carrier for reference color (in this embodiment, the photoreceptor 41Y for yellow which is the most inconspicuous color by its fog). Therefore, the information on color registration error obtained in this embodiment is the information about positions of the other image carriers with reference to the image carrier for the reference color. Therefore, the information about positions of the image carriers relative to the body can be held and the absolute position of images for the respective colors can be corrected. Further, the need of holding information about the position of the image carrier for the reference color can be eliminated, thereby reducing the memory capacity of the storage means.

In the present invention, information on color registration error due to rotational errors of the image carriers can be obtained. The rotational errors may be caused according to the machining precision of the driving force transferring members (including the gears 81–86 described with reference to FIG. 12) for the image carriers arranged in the photoreceptor cartridge 40. Therefore, the color registration error due to rotational error of the image carrier can be prevented.

As described above, according to the image forming apparatus of the present invention, a plurality of image carriers 41 (K, C, M, and Y) are mounted in the photoreceptor cartridge 40 such that the image carriers 41 (K, C, M, and Y) are arranged at proper relative positions. The developing devices 44 (K, C, M, and Y) are arranged detachably relative to the photoreceptors 41 (K, C, M, and Y) mounted in the photoreceptor cartridge 40, thereby improving the accuracy of relative positions of the photoreceptors and preventing the color registration error due to the misalignment and the skew of the photoreceptors.

In the cartridge photoreceptor 40, gears (photoreceptor gears) can be assembled to the photoreceptors to satisfy such a phase relation as to reduce variation in speed due to the photoreceptor gears for driving the photoreceptors. Further, the color registration error due to the photoreceptor gears can be reduced (FIG. 12). In case of separately mounting the photoreceptors to the apparatus body, since the photoreceptors rotate individually, the phase adjustment among the photoreceptor gears is impossible. Before shipment, photoreceptors having even characteristics can be selected for the photoreceptor cartridge 40, whereby the color registration error due to the variation in characteristics of the photoreceptors for respective colors can be prevented. A plurality of photoreceptors can be replaced at the same time, thereby improving the maintainability.

Since it is designed that the developing devices 44 (K, C, M, and Y) are detachable relative to the photoreceptor cartridge 40, the developing devices 44 (K, C, M, and Y) and the photoreceptor cartridge 40 can be replaced individually. Therefore, one of the developing devices 44 (K, C, M, and Y) which has reached the end of its life can be replaced without replacing the photoreceptors 41 (K, C, M, and Y), thereby reducing the running cost. If the developing device 44 (K, C, M, Y) which has reached the end of its life is replaced, since the developing device 44 (K, C, M, Y) is replaced alone, the color matching operation according to the positions and the profiles of the photoreceptors 41 (K, C, M, and Y) is not necessary, thereby providing an image forming apparatus having improved working efficiency. Since the replacement of the developing device 44 (K, C, M, Y) can be conducted after the photoreceptor cartridge 40 is drawn out from the apparatus body, the developing device 44 (K, C, M, Y) is detached and attached relative to the photoreceptor cartridge 40, thereby facilitating the replacement of the developing device 44 (K, C, M, Y) and improving the maintainability.

In the aforementioned embodiments, the writing means mounted together with the photoreceptor 41 (K, C, M, Y) and the intermediate transfer belt 30 to the photoreceptor cartridge 40 is not limited to the writing means composed of an LED line head as shown in FIG. 11 and may be an organic EL line head composed of an organic EL array as proposed, for example, in Japanese Patent Application 2001-208076 filed by the applicant of this application. The writing means may be a liquid crystal line head composed of liquid crystal shutter array. Alternatively, the writing means may be a laser scanning optical system using a semiconductor laser. The writing means mounted together with the photoreceptor 41 (K, C, M, Y) to the photoreceptor cartridge 40 may not be limited to the writing means using light or laser and may be a writing means using charge-transfer such as charge injection or charge removal, as proposed, for example, in Japanese Patent Application 2000-298925 and Japanese Patent Application 2000-298927 filed by the applicant of this application.

As apparent from the aforementioned description, according to the photoreceptor cartridge and the image forming apparatus of the present invention, the photoreceptor cartridge has information on color registration error such as positioning error of image carriers, whereby the color registration error can be corrected during the image formation by the image forming apparatus so as to achieve the image formation without color registration error. Since the photoreceptor cartridge supporting a plurality of image carriers together is detachably attached, the maintainability of the photoreceptor cartridge is improved and the running cost is reduced. In addition, the reduction in precision of machining and assembling the positioning member is allowed. Since the storage means stores information on color registration error inherent in each photoreceptor cartridge, the formation of an image without color registration error is obtained even if the photoreceptor cartridge is replaced. Since the photoreceptor cartridge housing the writing means has information on color registration error such as positioning error of image carriers, the color registration error can be corrected during the image formation by the image forming apparatus so as to achieve image formation without color registration error. The color registration error due to error in transfer position on the image carrier can be corrected.

While the image forming apparatus of the present invention has been described with reference to particular embodiments, the present invention is not limited to the particular embodiments and various changes and modifications may be made.

I claim:

1. An image carrier cartridge which is designed to be detachable relative to an image forming apparatus of a tandem type, said image forming apparatus comprising at least two image forming stations each of which is composed of an image carrier, and a charging means, a writing means, a developing means, and a transfer means which are arranged around the image carrier, wherein said image forming apparatus forms a color image by passing a transfer medium through the respective image forming stations, said image carrier cartridge supporting a plurality of said image carriers together and comprising:

a positioning member for positioning the image carriers at proper relative positions;

an electronic module having a storage means in which information on color registration error is stored; and a signal connecting means between said electronic module and an image forming apparatus body.

2. An image carrier cartridge as claimed in claim 1, wherein said information on color registration error is formed on the basis of the respective positions of the image carriers.

3. An image carrier cartridge as claimed in claim 1, wherein said information on color registration error is formed on the basis of the respective profiles of the image carriers.

4. An image carrier cartridge as claimed in claim 1, wherein said information on color registration error is formed on the basis of the respective positions of the image carriers relative to a positioning member of the image carrier cartridge for positioning the image carrier cartridge relative to the image forming apparatus body.

5. An image carrier cartridge as claimed in claim 4, wherein said positioning member of the image carrier cartridge for positioning the image carrier cartridge relative to the image forming apparatus body is a shaft of the image carrier for a reference color and wherein said information on color registration error is formed on the basis of the positions of the other image carriers relative to the image carrier for the reference color.

6. An image carrier cartridge as claimed in claim 1, wherein said information on color registration error is formed on the basis of the coefficient of linear expansion of the positioning member for the image carriers.

7. An image carrier cartridge as claimed in claim 1, wherein driving force produced at one portion of the image forming apparatus body diverges and is transmitted to all of a plurality of said image carriers within the image carrier cartridge.

8. An image carrier cartridge as claimed in claim 1 wherein no cleaning means for collecting remaining developer is disposed around said image carriers.

9. An image forming apparatus of a tandem type comprising at least two image forming stations each of which is composed of an image carrier, and a charging means, a writing means, a developing means, and a transfer means which are arranged around the image carrier, wherein said image forming apparatus forms a color image by passing a transfer medium through the respective image forming stations, said image forming apparatus comprising:

an image carrier cartridge having a positioning member for positioning the image carriers at proper relative positions; an electronic module having a storage means in which information on color registration error is stored; and a signal connecting means between said electronic module and an image forming apparatus body, wherein said image carrier cartridge is designed to be detachable relative to the image forming apparatus body and supports a plurality of said image carriers together; and a correcting means for correcting color registration errors on the basis of a signal from said electronic module.

10. An image forming apparatus as claimed in claim 9, wherein said information on color registration error is formed on the basis of the respective positions of the image carriers.

11. An image forming apparatus as claimed in claim 9, wherein said information on color registration error is formed on the basis of the respective profiles of the image carriers.

12. An image forming apparatus as claimed in claim 9, wherein said information on color registration error is formed on the basis of the respective positions of the image carriers relative to a positioning member of the image carrier cartridge for positioning the image carrier cartridge relative to the image forming apparatus body.

13. An image forming apparatus as claimed in claims 12, wherein said positioning member of the image carrier cartridge for positioning the image carrier cartridge relative to the image forming apparatus body is a shaft of the image carrier for a reference color and wherein said information on color registration error is formed on the basis of the positions of the other image carriers relative to the image carrier for the reference color.

14. An image forming apparatus as claimed in claim 9, wherein said information on color registration error is formed on the basis of the coefficient of linear expansion of the positioning member for the image carriers.

15. An image carrier cartridge which is designed to be detachable relative to an image forming apparatus of a tandem type, said image forming apparatus comprising at least two image forming stations each of which is composed of an image carrier, and a charging means, a writing means, a developing means, and a transfer means which are arranged around the image carrier, wherein said image forming apparatus forms a color image by passing a transfer medium through the respective image forming stations, said image carrier cartridge supporting a plurality of said image carriers together and comprising:

a positioning member for positioning the image carriers at proper relative positions;

said writing means located at positions corresponding to the respective image carriers;

an electronic module having a storage means in which information on color registration error is stored; and a signal connecting means between said electronic module and an image forming apparatus body.

16. An image carrier cartridge as claimed in claim 15, wherein said information on color registration error is formed on the basis of the respective positions of the image carriers.

17. An image carrier cartridge as claimed in claim 15, wherein said information on color registration error is formed on the basis of the respective writing positions of the image carriers.

18. An image carrier cartridge as claimed in claim 15, wherein said information on color registration error is formed on the basis of the respective parallelisms of the writing means relative to the axes of the image carriers.

19. An image carrier cartridge as claimed in claim 15, wherein said information on color registration error is formed on the basis of the respective positions of the image carriers relative to a positioning member of the image carrier cartridge for positioning the image carrier cartridge relative to the image forming apparatus body.

20. An image carrier cartridge as claimed in claim 19, wherein the positioning member of the image carrier cartridge for positioning the image carrier cartridge relative to the image forming apparatus body is a shaft of the image carrier for a reference color and wherein said information on color registration error is formed on the basis of the positions of the other image carriers relative to the image carrier for the reference color.

21. An image carrier cartridge as claimed in claim 15, wherein said information on color registration error is formed on the basis of the coefficient of linear expansion of the positioning member for the image carriers.

22. An image carrier cartridge as claimed in claim 15, wherein said information on color registration error is formed on the basis of the rotational error of the image carrier due to a driving force transmitting member for the image carriers provided on the image carrier cartridge.

23. An image carrier cartridge as claimed in claim 15, wherein driving force produced at one portion of the image forming apparatus body diverges and is transmitted to all of a plurality of said image carriers within the image carrier cartridge.

24. An image carrier cartridge as claimed in any one of claims 15, through 19 wherein no cleaning means for collecting remaining developer is disposed around said image carriers.

25. An image forming apparatus of a tandem type comprising at least two image forming stations each of which is composed of an image carrier, and a charging means, a writing means, a developing means, and a transfer means which are arranged around the image carrier, wherein said image forming apparatus forms a color image by passing a transfer medium through the respective image forming stations, said image forming apparatus comprising:

an image carrier cartridge having a positioning member for positioning the image carriers at proper relative positions; writing means located at positions corresponding to the respective image carriers; an electronic module having a storage means in which information on color registration error is stored; and a signal connecting means between said electronic module and an image forming apparatus body, wherein said image carrier cartridge is designed to be detachable relative to the image forming apparatus body and supports a plurality of said image carriers together; and a correcting means for correcting color registration errors on the basis of a signal from said electronic module.

26. An image forming apparatus as claimed in claim 25, wherein said information on color registration error is formed on the basis of the respective positions of the image carriers.

27. An image forming apparatus as claimed in claim 25, wherein said information on color registration error is formed on the basis of the respective writing positions of the image carriers.

28. An image forming apparatus as claimed in claim 25, wherein said information on color registration error is formed on the basis of the respective parallelisms of the writing means relative to the axes of the image carriers.

29. An image forming apparatus as claimed in claim 25, wherein said information on color registration error is formed on the basis of the respective positions of the image carriers relative to a positioning member of the image carrier cartridge for positioning the image carrier cartridge relative to the image forming apparatus body.

30. An image forming apparatus as claimed in claim 29, wherein the positioning member of the image carrier cartridge for positioning the image carrier cartridge relative to the image forming apparatus body is a shaft of the image carrier for a reference color and wherein said information on color registration error is formed on the basis of the positions of the other image carriers relative to the image carrier for the reference color.

31. An image forming apparatus as claimed in claim 25, wherein said information on color registration error is formed on the basis of the coefficient of linear expansion of the positioning member for the image carriers.

32. An image forming apparatus as claimed in claim 25, wherein said information on color registration error is formed on the basis of the rotational error of the image carrier due to a driving force transmitting member for the image carriers provided on the image carrier cartridge.

33. An image carrier cartridge which is designed to be detachable relative to an image forming apparatus of a tandem type, said image forming apparatus comprising at least two image forming stations each of which is composed of an image carrier, and a charging means, a writing means, a developing means, and a transfer means which are arranged around the image carrier, wherein said image forming apparatus forms a color image by passing a transfer medium through the respective image forming stations, said image carrier cartridge supporting a plurality of said image carriers together and comprising:

a positioning member for positioning the image carriers at proper relative positions;

said writing means located at positions corresponding to the respective image carriers;

said transfer means arranged to be in contact with a plurality of said image carriers;

an electronic module having a storage means in which information on color registration error is stored; and a signal connecting means between said electronic module and an image forming apparatus body.

34. An image carrier cartridge as claimed in claim 33, wherein said information on color registration error is formed on the basis of the respective writing positions of the image carriers.

35. An image carrier cartridge as claimed in claim 33, wherein said information on color registration error is formed on the basis of the respective transfer positions on the image carriers.

36. An image carrier cartridge as claimed in claim 33, wherein said information on color registration error is formed on the basis of the coefficient of linear expansion of the positioning member for the image carriers.

37. An image carrier cartridge as claimed in claim 33, wherein said information on color registration error is formed on the basis of the rotational error of the image carrier due to a driving force transmitting member for the image carriers provided on the image carrier cartridge.

38. An image carrier cartridge as claimed in claim 33, wherein driving force produced at one portion of the image forming apparatus body diverges and is transmitted to all of a plurality of said image carriers within the image carrier cartridge.

39. An image carrier cartridge as claimed in claim 33, wherein no cleaning means for collecting remaining developer is disposed around said image carriers.

40. An image forming apparatus of a tandem type comprising at least two image forming stations each of which is composed of an image carrier, and a charging means, a writing means, a developing means, and a transfer means which are arranged around the image carrier, wherein said image forming apparatus forms a color image by passing a transfer medium through the respective image forming stations, said image forming apparatus comprising:

an image carrier cartridge having a positioning member for positioning the image carriers at proper relative positions; writing means located at positions corresponding to the respective image carriers; a transfer means arranged to be in contact with a plurality of said image carriers; an electronic module having a storage means in which information on color registration error is stored; and a signal connecting means between said electronic module and an image forming apparatus body, wherein said image carrier cartridge is designed to be detachable relative to the image forming apparatus body and supports a plurality of said image carriers together; and a correcting means for correcting color registration errors on the basis of a signal from said electronic module.

41. An image forming apparatus as claimed in claim 40, wherein said information on color registration error is formed on the basis of the respective writing positions of the image carriers.

42. An image forming apparatus as claimed in claim 40, wherein said information on color registration error is formed on the basis of the respective transfer positions on the image carriers.

43. An image forming apparatus as claimed in claim 40, wherein said information on color registration error is formed on the basis of the coefficient of linear expansion of the positioning member for the image carriers.

44. An image forming apparatus as claimed in claim 40, wherein said information on color registration error is formed on the basis of the rotational error of the image carrier due to a driving force transmitting member for the image carriers provided on the image carrier cartridge.

* * * * *